US012037779B2

(12) United States Patent
Shimuta et al.

(10) Patent No.: US 12,037,779 B2
(45) Date of Patent: Jul. 16, 2024

(54) FLUSH WATER TANK APPARATUS AND FLUSH TOILET APPARATUS PROVIDED WITH THE SAME

(71) Applicant: TOTO LTD., Kitakyushu (JP)

(72) Inventors: Akihiro Shimuta, Kitakyushu (JP); Hidekazu Kitaura, Kitakyushu (JP); Nobuhiro Hayashi, Kitakyushu (JP); Masahiro Kuroishi, Kitakyushu (JP); Hiroshi Hashimoto, Kitakyushu (JP); Koki Shinohara, Kitakyushu (JP); Kenji Hatama, Kitakyushu (JP); Takashi Yoshioka, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 303 days.

(21) Appl. No.: 17/464,063

(22) Filed: Sep. 1, 2021

(65) Prior Publication Data

US 2022/0074181 A1 Mar. 10, 2022

(30) Foreign Application Priority Data

Sep. 4, 2020 (JP) ..... 2020-149223
Mar. 12, 2021 (JP) ..... 2021-040151

(51) Int. Cl.
*E03D 3/04* (2006.01)
*E03D 1/26* (2006.01)
(Continued)

(52) U.S. Cl.
CPC ..... *E03D 3/04* (2013.01); *E03D 1/266* (2013.01); *E03D 1/34* (2013.01); *E03D 5/024* (2013.01); *E03D 1/302* (2013.01); *E03D 1/33* (2013.01)

(58) Field of Classification Search
CPC ..... E03D 3/044; E03D 1/266; E03D 1/34; E03D 1/33; E03D 1/286; E03D 1/144; E03D 1/302; E03D 5/024
USPC ... 4/415, 332, 324, 394, 329, 331, 398, 447, 4/444, 433, 420.2, 420.4, 420.5; 137/215–218, 907
See application file for complete search history.

(56) References Cited

U.S. PATENT DOCUMENTS 2,744,262 A * 5/1956 Boyd ..... E03D 1/302 4/407
2,760,204 A * 8/1956 Joanis ..... E03D 5/024 4/367

(Continued)

FOREIGN PATENT DOCUMENTS

JP 2009-257061 A 11/2009

*Primary Examiner* — Craig J Price
(74) *Attorney, Agent, or Firm* — Studebaker & Brackett PC

(57) ABSTRACT

A flush water tank apparatus has a reservoir tank, a discharge valve, a discharge valve hydraulic drive portion configured to drive the discharge valve, and a discharge/vacuum break valve device configured to supply the water supplied from the upstream side to the discharge valve hydraulic drive portion on a downstream side. The discharge valve hydraulic drive portion includes a cylinder, and a piston configured to be moved by a pressure of the water flowing into the cylinder to move the discharge valve. The discharge/vacuum break valve device includes a valve body that operates to discharge the water flowing backward from the discharge valve hydraulic drive portion while opening the upstream side to an atmosphere when the supply of the water from the upstream side is stopped.

15 Claims, 22 Drawing Sheets

(51) Int. Cl.

| | |
|---|---|
| ***E03D 1/34*** | (2006.01) |
| ***E03D 5/02*** | (2006.01) |
| *E03D 1/30* | (2006.01) |
| *E03D 1/33* | (2006.01) |

(56) References Cited

U.S. PATENT DOCUMENTS

| | | | | | |
|---|---|---|---|---|---|
| 2,838,765 | A * | 6/1958 | Hosking | F16K 31/34 | 4/407 |
| 3,994,029 | A * | 11/1976 | Badders | E03D 5/024 | 137/445 |
| 4,230,145 | A * | 10/1980 | Badders | E03D 5/024 | 137/445 |
| 4,232,409 | A * | 11/1980 | Van Pham | E03D 5/012 | 4/380 |
| 4,955,921 | A * | 9/1990 | Basile | E03D 5/00 | 4/354 |
| 5,005,226 | A * | 4/1991 | Basile | E03D 3/10 | 4/354 |
| 5,431,181 | A * | 7/1995 | Saadi | E03D 5/10 | 137/315.07 |
| 6,370,707 | B1 * | 4/2002 | Parsons | E03D 5/024 | 4/379 |
| 6,453,479 | B1 * | 9/2002 | Parsons | E03D 1/142 | 4/354 |
| 6,536,053 | B2 * | 3/2003 | Icking | E03D 1/36 | 4/406 |
| 6,934,976 | B2 * | 8/2005 | Parsons | E03D 5/024 | 4/367 |
| 7,010,816 | B2 * | 3/2006 | Li | E03D 3/10 | 4/354 |
| 8,418,278 | B2 * | 4/2013 | Mochita | E03D 9/08 | 4/433 |
| 8,667,621 | B2 * | 3/2014 | Hashimoto | B05B 12/04 | 4/433 |
| 9,745,729 | B2 * | 8/2017 | Yamasaki | E03D 1/32 | |
| 9,834,918 | B2 * | 12/2017 | Veros | E03D 1/00 | |
| 10,221,554 | B2 * | 3/2019 | Veros | E03D 5/026 | |
| 10,995,481 | B2 * | 5/2021 | Veros | E03D 1/00 | |
| 11,186,975 | B2 * | 11/2021 | Kitaura | E03D 5/105 | |
| 11,371,229 | B2 * | 6/2022 | Hayashi | E03D 1/302 | |
| 11,505,933 | B2 * | 11/2022 | Kitaura | E03D 5/024 | |
| 11,746,516 | B2 * | 9/2023 | Veros | E03D 5/105 | 4/406 |

* cited by examiner

FLUSH WATER TANK APPARATUS AND FLUSH TOILET APPARATUS PROVIDED WITH THE SAME

BACKGROUND OF THE INVENTION

Field of the Invention

The present invention relates to a flush water tank apparatus, and particularly to a flush water tank apparatus configured to supply flush water to a flush toilet and a flush toilet apparatus provided with the same.

Description of the Related Art

Japanese Patent Laid-Open No. 2009-257061 discloses a low tank apparatus. In the low tank apparatus, a hydraulic cylinder device having a piston and a drain portion is arranged in a low tank provided with a discharge valve, and the piston and the discharge valve are connected to each other by a connection portion. To discharge flush water in the low tank, an electromagnetic valve is opened to thereby supply the water to the hydraulic cylinder device, so that the piston is pushed up. Since the piston is connected to the discharge valve by the connection portion, the movement of the piston causes the discharge valve to be pulled up to open the discharge valve, whereby the flush water in the low tank is discharged. However, the water supplied to the hydraulic cylinder device flows out through the drain portion, and flows into the low tank.

Furthermore, to close the discharge valve, the electromagnetic valve is closed to thereby stop the supply of the water to the hydraulic cylinder device. This causes the pushed-up piston to be lowered, whereby the discharge valve is returned to a valve closed position by its own weight. In this case, since the water in the hydraulic cylinder device flows out through the drain portion little by little, the piston is slowly lowered, and the discharge valve is gradually returned to the valve closed position.

However, in the low tank apparatus disclosed in Japanese Patent Laid-Open No. 2009-257061, since it takes a long time to return the piston of the hydraulic cylinder device to an original position, the time is required until a next toilet flush operation can be started after one toilet flush operation. That is, in the low tank apparatus disclosed in Japanese Patent Laid-Open No. 2009-257061, when the water flows into the cylinder of the hydraulic cylinder device, the piston is pushed up, and the discharge valve is pulled up. After the discharge valve is pulled up, the water that has flowed into the cylinder flows out through a gap (a drain portion) between a rod portion attached to the piston and a through hole provided in the cylinder, and the piston moves downward to be returned to the original position. Since the gap between the rod portion and the through hole is narrow, it takes a relatively long time to discharge the water in the cylinder. In addition, when the gap is increased, the pressure in the cylinder is not sufficiently increased, which makes it difficult to push up the piston during the toilet flush operation. Therefore, the gap cannot be simply increased.

Japanese Patent Laid-Open No. 2009-257061 also discloses the low tank device configured to discharge the water in the cylinder by connecting a discharge pipe to the cylinder of the hydraulic cylinder device, and providing a discharge pipe electromagnetic valve to this discharge pipe. According to the low tank apparatus, after the discharge valve is pulled up, the discharge pipe electromagnetic valve is opened, whereby the water in the cylinder can be promptly discharged via the discharge pipe. However, in the low tank apparatus of this type, it is necessary to provide a dedicated electromagnetic valve for discharging the water in the cylinder, and therefore the structure of the apparatus is complicated and the hydraulic cylinder device is increased in size.

Accordingly, an object of the present invention is to provide a flush water tank apparatus capable of quickly discharging water in a hydraulic cylinder device (discharge valve hydraulic drive portion) with a simple mechanism while opening a discharge valve using a water supply pressure and returning to a state where a next toilet flush operation can be started in a short time, and a flush toilet apparatus provided with the same.

SUMMARY OF THE INVENTION

To solve the above problems, the present invention is a flush water tank apparatus configured to supply flush water to a flush toilet, the flush water tank apparatus comprising a reservoir tank configured to store the flush water to be supplied to the flush toilet and having a discharge port formed to discharge the stored flush water to the flush toilet, a discharge valve configured to open and close the discharge port to supply the flush water to the flush toilet and to stop a supply of the flush water to the flush toilet, a discharge valve hydraulic drive portion configured to drive the discharge valve using a water supply pressure of supplied water, and a discharge/vacuum break valve device provided on an upstream side of the discharge valve hydraulic drive portion and configured to supply the water supplied from the upstream side to the discharge valve hydraulic drive portion on a downstream side, wherein the discharge valve hydraulic drive portion includes a cylinder into which the water supplied through the discharge/vacuum break valve device flows, and a piston that is slidably disposed in the cylinder, and is configured to be moved by a pressure of the water flowing into the cylinder to move the discharge valve, and the discharge/vacuum break valve device includes a valve body that operates, when the supply of the water from the upstream side is stopped, to discharge the water flowing backward from the discharge valve hydraulic drive portion while opening the upstream side to an atmosphere.

In the present invention configured as described above, the discharge valve hydraulic drive portion is configured to drive the discharge valve using a water supply pressure of the supplied water to open the discharge port of the reservoir tank, whereby the stored flush water is discharged to the flush toilet. The discharge/vacuum break valve device is provided on the upstream side of the discharge valve hydraulic drive portion, and is configured to supply the water supplied from the upstream side to the discharge valve hydraulic drive portion on the downstream side. The discharge valve hydraulic drive portion includes the cylinder and the piston, and the piston that is slidably disposed in the cylinder is moved by a pressure of the water flowing into the cylinder when the water supplied through the discharge/vacuum break valve device flows into the cylinder, whereby the discharge valve is moved. The discharge/vacuum break valve device is configured to discharge the water flowing backward from the discharge valve hydraulic drive portion while opening the upstream side to the atmosphere, when the supply of the water from the upstream side is stopped.

According to the present invention configured as described above, when the supply of the water from the upstream side is stopped, the discharge/vacuum break valve device discharges the water that has flowed backward from the discharge valve hydraulic drive portion, thereby making it possible to discharge the water flowing in the cylinder of the discharge valve hydraulic drive portion with a simple mechanism. This enables the piston to be returned to an initial position quickly, which makes it possible to return to a state where a next toilet flush operation can be started in a short time. Additionally, according to the present invention configured as described above, the discharge/vacuum break valve device opens the upstream side to the atmosphere when the supply of the water from the upstream side is stopped, thereby making it possible to draw the atmosphere when a pressure on the upstream side of the discharge/vacuum break valve device is negative, to prevent the water from flowing backward to the upstream side.

In the present invention, it is preferable that the discharge/vacuum break valve device includes an inflow port through which the supplied water flows, an outflow port through which the water flowing into the discharge/vacuum break valve device is supplied to the discharge valve hydraulic drive portion, and an air intake/water discharge opening configured to be opened and closed by a valve body, the inflow port is provided above the outflow port, and the air intake/water discharge opening is formed in a vertical face or a sloping surface.

According to the present invention configured as described above, the inflow port is provided above the outflow port, thereby making it possible to reliably prevent the water that has flowed backward from the discharge valve hydraulic drive portion to the outflow port from flowing backward to the inflow port. Additionally, the air intake/water discharge opening configured to be opened or closed by the valve body is formed in the vertical face or the sloping surface, thereby making it possible to draw the atmosphere from the upper portion of the air intake/water discharge opening while discharging, from a lower portion of the air intake/water discharge opening, the water that has flowed backward from the discharge valve hydraulic drive portion to the outflow port, whereby the water discharge and the air drawing can be simultaneously performed.

In the present invention, it is preferable that an area of the air intake/water discharge opening in the discharge/vacuum break valve device is larger than the area of the outflow port in the discharge/vacuum break valve device.

According to the present invention configured as described above, the area of the air intake/water discharge opening is larger than the area of the outflow port in the discharge/vacuum break valve device, thereby making it possible to reliably draw the atmosphere while discharging the water that has flowed backward from the discharge valve hydraulic drive portion to the outflow port.

In the present invention, it is preferable that the air intake/water discharge opening of the discharge/vacuum break valve device is formed to be longer in a vertical direction than in a horizontal direction.

According to the present invention configured as described above, the air intake/water discharge opening is formed to be longer in the vertical direction than in the horizontal direction, thereby making it possible to reliably perform the discharge of the backward-flow water and the atmosphere drawing with a small opening area.

In the present invention, it is preferable that the valve body of the discharge/vacuum break valve device is provided turnably around a predetermined central axis, and the air intake/water discharge opening is opened and closed by turning the valve body.

According to the present invention configured as described above, the air intake/water discharge opening is opened and closed by turning the valve body in the discharge/vacuum break valve device, thereby making it possible to configure an opening/closing mechanism of the air intake/water discharge opening in a compact manner, to improve the flexibility in design of the discharge/vacuum break valve device.

In the present invention, it is preferable that the predetermined central axis is disposed outside a perpendicular projection plane of the air intake/water discharge opening.

According to the present invention configured as described above, the central axis around which the valve body is turned is disposed outside the perpendicular projection plane of the air intake/water discharge opening, thereby making it possible to reliably ensure a crush amount of the packing for sealing between an edge portion of the air intake/water discharge opening and the valve body, to thereby reliably close the air intake/water discharge opening.

In the present invention, it is preferable that a bottom edge of the air intake/water discharge opening is formed to extend horizontally, and the water flowing backward from the discharge valve hydraulic drive portion to the discharge/vacuum break valve device is discharged into the reservoir tank beyond the bottom edge.

According to the present invention configured as described above, the bottom edge of the air intake/water discharge opening extends horizontally and the backward-flow water is discharged into the reservoir tank beyond the bottom edge, thereby making it possible to increase an area of the flow path through which the discharge water flows beyond the bottom edge, to thereby reduce a rise of the water level in the discharge/vacuum break valve device.

In the present invention, it is preferable that a top edge of the air intake/water discharge opening is formed to extend horizontally.

According to the present invention configured as described above, the top edge of the air intake/water discharge opening extends horizontally, thereby making it possible to increase an area of the flow path through which the external air is drawn through the air intake/water discharge opening even in a state where the water is discharged from the air intake/water discharge opening, to thereby reliably draw the atmosphere.

In the present invention, it is preferable that the valve body is in a stand-by position where a position of the center of gravity of the valve body is lowest in a state where the water is not supplied to the discharge/vacuum break valve device.

According to the present invention configured as described above, the valve body is in the stand-by position where the position of the center of gravity is lowest in the state where the water is not supplied to the discharge/vacuum break valve device, thereby making it possible to return the valve body to the stand-by position by its own weight with a simple structure.

In the present invention, it is preferable that the valve body includes a weight.

According to the present invention configured as described above, the valve body includes the weight, thereby making it possible to increase the gravity applied to the valve body, to thereby reliably return the valve body to the stand-by position with a simple structure.

In the present invention, it is preferable that the discharge/vacuum break valve device includes a biasing spring, and the biasing spring biases the valve body in a direction in which the air intake/water discharge opening is opened.

According to the present invention configured as described above, the valve body includes the biasing spring that biases the valve body in a direction in which the air intake/water discharge opening is opened, thereby making it possible to reliably open the air intake/water discharge opening when the supply of the water to the discharge/vacuum break valve device is stopped.

In the present invention, it is preferable that the biasing spring is configured to increase an increase in biasing force with respect to an increase in deformation amount as the deformation amount is increased.

First, since a static pressure is applied to the valve body in a state where the air intake/water discharge opening is closed, a large force is required to open the valve body. However, since the static pressure is not applied to valve body in a state where the air intake/water discharge opening is opened even a little bit, the valve body can be moved with a small force. According to the present invention configured as described above, since the biasing spring is configured to increase an increase in biasing force with respect to an increase in deformation amount as the deformation amount is increased, the biasing force in the direction of opening the valve body becomes the largest in a state where the air intake/water discharge opening is closed and the biasing spring is most deformed. This makes it possible to easily open the valve body when the supply of the water to the discharge/vacuum break valve device is stopped. On the other hand, the biasing force is reduced in a region where the deformation amount of the biasing force is small, thereby making it possible to easily move the valve body to be closed when the supply of the water to the discharge/vacuum break valve device is started.

In the present invention, it is preferable that the biasing spring does not apply the biasing force to the valve body in a state where the air intake/water discharge opening is open by a predetermined amount or more.

According to the present invention configured as described above, the biasing force is not applied to the valve body in the state where the air intake/water discharge opening is open by a predetermined amount or more, thereby making it possible to easily move the valve body to be closed when the supply of the water to the discharge/vacuum break valve device is started. On the other hand, the biasing force is applied to the valve body when the opening degree of the air intake/water discharge opening is less than the predetermined amount, thereby making it possible to easily open the valve body when the supply of the water to the discharge/vacuum break valve device is stopped.

In the present invention, it is preferable that the flush water tank apparatus further comprises a flow rate reduction unit configured to reduce a flow rate of the water flowing backward from the discharge valve hydraulic drive portion to the discharge/vacuum break valve device.

According to the present invention configured as described above, the flow rate of the water flowing backward to the discharge/vacuum break valve device is reduced by the flow rate reduction unit, thereby making it possible to prevent the air intake/water discharge opening from being filled with a large flow rate of water from flowing backward from the discharge valve hydraulic drive portion, so that the external air can be drawn.

In the present invention, it is preferable that the flush water tank apparatus further comprises a power generator that includes a water turbine configured to be rotated by a flow of the supplied water and a power generating portion configured to generate electric power by the rotation of the water turbine, and a water supply controller that includes an electromagnetic valve configured to be operated by the electric power generated by the power generator and is configured to control supply and supply stop of the water to the discharge/vacuum break valve device, wherein the discharge valve hydraulic drive portion includes an outer shell portion disposed to surround at least a part of the discharge valve on a plan view, and the power generator is disposed above a stopped water level in the reservoir tank and is disposed on an opposite side across the outer shell portion from a landing position where the water discharged from the discharge/vacuum break valve device lands on a water surface in the reservoir tank, in a left-right direction on the plan view.

In the present invention configured as described above, the power generator is disposed above the stopped water level in the reservoir tank, and is disposed on the opposite side across the outer shell portion from the landing position where the water discharged from the discharge/vacuum break valve device lands on the water surface in the reservoir tank, in the left-right direction on the plan view. As a result, the outer shell portion blocks scattering of the water when the water that has flowed out from the discharge/vacuum break valve device lands on the water surface in the reservoir tank, thereby making it possible to prevent exposure of the power generator to the water.

In the present invention, it is preferable that in a case where the reservoir tank is equally divided into three regions, which are a left-side region, a center region, and a right-side region, in the left-right direction on the plan view, the power generator is disposed in a region different from a region to which the landing position belongs.

In the present invention configured as described above, among the left-side region, the center region, and the right-side region on the plan view, the power generator is disposed in a region different from the region to which the landing position belongs, thereby making it possible to secure a relatively large distance between the landing position and the power generator. This can effectively prevent the power generator from being splashed with the water scattered when the water that has flowed out from the discharge/vacuum break valve device lands on the water surface in the reservoir tank.

In the present invention, it is preferable that the landing position is located in any one of the left-side region and the right-side region in the reservoir tank on the plan view, the power generator is disposed in the other of the left-side region and the right-side region in the reservoir tank on the plan view.

In the present invention configured as described above, the landing position of the water that has flowed out from the discharge/vacuum break valve device is located in one of the left-side region and the right-side region in the reservoir tank, whereas the power generator is disposed in the other of the left-side region and the right-side region. This makes it possible to secure the relatively large distance between the landing position and the power generator in the reservoir tank, and effectively prevent the power generator from being splashed with the water scattered when the water that has flowed out from the discharge/vacuum break valve device lands on the water surface in the reservoir tank.

In the present invention, it is preferable that the power generator is disposed on an opposite side across the outer shell portion of the discharge valve hydraulic drive portion in a front-rear direction from the landing position.

In the present invention configured as described above, the power generator is disposed on an opposite side across the outer shell portion from the landing position of the water that has flowed out from the discharge/vacuum break valve device, whereby the outer shell portion can block scattering of the water when the water that has flowed out from the discharge/vacuum break valve device lands on the landing position, which makes it possible to effectively prevent exposure of the power generator to the water.

In the present invention, it is preferable that the cylinder of the discharge valve hydraulic drive portion is provided above the outer shell portion.

In the present invention configured as described above, the cylinder of the discharge valve hydraulic drive portion is provided above the outer shell portion, whereby the cylinder can block scattering of the water when the water that has flowed out from the discharge/vacuum break valve device lands on the landing position, which makes it possible to more effectively prevent exposure of the power generator to the water.

The present invention is a flush toilet apparatus comprising the flush water tank apparatus of the present invention, and the flush toilet that is to be washed with flush water supplied from the flush water tank apparatus.

According to the present invention, there can be provided a flush water tank apparatus capable of quickly discharging water in a discharge valve hydraulic drive portion with a simple mechanism while opening a discharge valve using a water supply pressure and returning to a state where a next toilet flush operation can be started in a short time, and a flush toilet apparatus provided with the same.

DETAILED DESCRIPTION OF THE PREFERRED EMBODIMENTS

Next, referring to the attached drawings, a flush water tank apparatus according to embodiments of the present invention and a flush toilet apparatus provided with the same will be described.

Figure 1:
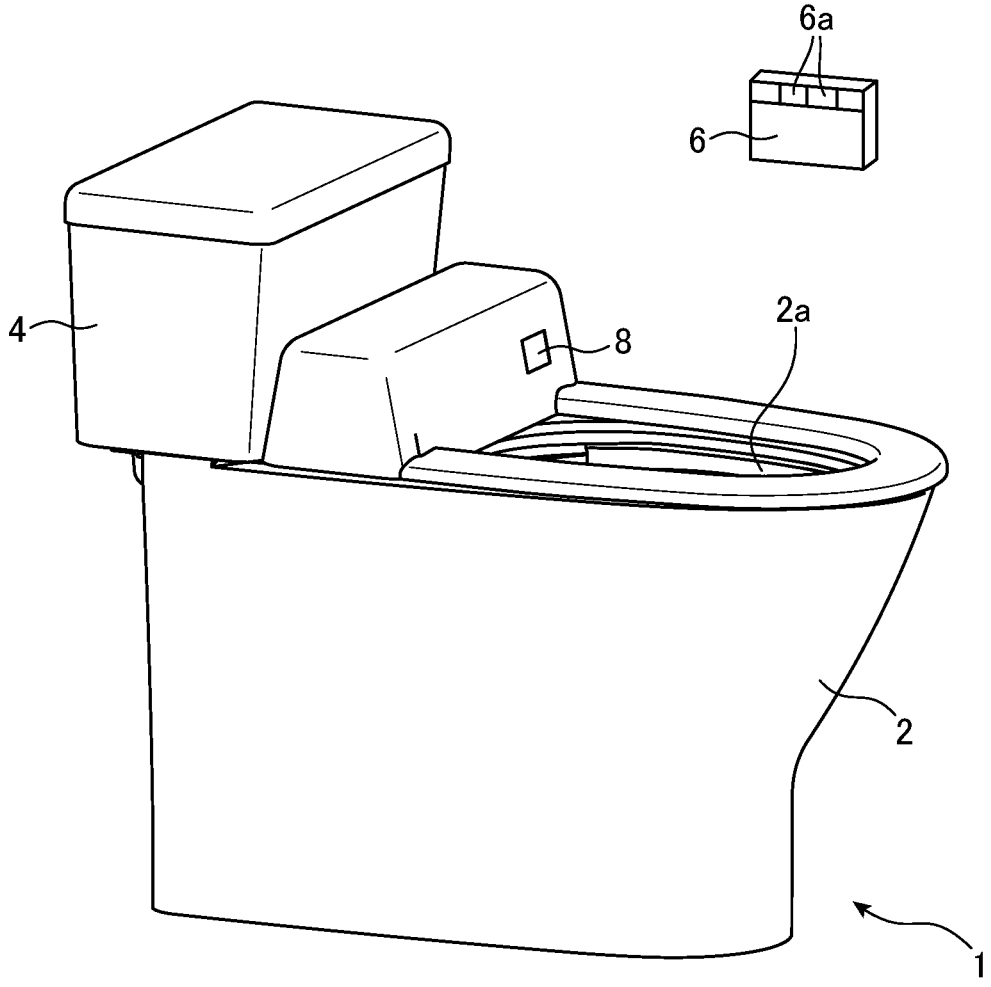
FIG. 1 is a perspective view illustrating an entire flush toilet apparatus provided with a flush water tank apparatus according to a first embodiment of the present invention.
Figure 2:
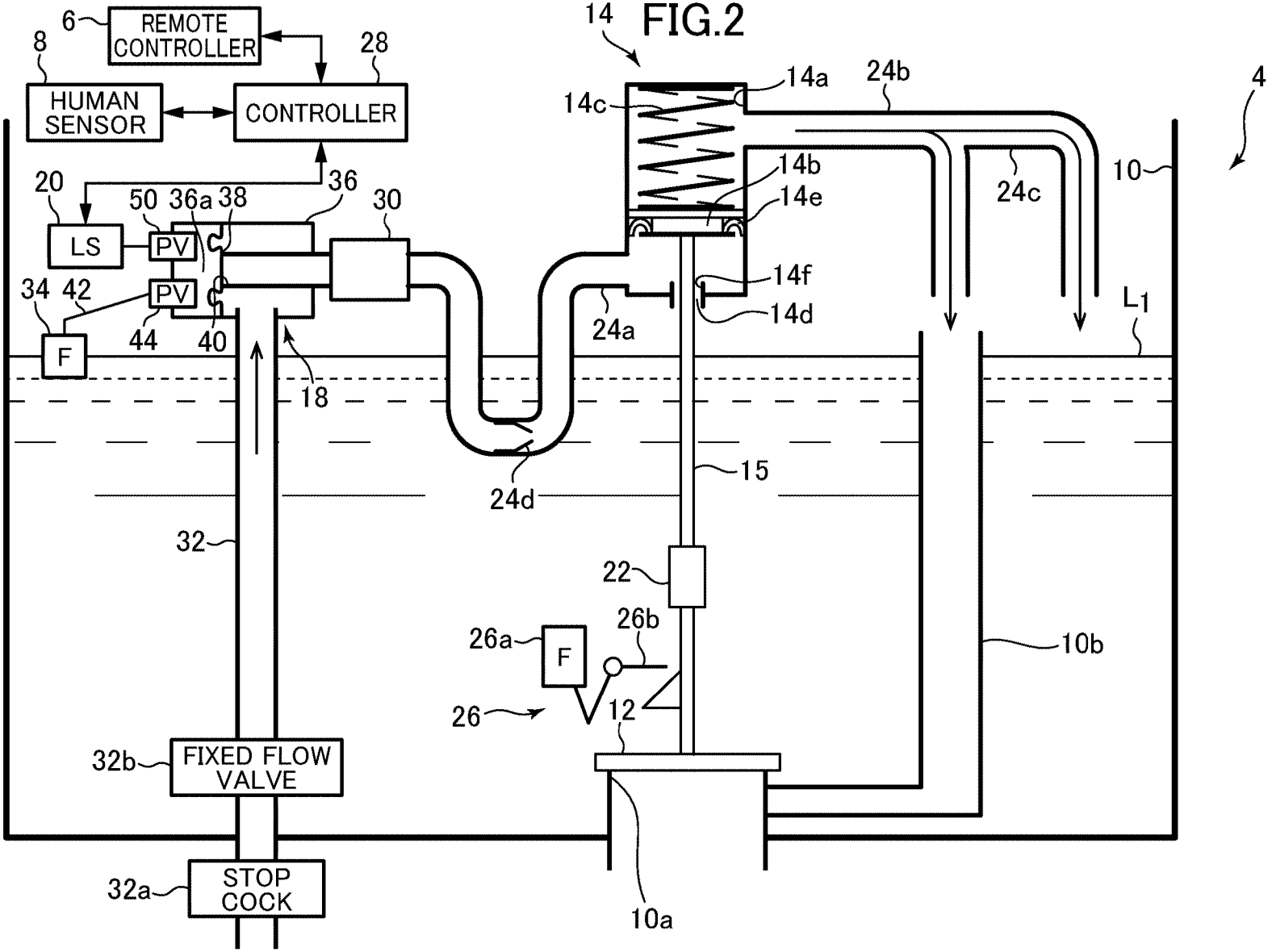
FIG. 2 is a cross sectional view illustrating a schematic configuration of the flush water tank apparatus according to the first embodiment of the present invention.
Figure 3:
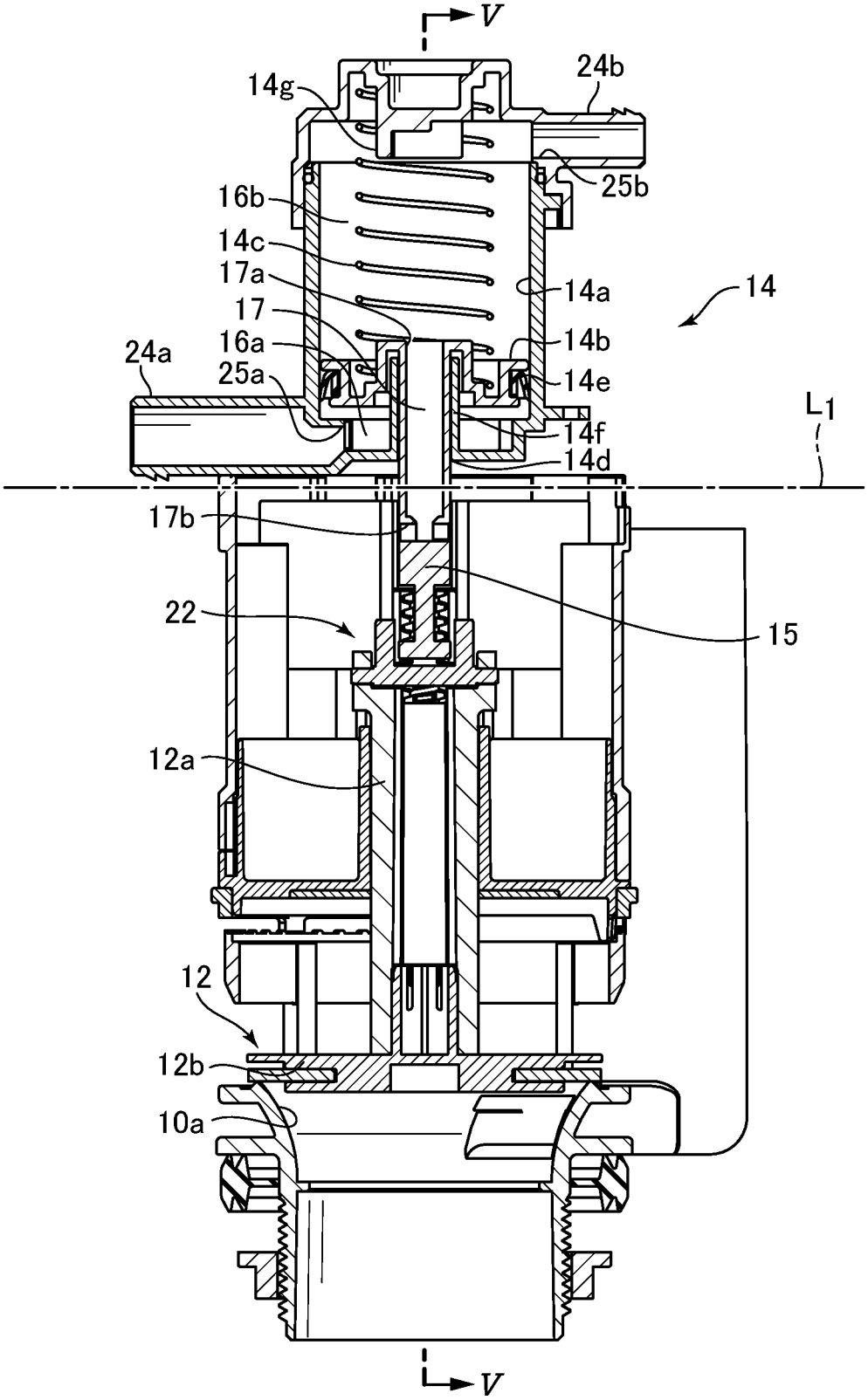
FIG. 3 is a cross sectional view of a discharge valve hydraulic drive portion and a discharge valve which are provided in the flush water tank apparatus according to the first embodiment of the present invention, and illustrates a state where a piston of the discharge valve hydraulic drive portion is at a first position to which the piston has been lowered.
Figure 4:
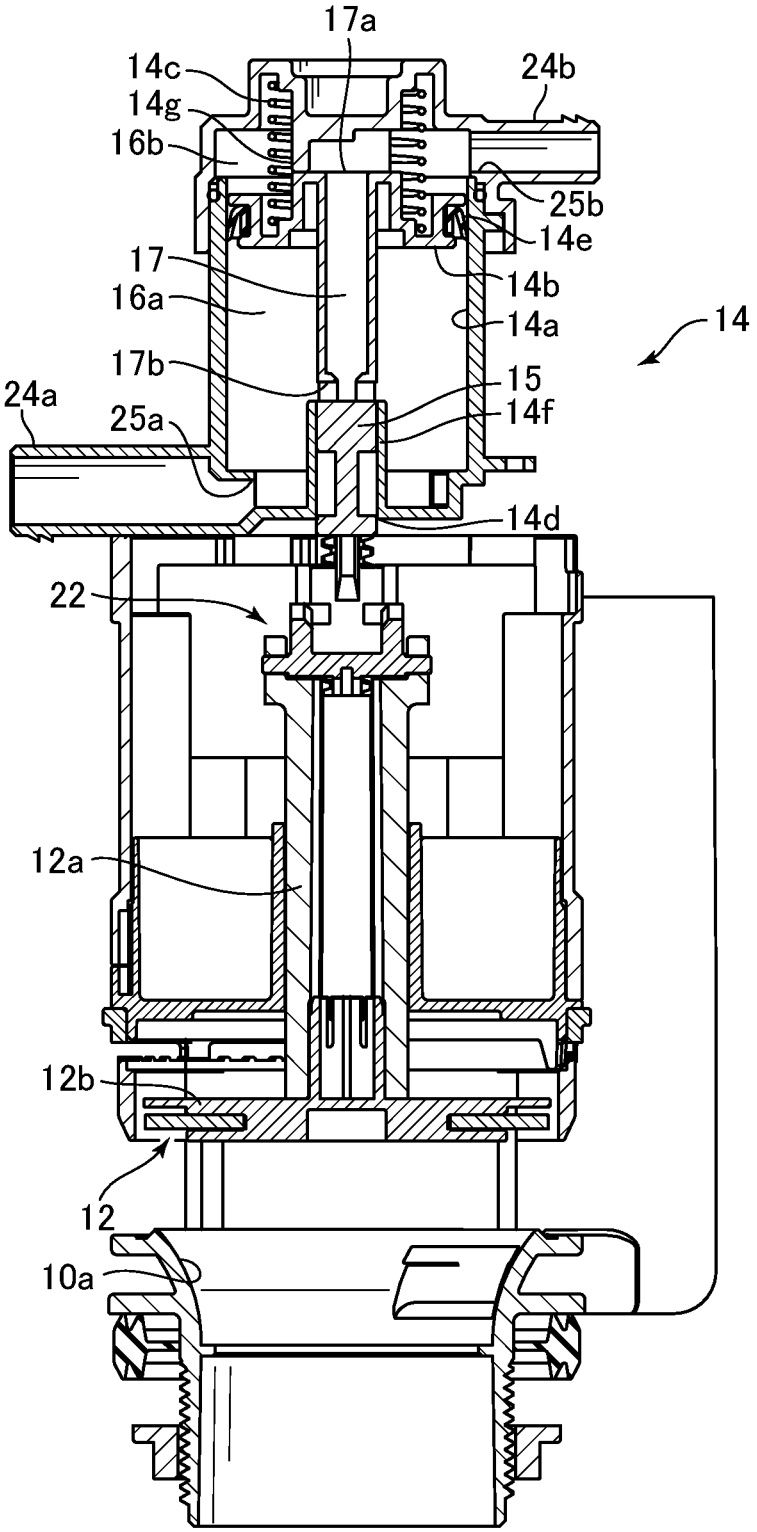
FIG. 4 is a cross sectional view of the discharge valve hydraulic drive portion and the discharge valve which are provided in the flush water tank apparatus according to the first embodiment of the present invention, and illustrates a state where the piston of the discharge valve hydraulic drive portion is at a second position to which the piston has risen.
Figure 5:
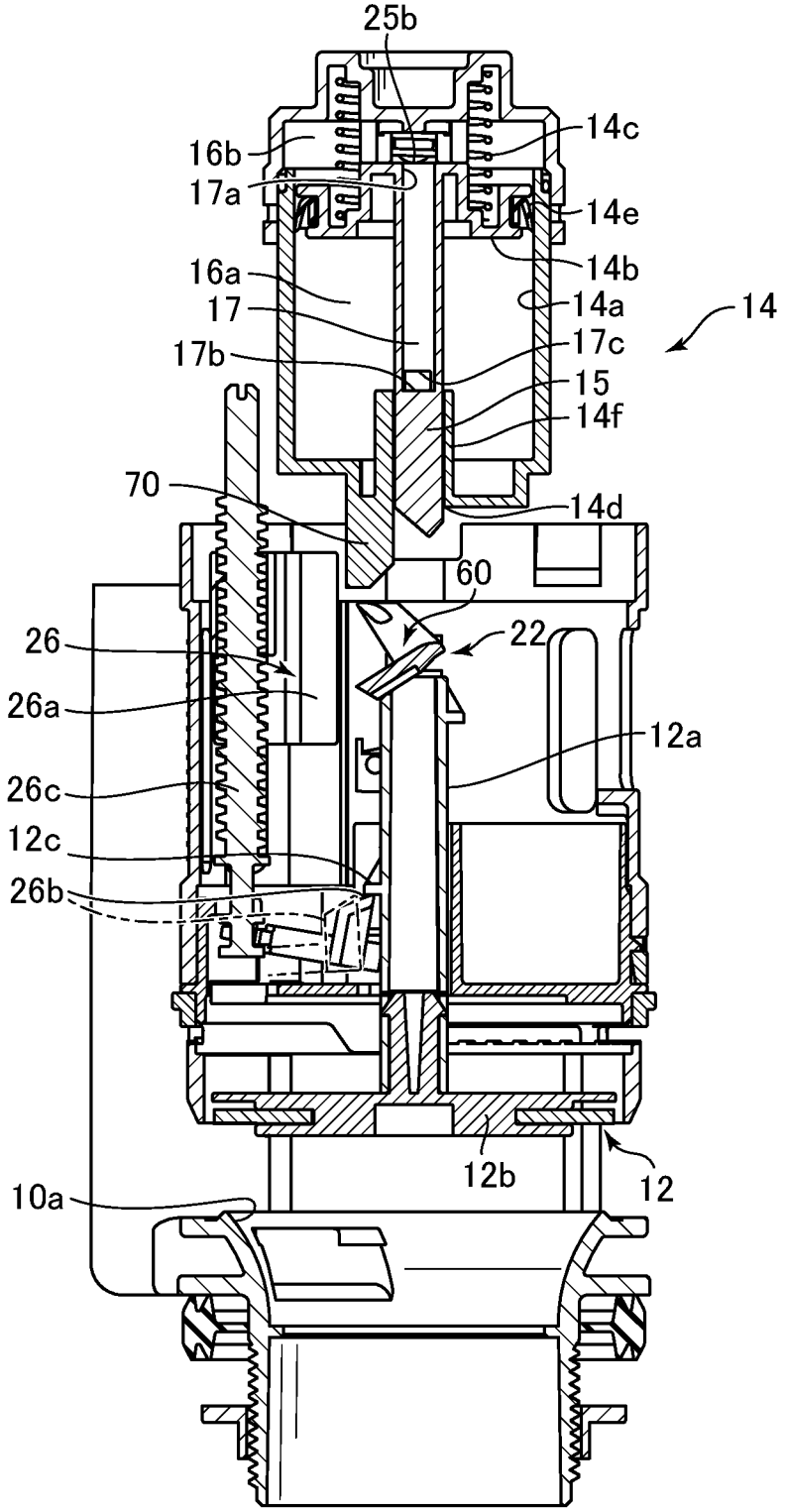
FIG. 5 is a cross sectional view of the discharge valve hydraulic drive portion and the discharge valve which are provided in the flush water tank apparatus according to the first embodiment of the present invention, and illustrates a state where the discharge valve is held by a discharge valve float mechanism.

FIG. 1 is a perspective view illustrating the entire flush toilet apparatus provided with the flush water tank apparatus according to a first embodiment of the present invention. FIG. 2 is a cross sectional view illustrating a schematic configuration of the flush water tank apparatus according to the first embodiment of the present invention. FIGS. 3 to 5 each are a cross sectional view of a discharge valve hydraulic drive portion and a discharge valve which are provided in the flush water tank apparatus according to the first embodiment of the present invention.

As illustrated in FIG. 1, a flush toilet apparatus 1 according to the first embodiment of the present invention includes a flush toilet main unit 2 which is a flush toilet, and a flush water tank apparatus 4 according to the first embodiment of the present invention, which is mounted at a rear portion of the flush toilet main unit 2. The flush toilet apparatus 1 of the present embodiment is configured so that washing of a bowl 2*a* of the flush toilet main unit 2 is brought about either by user's operation of a remote controller 6 attached to a wall surface after use, or after an elapse of a predetermined time period after a human sensor 8 which is a human body detecting sensor provided on the toilet seat senses that the user has separated from the toilet seat. The flush water tank apparatus 4 according to the present embodiment is configured to discharge flush water stored therein to the flush toilet main unit 2 based on a command signal from the remote controller 6 or the human sensor 8, so that the bowl 2*a* is washed with the flush water. Although in the present embodiment, the human sensor 8 is provided in the toilet seat, the present invention is not limited to this form, and the sensor may be provided at any position where a user's sitting on or separation from the seat, approach or departure, or hand swiping action can be sensed. For example, the sensor may be provided in the flush toilet main unit 2 or the flush water tank apparatus 4. The human sensor 8 may be any sensor capable of sensing a user's sitting on or separation from the seat, approach or departure, or hand swiping action. For example, an infrared sensor or a microwave sensor may be used as the human sensor 8.

Next, as illustrated in FIG. 2, the flush water tank apparatus 4 includes a reservoir tank 10 configured to store flush water to be supplied to the flush toilet main unit 2, a discharge valve 12 configured to open and close a discharge port 10*a* provided in the reservoir tank 10, and a discharge valve hydraulic drive portion 14 configured to drive the discharge valve 12. In addition, the flush water tank apparatus 4 includes, in the reservoir tank 10, a water supply controller 18 configured to control the water supply into the discharge valve hydraulic drive portion 14 and the reservoir tank 10, and an electromagnetic valve 20 attached to the water supply controller 18.

The reservoir tank 10 is a tank configured to store flush water to be supplied to the flush toilet main unit 2. The discharge port 10*a* for discharging the stored flush water to the flush toilet main unit 2 is formed at a bottom portion of the reservoir tank 10. In the reservoir tank 10, an overflow pipe 10*b* is connected on the downstream side of the discharge port 10*a*. The overflow pipe 10*b* rises vertically from the vicinity of the discharge port 10*a* and extends above a water surface of the flush water stored in the reservoir tank 10. Accordingly, the flush water that has flowed in from an upper end of the overflow pipe 10*b* bypasses the discharge port 10*a* and flows out directly to the flush toilet main unit 2.

Furthermore, as illustrated in FIG. 2, a discharge/vacuum break valve device 30 is provided in an inflow pipe 24*a* between the water supply controller 18 and the discharge valve hydraulic drive portion 14.

When the water supply from the water supply controller 18 is stopped, external air is drawn into the inflow pipe 24*a* by the discharge/vacuum break valve device 30, and the water remaining in the cylinder 14*a* of the discharge valve hydraulic drive portion 14 is discharged from the inflow pipe 24*a* into the reservoir tank 10. However, the structure and operation of the discharge/vacuum break valve device 30 will be described later.

Additionally, as illustrated in FIG. 2, the water supply controller 18 is configured to control the water supply to the discharge valve hydraulic drive portion 14 based on the operation of the electromagnetic valve 20 and control the supply and supply stop of the water to the reservoir tank 10. That is, the water supply controller 18 is connected between a water supply pipe 32 connected to the tap water and the inflow pipe 24*a* connected to the discharge valve hydraulic drive portion 14, and controls the supply and supply stop of the water supplied from the water supply pipe 32 to the discharge valve hydraulic drive portion 14 based on a command signal from a controller 28. In the present embodiment, the entire amount of the water that has flowed out from the water supply controller 18 is supplied to the discharge valve hydraulic drive portion 14 through the inflow pipe 24*a*. Most of the water supplied to the discharge valve hydraulic drive portion 14 flows out from the cylinder 14*a* through an outflow pipe 24*b*, and branches at an outflow pipe branching portion 24*c* into a part flowing into the reservoir tank 10 and a part flowing into the flush toilet main unit 2 via the overflow pipe 10*b*.

Furthermore, an orifice 24*d* which is a flow rate reduction unit is provided in the middle of the inflow pipe 24*a* between the discharge/vacuum break valve device 30 and the discharge valve hydraulic drive portion 14. The orifice 24*d* is a narrowed portion provided in the inflow pipe 24*a*, and is configured so that the flow path cross-sectional area gradually decreases from an upstream side to a downstream side. The orifice 24*d* is configured to reduce the flow rate of the water flowing in the inflow pipe 24*a*, and is particularly configured to reduce the flow rate of the water flowing backward from the discharge valve hydraulic drive portion 14 to the discharge/vacuum break valve device 30.

On the other hand, the water supplied from the tap water is supplied to the water supply controller 18 via a stop cock 32*a* disposed outside of the reservoir tank 10 and a fixed flow valve 32*b* disposed on the downstream side of the stop cock 32*a* and in the reservoir tank 10. The stop cock 32*a* is provided to stop the water supply to the flush water tank apparatus 4 at the time of maintenance or the like, and is usually used in a state where the cock is open. The fixed flow valve 32*b* is provided to cause the water supplied from the tap water to flow into the water supply controller 18 at a predetermined flow rate, and is configured to supply the water to the water supply controller 18 at a certain flow rate regardless of the installation environment of the flush toilet apparatus 1.

The electromagnetic valve 20 is attached to the water supply controller 18, and the water supply from the water supply controller 18 to the discharge valve hydraulic drive portion 14 is controlled based on the operation of the electromagnetic valve 20. Specifically, the controller 28 receives signals from the remote controller 6 and the human sensor 8, and sends the electric signals to the electromagnetic valve 20 to operate the electromagnetic valve 20.

Furthermore, a water supply valve float 34 is also connected to the water supply controller 18, and is configured to set the water level in the reservoir tank 10 at a predetermined stopped water level $L_1$. The water supply valve float 34 is disposed in the reservoir tank 10. The water supply valve float 34 is configured to rise with a rise of the water level of the reservoir tank 10, and stop the water supply from the water supply controller 18 to the discharge valve hydraulic drive portion 14 when the water level rises to the predetermined stopped water level $L_1$.

The water supply controller 18 includes a main body portion 36 to which the water supply pipe 32 and the inflow pipe 24*a* are connected, a main valve body 38 disposed in the main body portion 36, a valve seat 40 on which the main valve body 38 is seated, an arm portion 42 to be turned by the water supply valve float 34, a float-side pilot valve 44 to be moved by the turning of the arm portion 42, and an electromagnetic valve-side pilot valve 50.

The main body portion 36 is a member in which a connection portion of the water supply pipe 32 is provided in the lower portion of the main body portion 36 and a connection portion of the discharge/vacuum break valve device 30 is provided in one side of the main body portion 36. The main body portion 36 is configured to have a side surface to which the electromagnetic valve 20 is to be attached, the side surface being opposite to the discharge/vacuum break valve device 30. The valve seat 40 is formed in the interior of the main body portion 36, and is adapted to communicate with the discharge/vacuum break valve device 30. Furthermore, the main valve body 38 is disposed in the interior of the main body portion 36 to open and close the valve seat 40. The main valve body 38 is configured so that when the valve is open, the tap water that has flowed in from the water supply pipe 32 flows out to the discharge/vacuum break valve device 30 through the valve seat 40.

The main valve body 38 is a diaphragm valve body having a substantially circular disc shape, and is attached to the inside of the main body portion 36 to be able to be seated on and separated from the valve seat 40. Also, in the main body portion 36, a pressure chamber 36*a* is formed on the opposite side of the valve seat 40 with respect to the main valve body 38. That is, the pressure chamber 36*a* is defined by an inner wall surface of the main body portion 36 and the main valve body 38. When the pressure inside the pressure chamber 36*a* is increased, the main valve body 38 is pressed against the valve seat 40 by the pressure and is seated on the valve seat 40.

On the other hand, the electromagnetic valve 20 is attached to the main body portion 36, and is configured to be capable of advancing and retracting the electromagnetic valve-side pilot valve 50. That is, the electromagnetic valve-side pilot valve 50 is configured to open and close a pilot valve port (not illustrated) provided in the pressure chamber 36*a*. Also, the float-side pilot valve 44 is configured to open and close a float-side pilot valve port (not illustrated) provided in the pressure chamber 36*a*.

On the other hand, the water supply valve float 34 is supported by the arm portion 42. The float-side pilot valve 44 is connected to the arm portion 42. The water supply valve float 34 is pushed up upward in a state where the water level in the reservoir tank 10 has risen to the predetermined stopped water level $L_1$, and therefore the float-side pilot valve 44 closes the float-side pilot valve port (not illustrated) of the pressure chamber 36*a*. On the other hand, when the flush water in the reservoir tank 10 is discharged, and the water level in the reservoir tank 10 is lowered, the water supply valve float 34 is lowered downward, and the float-side pilot valve 44 is moved, whereby the float-side pilot valve port is opened.

With this configuration, in a toilet flush standby state where the water level in the reservoir tank 10 is the predetermined stopped water level $L_1$ and the electromagnetic valve 20 is not energized, both of the pilot valve port (not illustrated) of the main valve body 38 and the float-side pilot valve port (not illustrated) of the main body portion 36 are in a closed state.

The tap water supplied from the water supply pipe 32 flows into the pressure chamber 36*a*. Here, in a state where the electromagnetic valve-side pilot valve 50 closes the pilot valve port (not illustrated) and the float-side pilot valve 44 closes the float-side pilot valve port (not illustrated), the pressure inside the pressure chamber 36*a* is increased by the tap water that has flowed into the pressure chamber 36*a*. When the pressure inside the pressure chamber 36*a* is thus increased, the main valve body 38 is pressed toward the valve seat 40 by the pressure, whereby the valve seat 40 is closed by the main valve body 38.

On the other hand, when the electromagnetic valve 20 is energized and the electromagnetic valve-side pilot valve 50 opens the pilot valve port (not illustrated), the pressure inside the pressure chamber 36*a* is lowered, whereby the main valve body 38 is separated from the valve seat 40 and the valve seat 40 is opened. In a state where the water level in the reservoir tank 10 is lower than the predetermined stopped water level $L_1$, the water supply valve float 34 is lowered, and the float-side pilot valve 44 opens the float-side pilot valve port (not illustrated). Accordingly, the pressure inside the pressure chamber 36*a* is lowered, and the valve seat 40 is opened. In this way, in a state where either the pilot valve port of the main valve body 38 or the float-side pilot valve port is open, the pressure inside the pressure chamber 36*a* is lowered, and the valve seat 40 is opened.

Next, referring to FIGS. 3 to 5, structures of the discharge valve hydraulic drive portion and the discharge valve will be described. FIG. 3 is a cross sectional view of the discharge valve hydraulic drive portion 14 and the discharge valve 12, and illustrates a state where the piston of the discharge valve hydraulic drive portion 14 is at a first position to which the piston has been lowered. FIG. 4 is a cross sectional view of the discharge valve hydraulic drive portion 14 and the discharge valve 12, and illustrates a state where the piston of the discharge valve hydraulic drive portion 14 is at a second position to which the piston has risen. FIG. 5 is a cross sectional view of the discharge valve hydraulic drive portion 14 and the discharge valve 12, and illustrates a state where the discharge valve 12 is held by a discharge valve float mechanism.

As illustrated in FIGS. 3 and 4, the discharge valve 12 is a direct-acting valve body disposed to open and close the discharge port 10*a*, and includes a rod-shaped valve shaft 12*a* and a valve body portion 12*b* attached to a lower end of the rod-shaped valve shaft 12*a*. When the discharge valve 12 is pulled up vertically, the discharge port 10*a* is opened, and the flush water in the reservoir tank 10 is discharged to the flush toilet main unit 2, whereby the bowl 2*a* is washed.

The discharge valve hydraulic drive portion 14 is provided above the discharge valve 12, and is configured to drive the discharge valve 12 using a water supply pressure of the flush water supplied from the tap water. Specifically, the discharge valve hydraulic drive portion 14 includes a cylinder 14*a* into which the water supplied from the water supply controller 18 (FIG. 2) via the inflow pipe 24*a* flows, and a piston 14*b* that is slidably disposed in the cylinder 14*a*. A rod 15 which is a drive member is attached to a lower surface of the piston 14*b*. The rod 15 projects from a lower end of the cylinder 14*a* and extends toward the discharge valve 12 (FIG. 3). Additionally, the rod 15 is disposed to align on the same line as the valve shaft 12*a* rising from a center of the valve body portion 12*b* of the discharge valve 12, and the discharge valve 12 and the rod 15 are disposed coaxially with each other.

Additionally, a spring 14*c* is disposed in the interior of the cylinder 14*a*, and biases the piston 14*b* downward. An annular packing 14*e* which is an elastic member is attached to an outer periphery of the piston 14*b*. The packing 14*e* is formed to have an inverted U-shaped cross section so that a lower side is open. Furthermore, the packing 14*e* contacts an inner wall surface of the cylinder 14*a* in an elastically deformed state, so that the watertightness is ensured between the inner wall surface of the cylinder 14*a* and the piston 14*b*. A clutch mechanism 22 is provided in a connection portion between a lower end of the rod 15 and the discharge valve 12. The clutch mechanism 22 enables connection between the rod 15 and the discharge valve 12. The connection between the rod 15 and the discharge valve 12 is released at a predetermined timing.

The cylinder 14*a* is a cylindrical member. An axis of the cylinder 14*a* is disposed vertically, and the piston 14*b* is slidably received in the interior of the cylinder 14*a*. An internal space of the cylinder 14*a* is partitioned by the piston 14*b* into a pressure chamber 16*a* below the piston 14*b* and a back pressure chamber 16*b* above the piston 14*b*. The piston 14*b* is disposed in the cylinder 14*a* slidably between the first position illustrated in FIG. 3 and the second position illustrated in FIG. 4. As illustrated in FIG. 3, at the first position where the piston 14*b* is located at the lowest position, the volume of the pressure chamber 16*a* below the piston 14*b* becomes the smallest, and the volume of the back pressure chamber 16*b* above the piston 14*b* becomes the largest. On the other hand, at the second position of the piston 14*b* as illustrated in FIG. 4, the volume of the pressure chamber 16*a* below the piston 14*b* becomes the largest, and the volume of the back pressure chamber 16*b* above the piston 14*b* becomes the smallest.

As illustrated in FIG. 3, the inflow pipe 24*a* which is a water supply passage to a drive portion is connected to a lower end portion of the cylinder 14*a*, and the inflow pipe 24*a* communicates with the pressure chamber 16*a* in the cylinder 14*a* via an inflow port 25*a*. That is, the water that has flowed out from the water supply controller 18 (FIG. 2) flows into the pressure chamber 16*a* in the cylinder 14*a* through the inflow port 25*a*. The pressure inside the pressure chamber 16*a* is increased by the water flowing into the pressure chamber 16*a*, which causes the piston 14*b* to be pushed up against the biasing force of the spring 14*c*. That is, the piston 14*b* is moved from the first position to the second position by the pressure of the tap water, and therefore the discharge valve 12 is driven.

On the other hand, an outflow port 25*b* is provided in an upper portion of the cylinder 14*a*, and the outflow pipe 24*b* communicates with the back pressure chamber 16*b* in the cylinder 14*a* via the outflow port 25*b*. Accordingly, the water that has flowed into the back pressure chamber 16*b* in the cylinder 14*a* flows out through the outflow port 25*b*. As illustrated in FIG. 2, the outflow pipe branching portion 24*c* is provided at a distal end portion of the outflow pipe 24*b* extending from the cylinder 14*a*. The outflow pipe 24*b* branching at the outflow pipe branching portion 24*c* is configured so that the water flows out from one branch into the reservoir tank 10 and the water flows out from the other branch into the overflow pipe 10*b*. Accordingly, a part of the water that has flowed out from the cylinder 14*a* is discharged into the flush toilet main unit 2 through the overflow pipe 10*b*, and the remaining water is stored in the reservoir tank 10.

As illustrated in FIGS. 3 and 4, the rod 15 is a rod-shaped member connected to the lower surface of the piston 14*b*, and extends to project downward from the inside of the cylinder 14*a* through a sleeve 14*f* formed in a bottom surface of the cylinder 14*a*. The sleeve 14*f* is a cylindrical portion extending vertically, and is provided to pass through the bottom surface of the cylinder 14*a*. The rod 15 extends through inside of the sleeve 14*f*. The lower end of the rod 15 is connected to the discharge valve 12 via the clutch mechanism 22. Therefore, when the water flows into the cylinder 14*a*, and the piston 14*b* is pushed up by the water, the rod 15 connected to the piston 14*b* lifts the discharge valve 12 upward, whereby the discharge valve 12 is opened.

A gap 14*d* is provided between the rod 15 projecting from a lower portion of the cylinder 14*a* and an inner wall surface of the sleeve 14*f* in the cylinder 14*a*, and a part of the water that has flowed into the cylinder 14*a* flows out from the gap 14*d*. The water that has flowed out from the gap 14*d* flows into the reservoir tank 10. The gap has a flow path with a relatively narrow cross section and a high resistance. Therefore, even in a state where the water flows out from the gap 14*d*, the pressure inside the pressure chamber 16*a* is increased by strong flow of the water flowing into the cylinder 14*a* from the inflow pipe 24*a*, which causes the piston 14*b* to be pushed up against the biasing force of the spring 14*c*.

Furthermore, as illustrated in FIGS. 3 and 4, a communicating flow path 17 is provided at an upper end portion of the rod 15. The communicating flow path 17 extends through inside of the rod 15 along a central axis from an upper end of the rod 15. The communicating flow path 17 extends from an upper end opening 17*a* which is a back pressure chamber opening provided at the upper end of the rod 15 to a side opening 17*b* which is a rod opening provided in an intermediate part of the side surface of the rod 15. In the present embodiment, the rod 15 is provided to pass through the piston 14*b*, and the upper end opening 17*a* formed in the upper end of the rod 15 is open in the back pressure chamber 16*b* above the piston 14*b*. The upper end opening 17*a* is open upward or in a sliding direction of the piston 14*b* in the back pressure chamber 16*b*.

An outflow guiding portion 14*g* is provided to hang downward from a ceiling surface of the cylinder 14*a*. The outflow guiding portion 14*g* is provided inside the spring 14*c* disposed in the cylinder 14*a*, and is formed in a cylindrical shape, a part of which is cut out. A cylindrical cutout portion in the outflow guiding portion 14*g* is directed in a direction of the outflow port 25*b* of the cylinder 14*a*. Therefore, the water that has flowed into the back pressure chamber 16*b* from the upper end opening 17*a* through the communicating flow path 17 is guided toward the outflow port 25*b* by the outflow guiding portion 14*g*. As illustrated in FIG. 4, in a state where the piston 14*b* is moved to the second position, a lower end of the outflow guiding portion

14*g* contacts an upper surface of the piston 14*b*. In other words, the piston 14*b* is positioned at the second position by contacting the lower end of the outflow guiding portion 14*g*.

Although in the present embodiment, the upper end opening 17*a* formed in the upper end of the rod 15 functions as the back pressure chamber opening opened to the back pressure chamber 16*b*, the back pressure chamber opening is not necessarily provided in the rod 15, and may be provided in the piston 14*b*. In this case, a part of the communicating flow path 17 is formed inside the piston 14*b*, and the communicating flow path 17 extending from the back pressure chamber opening provided on the back pressure chamber 16*b* side of the piston 14*b* is connected to the communicating flow path 17 provided in the rod 15.

On the other hand, the side opening 17*b* which is a rod opening is located at a lower end of the communicating flow path 17, and is open in a side surface of the intermediate part of the rod 15. In the present embodiment, two side openings 17*b* are provided at the same height on both sides of a central line of the rod 15. In the case where a plurality of side openings 17*b* are provided, it is preferable that the side openings 17*b* are provided at positions symmetrical about the central axis of the rod and at the same height. That is, in the present embodiment, the two side openings 17*b* are provided at positions spaced from each other by a central angle of 180 degrees with the central axis of the rod as a center. However, for example, in the case where three side openings 17*b* are provided, it is preferable that the side openings 17*b* are provided at positions spaced from one another by a central angle of 120 degrees, and in the case where four side openings 17*b* are provided, it is preferable that the side openings 17*b* are provided at positions spaced from one another by a central angle of 90 degrees.

As illustrated in FIG. 3, in a state where the piston 14*b* is located at the first position, each side opening 17*b* provided in the rod 15 is located outside the pressure chamber 16*a* or outside the cylinder 14*a*. That is, at the first position to which the piston 14*b* has been lowered, each side opening 17*b* provided in the side surface of the rod 15 is located below the lower end of the sleeve 14*f*, and each side opening 17*b* is open outside the cylinder 14*a*. In this state, the back pressure chamber 16*b* above the piston 14*b* and the outside of the cylinder 14*a* communicate with each other via the communicating flow path 17. In the state where the piston 14*b* is located at the first position, each side opening 17*b* in the rod 15 is located below the stopped water level $L_1$ indicated by a dashed-dotted line in FIG. 3, and is submerged in the water.

On the other hand, as illustrated in FIG. 4, in a state where the piston 14*b* is located at the second position, each side opening 17*b* provided in the rod 15 is located inside the pressure chamber 16*a*. That is, at the second position to which the piston 14*b* has risen, each side opening 17*b* provided in the side surface of the rod 15 is located above the upper end of the sleeve 14*f*, and each side opening 17*b* is open inside the pressure chamber 16*a* in the cylinder 14*a*. In this state, the back pressure chamber 16*b* above the piston 14*b* and the pressure chamber 16*a* below the piston 14*b* communicate with each other via the communicating flow path 17.

As illustrated in FIG. 5, an edge portion 17*c* on the piston 14*b* side of each side opening 17*b* is formed to extend linearly in a direction (horizontal direction in FIG. 5) perpendicular to the central axis of the rod 15. Here, when the piston 14*b* approaches the second position and the edge portion 17*c* above the side openings 17*b* reaches a position higher than the upper end of the sleeve 14*f*, each side opening 17*b* starts to open in the pressure chamber 16*a*. At this time, since the edge portion 17*c* is formed to extend perpendicularly to the central axis of the rod 15, an area of each side opening 17*b* opening into the pressure chamber 16*a* increases suddenly when the edge portion 17*c* above the side openings 17*b* reaches a position slightly higher than the upper end of the sleeve 14*f* formed linearly. Therefore, the water in the pressure chamber 16*a* is caused to rapidly flow into the communicating flow path 17 through each side opening 17*b*. This can decrease the hydraulic pressure inside the pressure chamber 16*a* rapidly, and therefore the pressure inside the pressure chamber 16*a* and the pressure inside the back pressure chamber 16*b* reach equilibrium in process of movement of the piston 14*b*, which can prevent the piston 14*b* from being locked.

Next, the clutch mechanism 22 is provided between the rod 15 and the valve shaft 12*a* of the discharge valve 12. The clutch mechanism 22 is configured to disconnect the valve shaft 12*a* of the discharge valve 12 from the rod 15 when the discharge valve 12 is lifted up to a predetermined position. In a state where the clutch mechanism 22 is disengaged, the discharge valve 12 ceases to move in association with the movement of the piston 14*b* and the rod 15, and falls by gravity while resisting buoyancy. Details of the clutch mechanism 22 will be described later.

On the other hand, as illustrated in FIG. 5, a discharge valve float mechanism 26 which is a float mechanism is provided in the vicinity of the valve shaft 12*a* of the discharge valve 12. FIG. 5 is a cross sectional view illustrating a state where the discharge valve 12 is held by the discharge valve float mechanism 26, and a cutting direction of the cross section is turned by 90 degrees with respect to FIGS. 3 and 4. The discharge valve float mechanism 26 is configured to delay closing of the discharge port 10*a* when the discharge valve 12 is falling after the rod 15 is lifted up by a predetermined distance and the discharge valve 12 is disconnected from the rod 15 by the clutch mechanism 22. Specifically, the discharge valve float mechanism 26 includes a float portion 26*a* which is a float, an engaging portion 26*b* that moves in association with the float portion 26*a*, and a float shaft 26*c* that connects the float portion 26*a* and the engaging portion 26*b*.

On the other hand, an engaging projection 12*c* is provided on the valve shaft 12*a* of the discharge valve 12. The engaging projection 12*c* is located above the engaging portion 26*b* of the discharge valve float mechanism 26 in a state where the discharge valve 12 is lifted up. When the lifted discharge valve 12 is disconnected by the clutch mechanism 22, the discharge valve 12 falls and the engaging projection 12*c* is engaged with the engaging portion 26*b*, thereby stopping the fall of the discharge valve 12 (FIG. 5 illustrates a state where the engaging portion 26*b* and the engaging projection 12*c* are engaged with each other, and the discharge valve 12 is held). Next, when the float portion 26*a* drops with the lowering of the water level in the reservoir tank 10, and the water level in the reservoir tank 10 is lowered to a predetermined water level, the float portion 26*a* turns the engaging portion 26*b* to a disengagement position indicated by an imaginary line in FIG. 5. When the engaging portion 26*b* is turned to the disengagement position, the engagement between the engaging portion 26*b* and the engaging projection 12*c* is released. When the engagement is released, the discharge valve 12 falls, and is seated on the discharge port 10*a*. This enables the delay of closing of the discharge valve 12, so that an appropriate amount of flush water can be discharged from the discharge port 10*a*.

Next, referring now to FIGS. 6 to 10, the clutch mechanism 22 that connects the discharge valve 12 and the rod 15 will be described.

Figure 6:
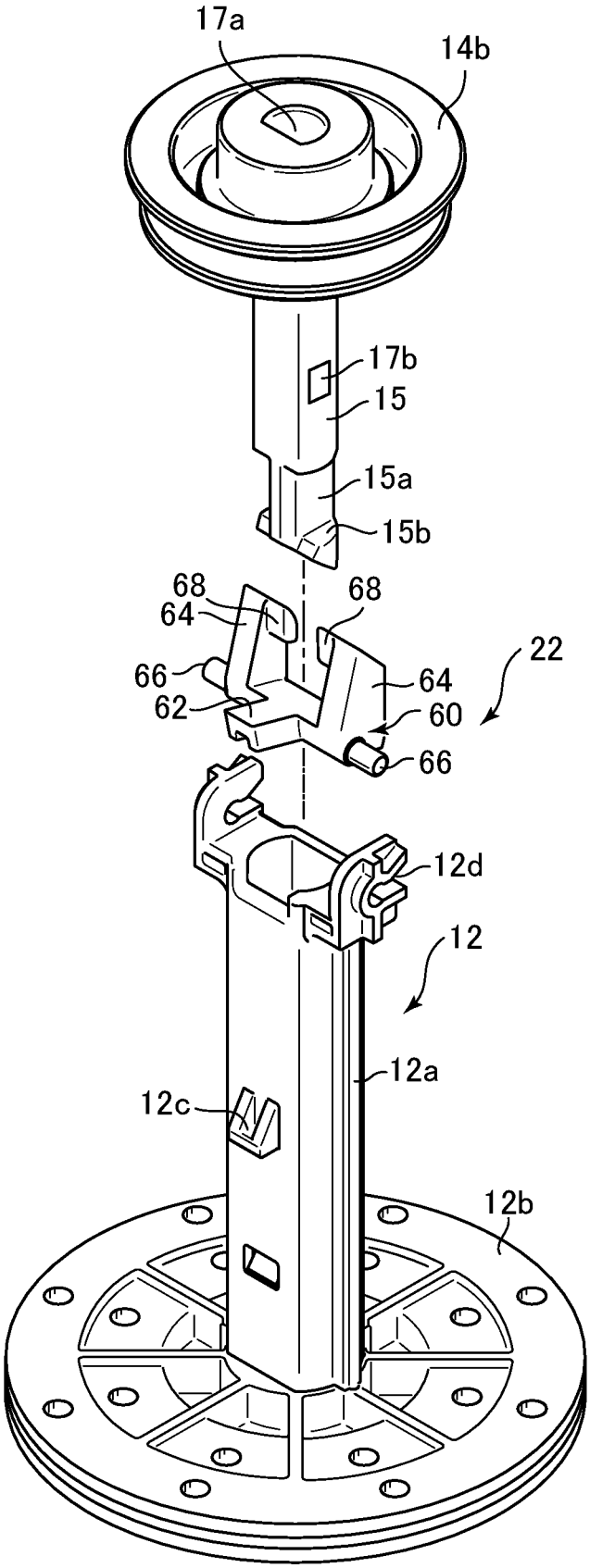
FIG. 6 is an exploded perspective view illustrating components forming a clutch mechanism in an exploded state, in the flush water tank apparatus according to the first embodiment of the present invention.
Figure 7:
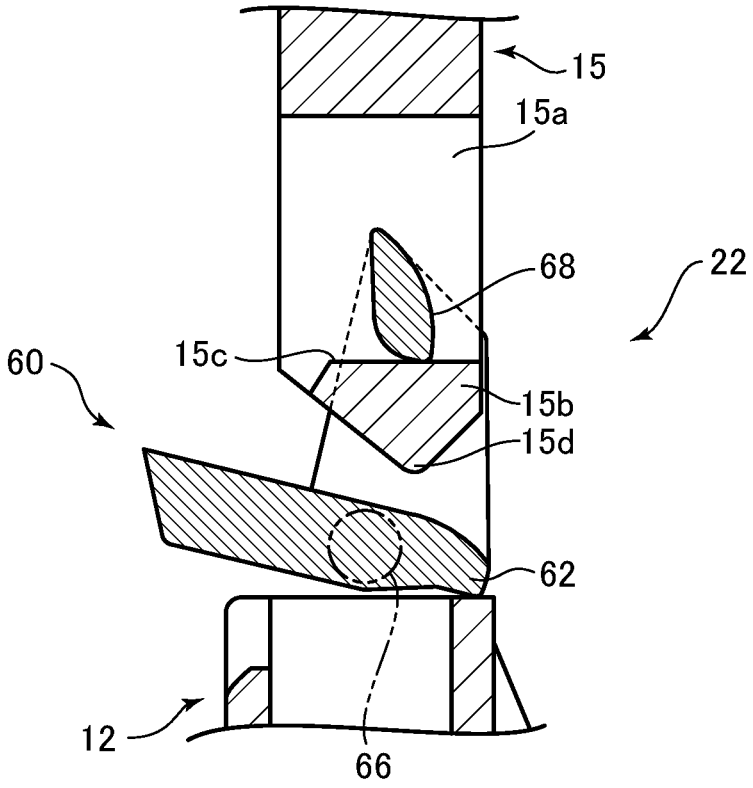
FIG. 7 is a partially enlarged cross sectional view illustrating a state of the clutch mechanism when a discharge valve is in a closed state, in the flush water tank apparatus according to the first embodiment of the present invention.
Figure 8:
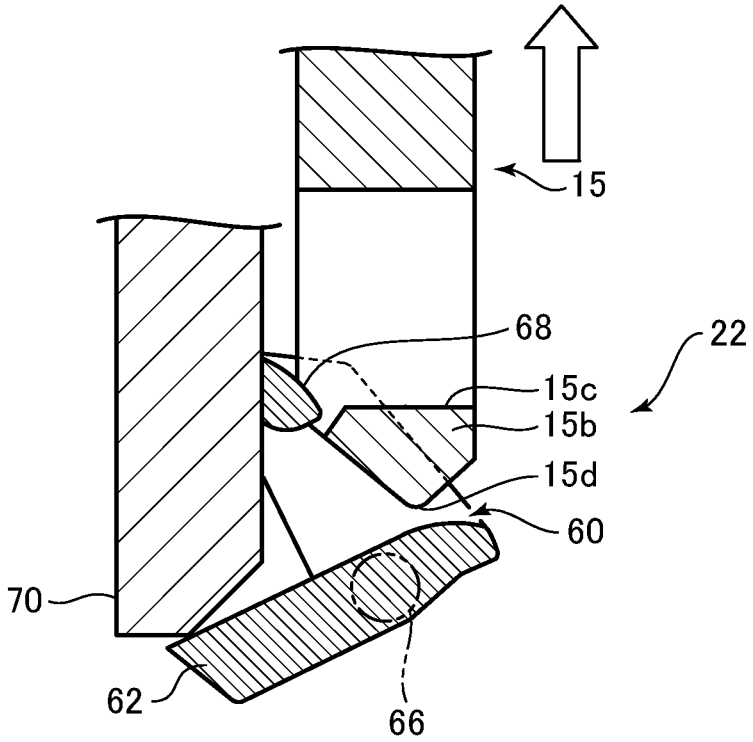
FIG. 8 is a partially enlarged cross sectional view illustrating the state of the clutch mechanism when the engagement is released, in the flush water tank apparatus according to the first embodiment of the present invention.
Figure 9:
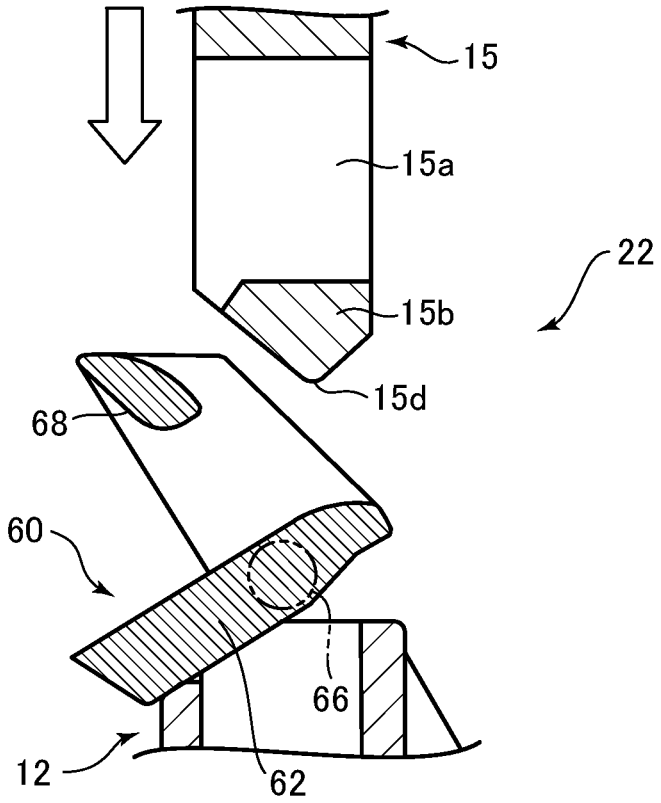
FIG. 9 is a partially enlarged cross sectional view illustrating the state of the clutch mechanism immediately before the engagement, in the flush water tank apparatus according to the first embodiment of the present invention.
Figure 10:
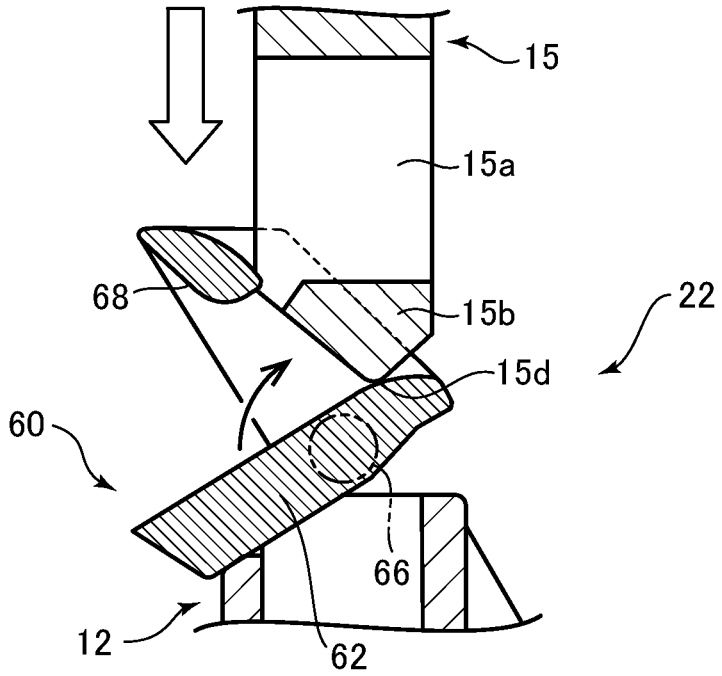
FIG. 10 is a partially enlarged cross sectional view illustrating a state when the clutch mechanism is engaged, in the flush water tank apparatus according to the first embodiment of the present invention.

FIG. 6 is an exploded perspective view illustrating components forming the clutch mechanism 22 in an exploded state. FIG. 7 is a partially enlarged cross sectional view illustrating a state of the clutch mechanism 22 when the discharge valve 12 is in a closed state. FIG. 8 is a partially enlarged cross sectional view illustrating the state of the clutch mechanism 22 when the engagement is released. FIG. 9 is a partially enlarged cross sectional view illustrating the state of the clutch mechanism 22 immediately before the engagement. FIG. 10 is a partially enlarged cross sectional view illustrating a state when the clutch mechanism 22 is engaged.

First, as illustrated in FIG. 6, the clutch mechanism 22 includes a lower end portion of the rod 15, an upper end portion of the valve shaft 12*a* of the discharge valve 12, and a movable member 60 attached to the upper end portion. That is, the rod 15 extends downward from a lower surface of the piston 14*b* of the discharge valve hydraulic drive portion 14, and the lower end portion of the rod 15 forms a part of the clutch mechanism 22. The movable member 60 is turnably attached to the upper end portion of the valve shaft 12*a*. When the movable member 60 is engaged with or disengaged from the lower end portion of the rod 15, the rod 15 and the discharge valve 12 are connected to each other or disconnected from each other.

A thin thickness portion 15*a* and a pull-up portion 15*b* are formed at the lower end portion of the rod 15, and function as a part of the clutch mechanism 22. On the other hand, a support portion 12*d* is provided at the upper end portion of the valve shaft 12*a* of the discharge valve 12. The support portion 12*d* includes a pair of bearings formed to be laterally open. Both ends of the movable member 60 are turnably attached to the support portion 12*d*.

The thin thickness portion 15*a* at the lower end of the rod 15 is a portion formed to be thinner than the upper portion of the rod 15. The pull-up portion 15*b* of the rod 15 is a portion formed to project horizontally toward both ends from the lower end of the thin thickness portion 15*a*. The pull-up portion 15*b* of the rod 15 and the movable member 60 are engaged with each other to pull up the discharge valve 12.

The movable member 60 includes a base plate 62 extending laterally, a pair of rotary shafts 66 extending outward from both ends of the base plate 62, a pair of arms 64 rising vertically from both side portions of the base plate 62, and an abutting portion 68 extending inward from an upper end of each arm 64. Each rotary shaft 66 of the movable member 60 is received on each support portion 12*d* provided at the upper end portion of the valve shaft 12*a* so that the movable member 60 can be turnably supported.

The base plate 62 is a plate-like portion extending laterally, and is formed to have a T-shape in top plan view. The arms 64 are formed to rise upward from both ends of the T-shaped base plate 62, respectively. The thin thickness portion 15*a* and the pull-up portion 15*b* at the lower end of the rod 15 are located between the pair of arms 64 in a state where the clutch mechanism 22 is engaged. The rotary shafts 66 are formed to project horizontally from both left and right ends of the base plate 62, respectively, and from proximal ends of the arms 64, respectively. The rotary shafts 66 are received on the respective support portions 12*d* of the valve shaft 12*a*.

The abutting portion 68 is formed to project inward from the upper end of each arm 64. The abutting portion 68 is formed to have a teardrop shaped cross section as viewed from a direction parallel to the rotary shaft 66, and is formed to have an arc-shaped curved surface at the lower side thereof. The thin thickness portion 15*a* at the lower end of the rod 15 is located between the abutting portions 68 and both ends of the pull-up portion 15*b* are located below the respective abutting portions 68 in a state where the clutch mechanism 22 is engaged.

Next, referring to FIGS. 7 to 10, the operation of the clutch mechanism 22 will be described.

First, the movable member 60 is in an "engagement position" illustrated in FIG. 7 in a state where the discharge valve 12 is seated on the discharge port 10*a* and the clutch mechanism 22 is engaged. In the state where the movable member 60 is disposed at the engagement position, the pull-up portion 15*b* at the lower end of the rod 15 is located directly below the abutting portion 68 of the movable member 60. When the flush water is supplied to the discharge valve hydraulic drive portion 14 (FIG. 2) and the rod 15 is pulled up upward from the state illustrated in FIG. 7, the discharge valve 12 is pulled up vertically upward by the rod 15. That is, when the rod 15 is pulled up, an upper surface 15*c* of the pull-up portion 15*b* of the rod 15 and a lower end of the abutting portion 68 of the movable member 60 are engaged with each other while the movable member 60 is maintained at the engagement position, whereby the discharge valve 12 is pulled up.

When the discharge valve 12 is pulled up together with the rod 15 in the state where the clutch mechanism 22 is engaged, the movable member 60 approaches the bottom surface of the cylinder 14*a* of the discharge valve hydraulic drive portion 14. When the discharge valve 12 is pulled up to a predetermined position, a distal end of a restricting portion 70 projecting downward from the bottom surface of the cylinder 14*a* contacts the base plate 62 of the movable member 60 as illustrated in FIG. 8. When the base plate 62 contacts the distal end of the restricting portion 70, the movable member 60 is turned around the rotary shaft 66 from the "engagement position" illustrated in FIG. 7 to the "disengagement position" illustrated in FIG. 8. When the movable member 60 is turned to the "disengagement position," the engagement between the pull-up portion 15*b* of the rod 15 and the abutting portion 68 of the movable member 60 is released, and the engagement of the clutch mechanism 22 is released. That is, when the movable member 60 is turned around the rotary shaft 66, the abutting portion 68 provided at the distal end of the arm 64 moves and is released from the pull-up portion 15*b* at the lower end of the rod 15, whereby the engagement between the abutting portion 68 and the pull-up portion 15*b* is released.

When the engagement of the clutch mechanism 22 is released, the discharge valve 12 is disconnected from the rod 15, and the discharge valve 12 falls and is seated on the discharge port 10*a*. This makes it possible to stop the flush water from being discharged from the reservoir tank 10 into the flush toilet main unit 2.

Next, when the supply of the flush water to the discharge valve hydraulic drive portion 14 is stopped, the piston 14*b* and the rod 15 are lowered by the biasing force of the spring 14*c* disposed in the interior of the cylinder 14*a*. When the rod 15 is lowered as illustrated in FIG. 9, the lower end of the rod 15 approaches the movable member 60 attached to the discharge valve 12 that is seated on the discharge port 10*a*. In FIG. 9, the center of gravity of the movable member 60 is located on the left side with respect to the center of the rotary shaft 66, and therefore, the movable member 60 is maintained at the "disengagement position" even after the engagement of the clutch mechanism 22 is released in FIG. 8.

When the rod 15 is further lowered, an abutted portion 15*d* of the rod 15 contacts the base plate 62 of the movable member 60 as illustrated in FIG. 10, and the movable member 60 is turned in a clockwise direction in FIG. 10. Hereby, the movable member 60 at the "disengagement position" is turned to the "engagement position" illustrated in FIG. 7 to return to the state illustrated in FIG. 7, whereby the clutch mechanism 22 is engaged.

Next, referring now to FIGS. 11 to 13, the discharge/vacuum break valve device 30 connected between the water supply controller 18 and the discharge valve hydraulic drive portion 14 will be described.

Figure 11:
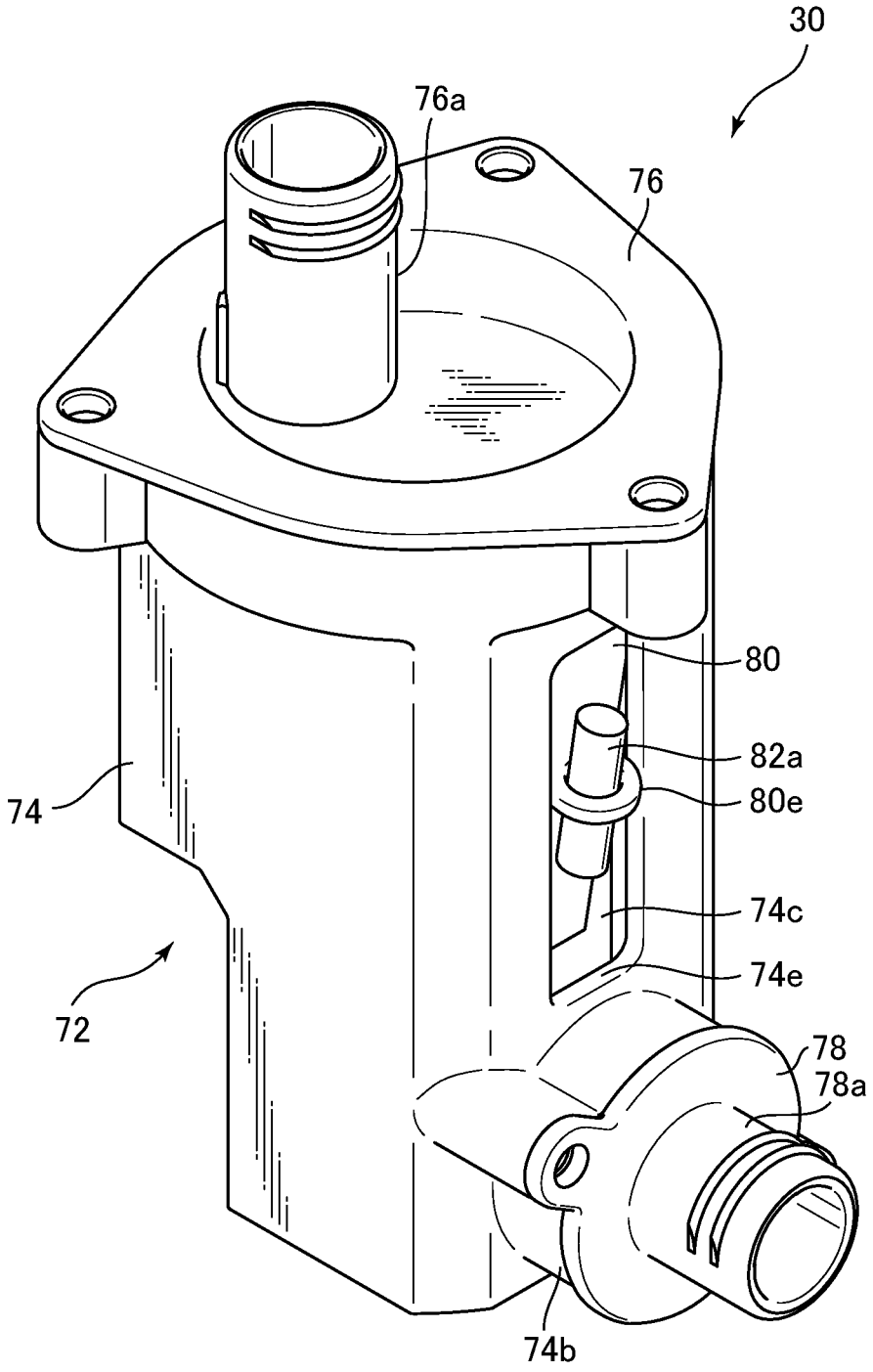
FIG. 11 is a perspective view of a discharge/vacuum break valve device provided in the flush water tank apparatus according to the first embodiment of the present invention.

FIG. 11 is a perspective view of the discharge/vacuum break valve device 30. FIG. 12 is a cross-sectional view of the discharge/vacuum break valve device 30 in a state where the water is not supplied from the water supply controller 18. FIG. 13 is a cross-sectional view of the discharge/vacuum break valve device 30 in a state where the water is supplied from the water supply controller 18.

Figure 12:
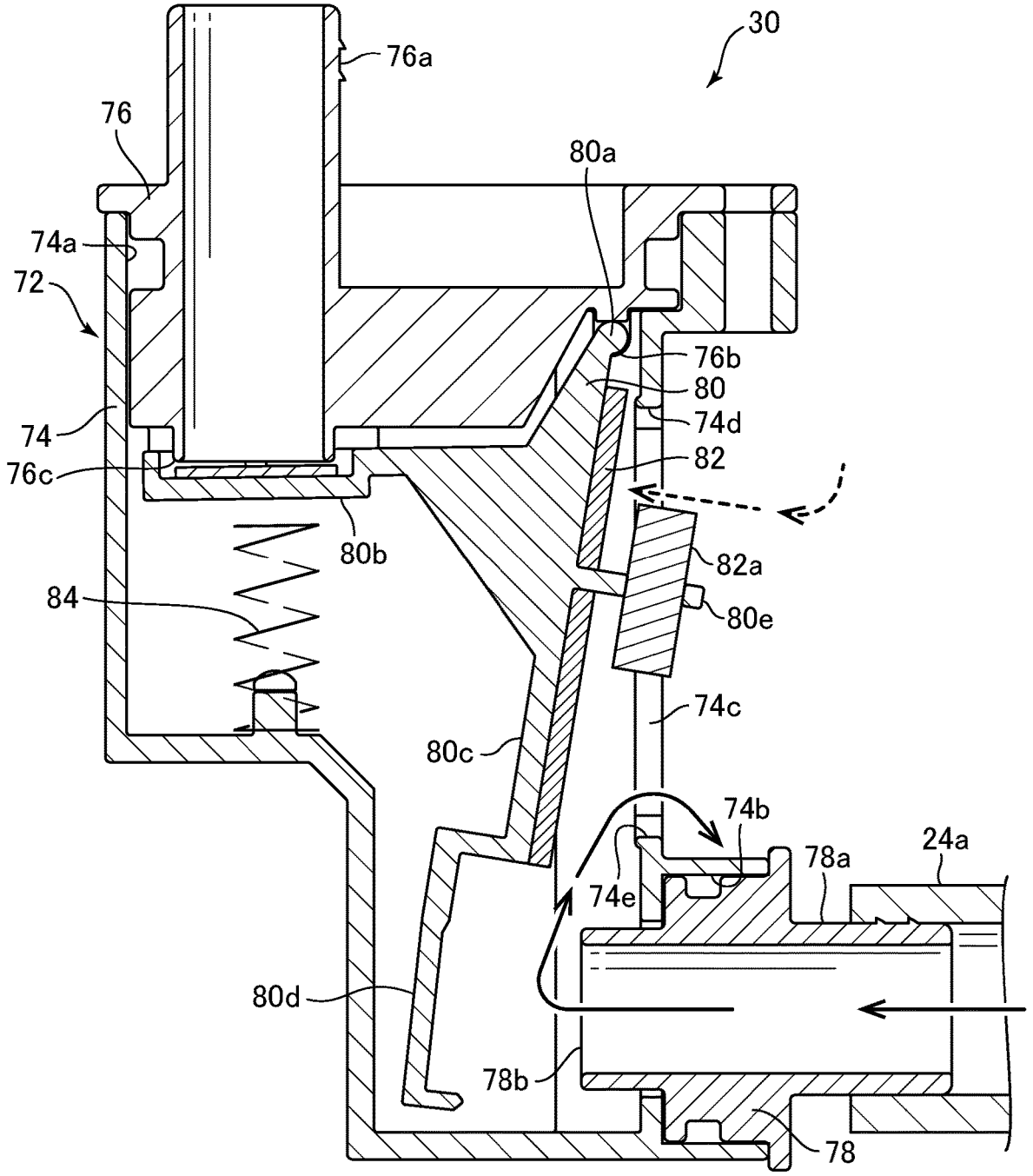
FIG. 12 is a cross-sectional view of the discharge/vacuum break valve device provided in the flush water tank apparatus according to the first embodiment of the present invention, and illustrates a state where the water is not supplied from a water supply controller.
Figure 13:
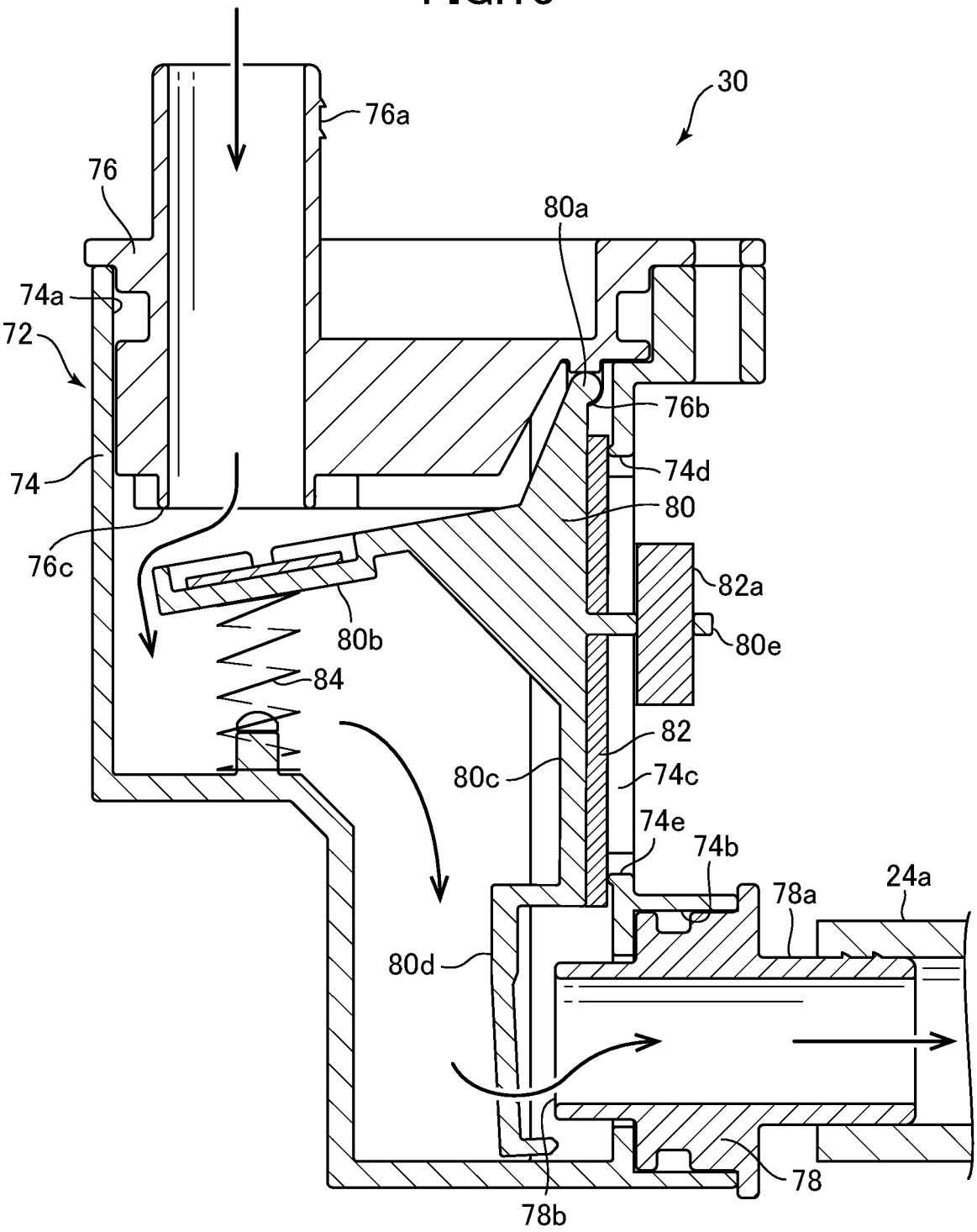
FIG. 13 is a cross-sectional view of the discharge/vacuum break valve device provided in the flush water tank apparatus according to the first embodiment of the present invention, and illustrates a state where the water is supplied from the water supply controller.

As illustrated in FIGS. 12 and 13, the discharge/vacuum break valve device 30 includes a valve body case 72, a flap valve body 80 which is a valve body, and a packing 82.

As illustrated in FIG. 11, the valve body case 72 includes a box-shaped main body portion 74, an inflow pipe connection member 76 attached to an upper surface of the main body portion 74, and an outflow pipe connection member 78 attached to a lower side surface of the main body portion 74.

The main body portion 74 of the valve body case 72 is formed into a substantially rectangular parallelepiped box shape in which one of lower side corners is cut out. The main body portion 74 has an opening portion in the upper surface thereof, and the inflow pipe connection member 76 is attached thereto to close the opening portion 74*a*. An attaching portion 74*b* for the outflow pipe connection member 78 is provided on the side on which the corner is not cut out, in the lower side surface of the main body portion 74, and the outflow pipe connection member 78 is attached to the attaching portion 74*b*. Additionally, an air intake/water discharge opening 74*c* is provided in a side surface of the main body portion 74 and on an upper side of the attaching portion 74*b*.

The air intake/water discharge opening 74*c* is an opening having a longitudinal rectangular shape and directed toward a substantially vertical direction. In a state where the flap valve body 80 is open, external air is drawn via the air intake/water discharge opening 74*c*, and the water that has flowed backward from the inflow pipe 24*a* flows out from the air intake/water discharge opening 74*c*, and is discharged into the reservoir tank 10. That is, the air intake/water discharge opening 74*c* is formed into a vertical face directed toward a substantially vertical direction of the main body portion 74, and is formed to be longer in the vertical direction than in the horizontal direction. Each of a top edge 74*d* and a bottom edge 74*e* of the air intake/water discharge opening 74*c* is formed linearly to extend in the horizontal direction, and the water that has flowed backward to the discharge/vacuum break valve device 30 is discharged into the reservoir tank 10 beyond the bottom edge 74*e*. The air intake/water discharge opening 74*c* may be provided in a sloping surface inclined with respect to the horizontal direction.

In the inflow pipe connection member 76, a water flow pipe attaching portion 76*a* is provided to project upward. A water flow pipe extending from the water supply controller 18 (FIG. 2) is connected to the water flow pipe attaching portion 76*a*. A lower end of the water flow pipe attaching portion 76*a* is open to the interior of the main body portion 74, and the water supplied from the water supply controller 18 flows into the discharge/vacuum break valve device 30 through an inflow port 76*c* at the lower end of the water flow pipe attaching portion 76*a*. That is, the water that has flowed out from the water supply controller 18 flows vertically downward into the valve body case 72 from the inflow port 76*c* through the water flow pipe attaching portion 76*a* provided above the discharge/vacuum break valve device 30.

In the outflow pipe connection member 78, a water flow pipe attaching portion 78*a* is provided to project horizontally. The inflow pipe 24*a* is connected to the water flow pipe attaching portion 78*a*. Therefore, the water that has been supplied from the water supply controller 18 and has flowed into the valve body case 72 flows out from the discharge/vacuum break valve device 30 through an outflow port 78*b* at an upstream end of the water flow pipe attaching portion 78*a*, and is supplied to the discharge valve hydraulic drive portion 14 via the inflow pipe 24*a*. That is, the water that has flowed into the discharge/vacuum break valve device 30 is supplied to the discharge valve hydraulic drive portion 14 through the outflow port 78*b*. The air intake/water discharge opening 74*c* is formed so that an area thereof is larger than that of the outflow port 78*b*, and the inflow port 76*c* is provided above the outflow port 78*b*.

The flap valve body 80 is a substantially L-shaped member that is turnably attached in the valve body case 72, and is configured to open and close the air intake/water discharge opening 74*c*. A support shaft 80*a*, which is a central axis, extending horizontally is formed in the vicinity of a corner portion of the L-shape of the flap valve body 80. The support shaft 80*a* is turnably supported on a bearing portion 76*b* provided in the inflow pipe connection member 76, and the flap valve body 80 is turned between the state illustrated in FIG. 12 and the state illustrated in FIG. 13. The support shaft 80*a* is disposed outside a perpendicular projection plane of the air intake/water discharge opening 74*c*. That is, the support shaft 80*a* is located outside the projection plane of the air intake/water discharge opening 74*c* that is formed by applying light perpendicularly to a surface (vertical face) on which the air intake/water discharge opening 74*c* is formed.

Additionally, the flap valve body 80 is provided with an arm portion extending laterally, and a supply water receiving portion 80*b* is provided at a distal end of the arm portion. The supply water receiving portion 80*b* is disposed below the water flow pipe attaching portion 76*a* to cover the inflow port 76*c*. Therefore, when the water flows in via the inflow port 76*c*, the supply water receiving portion 80*b* of the flap valve body 80 is pushed downward, and the flap valve body 80 is turned from the state illustrated in FIG. 12 to the state illustrated in FIG. 13.

Furthermore, the flap valve body 80 includes a valve plate portion 80*c* extending downward from the support shaft 80*a*, and a discharge water receiving portion 80*d* provided below the valve plate portion 80*c*. The valve plate portion 80*c* is disposed to face the air intake/water discharge opening 74*c* provided in the side surface of the main body portion 74, and is configured to cover the air intake/water discharge opening 74*c* when the flap valve body 80 is turned to the state illustrated in FIG. 13. A thin plate-shaped packing 82 is attached to a surface of the valve plate portion 80*c*, the surface being on the side facing the air intake/water discharge opening 74*c*. When the flap valve body 80 is turned to the state illustrated in FIG. 13, a gap between the valve plate portion 80*c* and the air intake/water discharge opening 74*c* is sealed. Here, since the support shaft 80*a* of the flap valve body 80 is disposed outside the perpendicular projection plane of the air intake/water discharge opening 74*c*, a crush amount of the packing 82 can be reliably ensured in a state where the flap valve body 80 is turned to the state illustrated in FIG. 13.

The discharge water receiving portion 80*d* is formed below the valve plate portion 80*c*, and is disposed to face the outflow port 78*b* of the outflow pipe connection member 78. Therefore, when the water flows backward from the inflow pipe 24*a* to the water flow pipe attaching portion 78*a*, the discharge water receiving portion 80*d* is pushed, and is turned from the state illustrated in FIG. 13 to the state illustrated in FIG. 12. The water that has flowed backward from the water flow pipe attaching portion 78*a* flows out through the air intake/water discharge opening 74*c*, and is discharged into the reservoir tank 10.

Additionally, in the valve plate portion 80*c*, a weight attaching portion 80*e* is provided to project from the air intake/water discharge opening 74*c*, and a weight 82*a* is attached to a distal end portion of the weight attaching portion 80*e*. When the weight 82*a* is attached, the center of gravity of the entire flap valve body 80 is located on a side (the right side in FIGS. 12 and 13) closer to the air intake/water discharge opening 74*c* than the support shaft 80*a*. As a result, the flap valve body 80 is turned to a position illustrated in FIG. 12 in a standby state where a moment of force for turning the flap valve body 80 in the clockwise direction in FIG. 13 around the support shaft 80*a* is applied and no static pressure and dynamic pressure of the water are applied. That is, the flap valve body 80 is in a standby position illustrated in FIG. 12 where the position of the center of gravity of the flap valve body 80 is lowest in the state where the water is not supplied to the discharge/vacuum break valve device 30.

A coil spring 84, which is a biasing spring, is attached to a bottom surface of a cutout portion of the main body portion 74 to be directed vertically upward. An upper end of the coil spring 84 is located below the supply water receiving portion 80*b* of the flap valve body 80. As illustrated in FIG. 13, the upper end of the coil spring 84 contacts the supply water receiving portion 80*b* in a state where the air intake/water discharge opening 74*c* is closed by the valve plate portion 80*c*, and the flap valve body 80 is biased in a direction of turning in the clockwise direction. That is, the coil spring 84 biases the flap valve body 80 in a direction in which the air intake/water discharge opening 74*c* is opened. On the other hand, in a state where the flap valve body 80 is turned to a position illustrated in FIG. 12, the upper end of the coil spring 84 does not contact the supply water receiving portion 80*b* and the biasing force by the coil spring 84 is not applied. Thus, the coil spring 84 does not apply the biasing force to the flap valve body 80 in a state where the air intake/water discharge opening 74*c* is open by a predetermined amount or more.

In the present embodiment, a cylindrical biasing spring is used as the coil spring 84. In the biasing spring, an increase in biasing force with respect to an increase in deformation amount becomes almost constant. In contrast, as a modification example, a conical coil spring can be also used as the biasing spring. The conical coil spring has the property of increasing an increase in biasing force with respect to an increase in deformation amount as the deformation amount is increased. Therefore, even when the conical coil spring is disposed to constantly bias the flap valve body 80, the biasing force having a similar tendency to the present embodiment can be applied. That is, when the conical coil spring is used, it makes it possible to relatively reduce the biasing force in a state where the flap valve body 80 is open, and to apply the biasing force so that the biasing force can increase rapidly as the flap valve body 80 approaches a closing position.

Next, the operation of the flush water tank apparatus 4 according to the first embodiment of the present invention and the flush toilet apparatus 1 provided with the same will be described.

First, in the toilet flush standby state, the water level in the reservoir tank 10 is the predetermined water level $L_1$, and the energization of the electromagnetic valve 20 is not performed. In this state, both of the electromagnetic valve-side pilot valve 50 and the float-side pilot valve 44 of the water supply controller 18 (FIG. 2) are in the closed state, and the valve seat 40 is closed by the main valve body 38. Next, when the user presses a flush button in the remote controller 6 (FIG. 1), the remote controller 6 transmits a command signal for flushing the toilet to the controller 28 (FIG. 2). In the flush toilet apparatus 1 of the present embodiment, after an elapse of a predetermined time period after a user's separation from the seat is detected by the human sensor 8 (FIG. 1), the command signal for flushing the toilet is transmitted to the controller 28 even without the flush button in the remote controller 6 being pressed.

When receiving the command signal for flushing the toilet, the controller 28 energizes the electromagnetic valve 20 to open the electromagnetic valve-side pilot valve 50. This reduces the pressure inside the pressure chamber 36*a*, the main valve body 38 is separated from the valve seat 40, and the valve seat 40 is opened. As a result, the tap water supplied from the water supply pipe 32 to the water supply controller 18 (FIG. 2) flows out from the water supply controller 18 and flows into the discharge/vacuum break valve device 30.

When the water flows into the discharge/vacuum break valve device 30, the supply water receiving portion 80*b* of the flap valve body 80 is pushed downward, and the flap valve body 80 is turned to the position illustrated in FIG. 13. In this way, the air intake/water discharge opening 74*c* in the discharge/vacuum break valve device 30 is closed by the flap valve body 80. The water that has flowed in through the inflow port 76*c* of the discharge/vacuum break valve device 30 flows into the valve body case 72 while bypassing the supply water receiving portion 80*b* as indicated by an arrow in FIG. 13, and further flows into the inflow pipe 24*a* through the outflow port 78*b* while bypassing the discharge water receiving portion 80*d*.

Furthermore, as illustrated in FIG. 2, the water that has flowed into the inflow pipe 24*a* flows into the cylinder 14*a* of the discharge valve hydraulic drive portion 14. The water that has flowed into the cylinder 14*a* causes the piston 14*b* to be pushed up against the biasing force of the spring 14*c*. At this time, since the clutch mechanism 22 is engaged (FIG. 3), the rod 15 connected to the piston 14*b* and the discharge valve 12 connected to the rod 15 are pulled up, whereby the discharge valve 12 is separated from the discharge port 10*a*. That is, the discharge valve 12 is driven by a drive force of the discharge valve hydraulic drive portion 14 based on the water supply pressure of tap water supplied via the water supply pipe 32, and is opened.

When the discharge valve 12 is opened, the flush water (tap water) stored in the reservoir tank 10 is discharged to the bowl 2*a* of the flush toilet main unit 2 through the discharge port 10*a*, whereby the bowl 2*a* is washed. When the flush water in the reservoir tank 10 is discharged, the water level in the reservoir tank 10 becomes lower than the predetermined stopped water level $L_1$, and therefore the water supply valve float 34 is lowered. Hereby, the arm portion 42 (FIG. 2) is turned, and the float-side pilot valve 44 is opened.

In a state where the float-side pilot valve port (not illustrated) is open, the pressure inside the pressure chamber 36*a* is not increased even when the electromagnetic valve-side pilot valve 50 is closed, and therefore the open state of the main valve body 38 can be maintained. Therefore, when the water level in the reservoir tank 10 is lowered after an elapse of the predetermined time period after the controller 28 energizes the electromagnetic valve 20 to open the main valve body 38, the energization of the electromagnetic valve 20 is stopped. Hereby, the electromagnetic valve-side pilot valve 50 is closed. However, since the float-side pilot valve port is open, the main valve body 38 remains separated from the valve seat 40. That is, the controller 28 can open the main valve body 38 for a long time only by energizing the electromagnetic valve 20 for a short time.

On the other hand, the water that has flowed into the pressure chamber 16*a* in the cylinder 14*a* of the discharge valve hydraulic drive portion 14 from the inflow pipe 24*a* pushes up the piston 14*b* from the position illustrated in FIG. 3 to the position illustrated in FIG. 4. Here, when the piston 14*b* is located at the first position (FIG. 3), the side openings 17*b* provided in the rod 15 are located outside the pressure chamber 16*a*, and therefore the pressure inside the pressure chamber 16*a* can be easily increased without causing the water in the pressure chamber 16*a* to flow out through the side openings 17*b*. When the piston 14*b* is pushed up, and accordingly, the rod 15 and the discharge valve 12 are pulled up to a predetermined position, the clutch mechanism 22 disconnects the discharge valve 12 from the rod 15.

That is, as illustrated in FIG. 8, the restricting portion 70 projecting downward from the cylinder 14*a* turns the movable member 60 to the "disengagement position," and the engagement between the pull-up portion 15*b* of the rod 15 and the abutting portions 68 of the movable member 60 is released. Hereby, the rod 15 remains pushed up upward together with the piston 14*b*, while the discharge valve 12 falls by its own weight. However, the engaging projection 12*c* (FIG. 5) of the disconnected discharge valve 12 is engaged with the engaging portion 26*b* of the discharge valve float mechanism 26, thereby stopping the fall of the discharge valve 12. Hereby, the discharge port 10*a* of the reservoir tank 10 remains open, and the water discharge from the reservoir tank 10 is continued.

On the other hand, when the piston 14*b* is pushed up from the first position illustrated in FIG. 3 to the second position illustrated in FIG. 4, the side openings 17*b* provided in the rod 15 moves from the outside of the cylinder 14*a* to the inside of the pressure chamber 16*a*. That is, as illustrated in FIG. 4, when the side openings 17*b* moves above the upper end of the sleeve 14*f* provided in the cylinder 14*a*, the side openings 17*b* open into the pressure chamber 16*a*. Hereby, the pressure chamber 16*a* and the back pressure chamber 16*b* in the cylinder 14*a* communicate with each other through the communicating flow path 17. That is, the water that has flowed into the pressure chamber 16*a* flows into the communicating flow path 17 through side openings 17*b*, and flows into the back pressure chamber 16*b* through the upper end opening 17*a*.

At this time, when the edge portion 17*c* above the side openings 17*b* directed horizontally moves above the upper end of the sleeve 14*f*, an opening area of each side opening 17*b* into the pressure chamber 16*a* increases suddenly, and the water in the pressure chamber 16*a* flows into the back pressure chamber 16*b* rapidly. The water that has flowed into the back pressure chamber 16*b* flows out from the cylinder 14*a* through the outflow pipe 24*b*. At this time, the outflow guiding portion 14*g* provided on the ceiling surface of the cylinder 14*a* guides, toward the outflow pipe 24*b*, the water that has flowed out from the upper end opening 17*a*. The water that has flowed out through the outflow pipe 24*b* branches at the outflow pipe branching portion 24*c* (FIG. 2), and flows into the reservoir tank 10 and the overflow pipe 10*b*. A part of the water that has flowed from the inflow pipe 24*a* into the cylinder 14*a* flows out from the gap 14*d* between the inner wall of the sleeve 14*f* of the cylinder 14*a* and the rod 15, and flows into the reservoir tank 10.

Next, when the water level in the reservoir tank 10 is lowered to a second predetermined water level that is lower than the stopped water level $L_1$, the float portion 26*a* (FIG. 5) of the discharge valve float mechanism 26 is lowered, which causes the engaging portion 26*b* to move to the disengagement position indicated by an imaginary line in FIG. 5. Hereby, the engagement between the engaging projection 12*c* of the discharge valve 12 and the engaging portion 26*b* is released, and the discharge valve 12 starts to be lowered again. Then, the discharge valve 12 closes the discharge port 10*a* of the reservoir tank 10 to stop the discharge of the flush water to the flush toilet main unit 2. Since the valve seat 40 in the water supply controller 18 is in the open state even after the discharge port 10*a* is closed, the water supplied from the water supply pipe 32 flows into the discharge valve hydraulic drive portion 14, and the water that has flowed out from the discharge valve hydraulic drive portion 14 flows into the reservoir tank 10 through the outflow pipe 24*b*, whereby the water level in the reservoir tank 10 rises.

When the water level in the reservoir tank 10 rises to the predetermined water level $L_1$, the water supply valve float 34 (FIG. 2) rises, and the float-side pilot valve 44 is moved via the arm portion 42, whereby the float-side pilot valve 44 is closed. Hereby, the float-side pilot valve port (not illustrated) and the pilot valve port (not illustrated) of the main valve body 38 are closed, and therefore, the pressure inside the pressure chamber 36*a* is increased, and the main valve body 38 is seated on the valve seat 40. As a result, the water supply from the water supply controller 18 is stopped. When the water supply from the water supply controller 18 is stopped, the piston 14*b* of the discharge valve hydraulic drive portion 14 is pushed down by the biasing force of the spring 14*c*, and accordingly the rod 15 is also pushed down.

When the rod 15 is pushed down (FIG. 9) together with the piston 14*b*, the rod 15 and the discharge valve 12 that have been disconnected from each other by the clutch mechanism 22 are connected to each other again. That is, as illustrated in FIG. 10, the abutted portion 15*d* of the rod 15 that has been lowered contacts the movable member 60, the movable member 60 is turned to the "engagement position," and the pull-up portion 15*b* of the rod 15 is engaged with the abutting portions 68 of the movable member 60 (FIG. 7). Therefore, when the next toilet flush operation is performed, the rod 15 and the discharge valve 12 are pulled up together by the piston 14*b*. Thus, one toilet flush operation is completed, and the flush toilet apparatus 1 returns to the standby state of the toilet flush operation.

Next, the operation of the discharge/vacuum break valve device 30 after the water supply from the water supply controller 18 is stopped will be described.

When the water supply from the water supply controller 18 is stopped, the dynamic pressure by the water supply is not applied to the supply water receiving portion 80*b* (FIG.

13) of the flap valve body 80 provided in the discharge/vacuum break valve device 30. As a result, the flap valve body 80 is turned from the state illustrated in FIG. 13 to the state illustrated in FIG. 12 by the biasing force or the like of the coil spring 84, whereby the air intake/water discharge opening 74*c* is opened. On the other hand, when the water supply from the water supply controller 18 is stopped, the piston 14*b* (FIG. 4) of the discharge valve hydraulic drive portion 14 that has been pushed up to the second position is pushed down by the biasing force of the spring 14*c*. Hereby, most of the water with which the pressure chamber 16*a* in the cylinder 14*a* is filled flows backward toward the discharge/vacuum break valve device 30 through the inflow pipe 24*a*.

The water that has flowed backward from inflow pipe 24*a* to the discharge/vacuum break valve device 30 flows into the valve body case 72 through the outflow port 78*b* of the water flow pipe attaching portion 78*a* as indicated by solid arrows in FIG. 12, and flows out beyond the bottom edge 74*e* of the air intake/water discharge opening 74*c*. The water that has flowed out from the air intake/water discharge opening 74*c* in the discharge/vacuum break valve device 30 is discharged into the reservoir tank 10. Here, since the bottom edge 74*e* of the air intake/water discharge opening 74*c* is formed linearly in the horizontal direction, a relatively large flow path can be ensured to enable the water that has flowed backward to be discharged in the case where the air intake/water discharge opening 74*c* is opened even a little bit. Thus, the water that has flowed backward from the discharge valve hydraulic drive portion 14 can be discharged promptly, and therefore the remaining water in the cylinder 14*a* can be discharged quickly, and the flush water tank apparatus 4 can be returned to an initial state rapidly.

The outflow port 78*b* is provided below the inflow port 76*c*, which can prevent the water that has flowed backward into the discharge/vacuum break valve device 30 through the outflow port 78*b* from flowing backward to the inflow port 76*c*. Furthermore, since the air intake/water discharge opening 74*c* is formed so that an area thereof is larger than that of the outflow port 78*b*, the air intake/water discharge opening 74*c* is not filled with the water that has flowed backward through the outflow port 78*b*, and the water that has flowed backward through the outflow port 78*b* is discharged promptly. In addition, since the orifice 24*d* (FIG. 2) which is flow rate reduction unit is provided in the flow path between the discharge/vacuum break valve device 30 and the discharge valve hydraulic drive portion 14, a large flow rate of water from the discharge/vacuum break valve device 30 can be prevented from flowing backward, and the air intake/water discharge opening 74*c* can be reliably prevented from being filled with the water. According to these configurations, the water that has flowed backward into the discharge/vacuum break valve device 30 through the outflow port 78*b* can be reliably prevented from flowing backward to the water supply controller 18 on the upstream side. In the present embodiment, the orifice 24*d* is provided as the flow rate reduction unit, but another configuration can be used to reduce the flow rate of the water flowing backward.

On the other hand, when the air intake/water discharge opening 74*c* in the discharge/vacuum break valve device 30 is opened, external air is drawn into the valve body case 72 through an upper portion of the air intake/water discharge opening 74*c* as indicated by dotted arrows in FIG. 12. That is, the air intake/water discharge opening 74*c* is formed vertically long, which makes it possible to easily introduce the external air from the upper portion of the air intake/water discharge opening 74*c* while discharging the water that has flowed backward through the outflow port 78*b* from the lower portion of the air intake/water discharge opening 74*c*. Thus, even when the water supply from the water supply controller 18 is stopped and the pressure on the water flow pipe attaching portion 76*a* side is negative, the external air is drawn from the discharge/vacuum break valve device 30, thereby preventing the water that has flowed backward from the inflow pipe 24*a* from flowing backward to the water supply controller 18. Here, since the top edge 74*d* of the air intake/water discharge opening 74*c* is formed linearly in the horizontal direction, a relatively large flow path can be ensured to enable the external air to be drawn in the case where the air intake/water discharge opening 74*c* is opened even a little bit.

Furthermore, as illustrated in FIG. 12, since the inflow port 76*c* provided in the lower end of the water flow pipe attaching portion 76*a* is located below the top edge 74*d* of the air intake/water discharge opening 74*c*, the water in the valve body case 72 does not flow backward into the water flow pipe attaching portion 76*a*, whereby the backward flow can be reliably prevented. Thus, when the water supply from the upstream side is stopped, the flap valve body 80 in the discharge/vacuum break valve device 30 is operated to discharge the water that has flowed backward from the discharge valve hydraulic drive portion 14 while opening the upstream side to the atmosphere. The discharge/vacuum break valve device 30 has both of a function of discharging the water that has flowed backward from the downstream side and a function of drawing the external air into a conduit, and the air intake/water discharge opening 74*c* functions as an inlet port of the external air and a discharge port of the water in the conduit.

Next, referring to FIGS. 14A-14H, a force applied to open and close the flap valve body 80 will be described.

FIGS. 14A-14H are a diagram for illustrating a force to be applied to the flap valve body 80 in the discharge/vacuum break valve device 30 in each operating state.

Figure 14A:
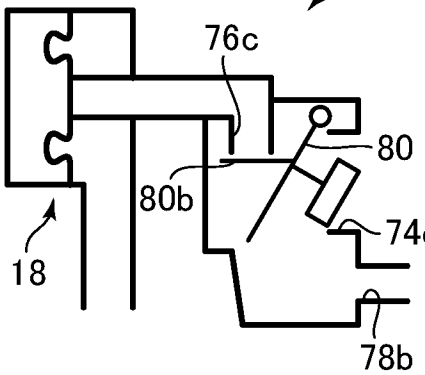
FIGS. 14A-14H are a diagrams for illustrating a force to be applied, in each operating state, to a flap valve body in the discharge/vacuum break valve device provided in the flush water tank apparatus according to the first embodiment of the present invention.

First, in a state before the water supply from the water supply controller 18 is started as illustrated in FIG. 14A, the flap valve body 80 in the discharge/vacuum break valve device 30 is in the stand-by position. In this state, a force to be applied to the flap valve body 80 is only gravity, the flap valve body 80 is turned to the state (the state illustrated in FIG. 12) of the stand-by position where the gravity is lowest, and the air intake/water discharge opening 74*c* is open. In the state where the flap valve body 80 is in the stand-by position, the coil spring 84 (FIG. 12) does not contact the flap valve body 80, and therefore the biasing force by the coil spring 84 is not applied to the flap valve body 80.

Figure 14B:
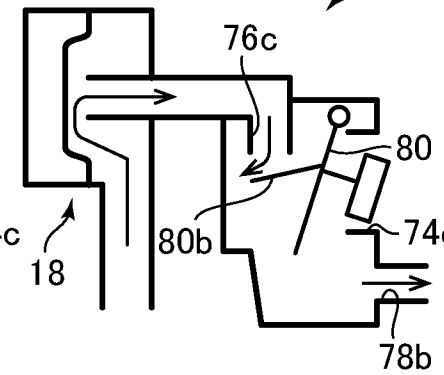

Next, as illustrated in FIG. 14B, when the water supply from the water supply controller 18 is started, the supply water receiving portion 80*b* of the flap valve body 80 is pushed by the dynamic pressure of the water that has flowed in from the inflow port 76*c*, and a moment T1 of a force based on the dynamic pressure is applied to the flap valve body 80. Thus, by the moment T1 of the force, the flap valve body 80 is turned in a direction of closing the air intake/water discharge opening 74*c*. That is, the moment T1 of the force based on the dynamic pressure of the water that has flowed in from the inflow port 76*c* overcomes a moment Tg of a force based on the gravity acting on the flap valve body 80 that is intended to be maintained in the stand-by position ($T1-Tg>0$), whereby the flap valve body 80 is turned. When the flap valve body 80 is further turned in the closing direction by a predetermined amount or more, the coil spring 84 (FIG. 12) contacts the flap valve body 80, whereby a moment Tb of a force based on the biasing force of the coil spring 84 is also applied to the flap valve body 80. The flap valve body 80 also overcomes the biasing force by the coil spring 84 (T1−Tg−Tb>0), whereby the flap valve body 80 is turned in the closing direction.

Figure 14C:
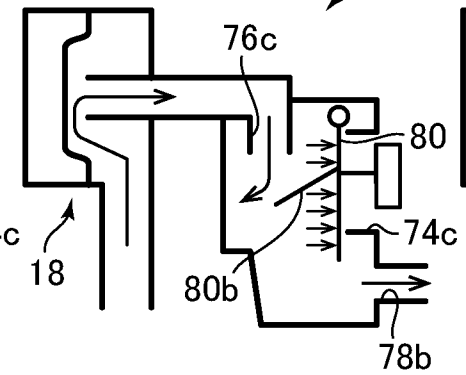

When the flap valve body 80 is further turned and the air intake/water discharge opening 74*c* is close to the closed state, the flap valve body 80 is pressed in the closing direction also by a moment Ts of a force based on the static pressure of the water in the discharge/vacuum break valve device 30, as illustrated in FIG. 14C.

Figure 14D:
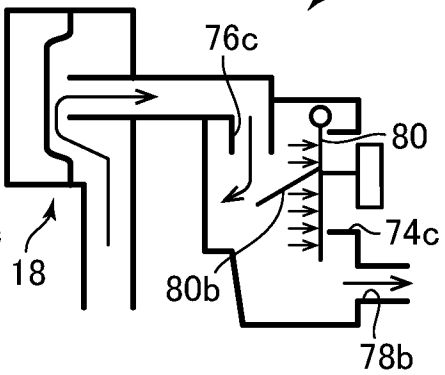

Next, as illustrated in FIG. 14D, in a state where the air intake/water discharge opening 74*c* is closed by the flap valve body 80, and the water supply from the water supply controller 18 is continued, the flap valve body 80 is closed by the static pressure and the dynamic pressure. That is, the closed state of the air intake/water discharge opening 74*c* is stably maintained by the moment T1 of the force based on the dynamic pressure of the water supply applied to the supply water receiving portion 80*b* of the flap valve body 80 and the moment Ts of the force based on the static pressure applied to the rear surface of the flap valve body 80 (T1+Ts−Tg−Tb>0).

Figure 14E:
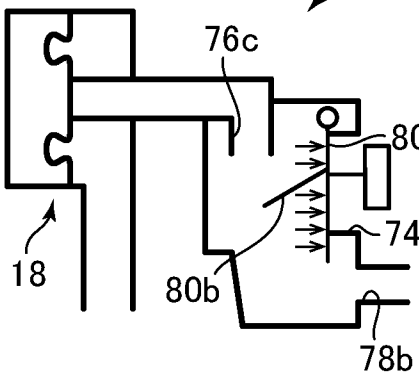

Furthermore, as illustrated in FIG. 14E, when the water supply from the water supply controller 18 is stopped, the moment T1 of the force based on the dynamic pressure of the water supply is not applied to the flap valve body 80. In this state, the sum of the moments (Tg and Tb) in the direction of opening the flap valve body 80 is larger than the moment (Ts) of the force in the direction of closing the flap valve body 80 (Ts−Tg−Tb<0). Thus, the flap valve body 80 starts to be turned in the opening direction. Here, since the force based on the static pressure applied to the flap valve body 80 is proportional to the opening area of the air intake/water discharge opening 74*c*, the moment Ts of the force based on the static pressure becomes excessive when the opening area is set excessively, which makes it difficult to open the flap valve body 80.

Figure 14F:
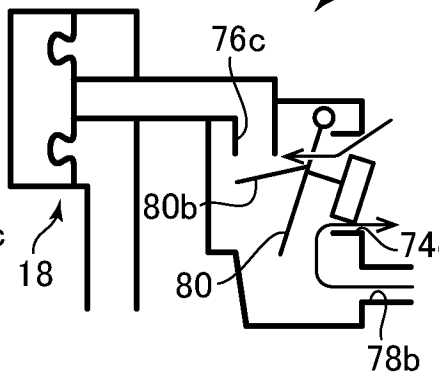

Next, as illustrated in FIG. 14F, when the flap valve body 80 is opened, the atmosphere is introduced from the air intake/water discharge opening 74*c* into the discharge/vacuum break valve device 30, and the water in the discharge/vacuum break valve device 30 is discharged through the air intake/water discharge opening 74*c*. When the atmosphere is introduced into the discharge/vacuum break valve device 30, the moment Ts of the force based on the static pressure is not applied to the flap valve body 80 (Ts=0). When the flap valve body 80 is turned in the opening direction by the predetermined amount or more, a distal end of the coil spring 84 (FIG. 12) is separated from the flap valve body 80, whereby the moment Tb of the force based on the biasing force of the coil spring 84 is not applied to the flap valve body 80 (Tb=0). Even in this state, the open state of the flap valve body 80 is maintained (−Tg<0).

Figure 14G:
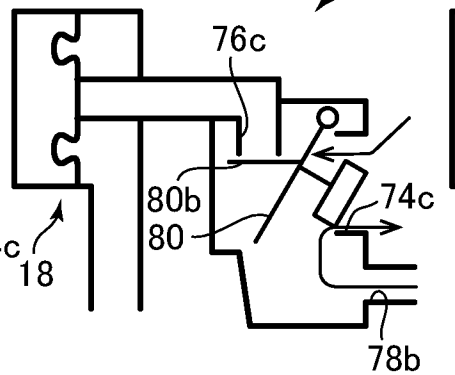

Furthermore, as illustrated in FIG. 14G, when the water starts to flow backward from the side of the discharge valve hydraulic drive portion 14 through the outflow port 78*b*, the flap valve body 80 is turned in the opening direction also by a moment T2 of a force based on the dynamic pressure of the water flowing backward through the outflow port 78*b*.

Figure 14H:
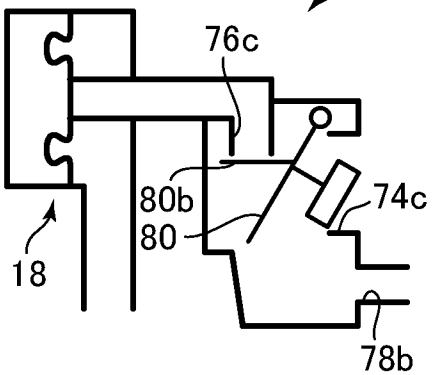

Next, as illustrated in FIG. 14H, when the discharge of the water that has flowed backward through the outflow port 78*b* is completed, the flap valve body 80 is maintained in the open state only by the moment Tg of the force based on the gravity applied to the flap valve body 80, and is returned to the state before the water supply from the water supply controller 18 is started. The discharge/vacuum break valve device 30 in the present embodiment is adapted to reliably perform the operations of FIGS. 14(A) to (H) by appropriately setting the moments T1, T2, Tg, Tb, and Ts of the forces to be applied to the flap valve body 80.

As described above, the discharge/vacuum break valve device 30 provided in the flush water tank apparatus 4 of the present embodiment functions as a negative pressure break valve (vacuum breaker) to discharge the backward-flow water and introduce the atmosphere into the conduit, but such a negative pressure break valve is different from a normal negative pressure break valve provided in the conventional flush water tank apparatus or the like. This will be described below referring to FIG. 24.

Figure 24:
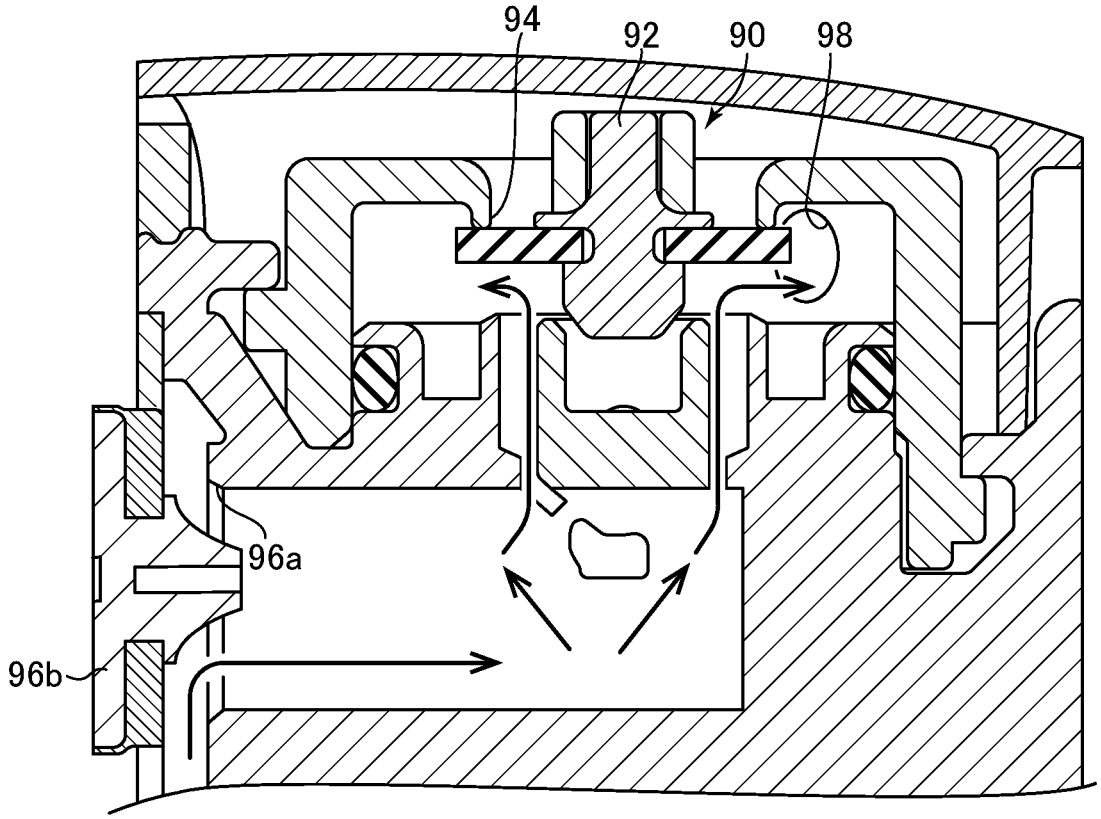
FIG. 24 is a cross sectional view illustrating a typical configuration of a normal negative pressure break valve.

FIG. 24 is a cross sectional view illustrating a typical configuration of the negative pressure break valve, and illustrates a configuration of the negative pressure break valve disclosed in Japanese Patent Laid-Open No. 2013-204389, as an example.

As illustrated in FIG. 24, a normal negative pressure break valve 90 includes a negative pressure break valve body 92, and an air opening 94 configured to be opened and closed by the negative pressure break valve body 92. In an example illustrated in FIG. 24, the negative pressure break valve 90 is provided in the middle of the flow path from a main valve port 96*a* to an outflow port 98. The flush water that has flowed in from the main valve port 96*a* and has flowed out from the outflow port 98 can be used to be supplied into the reservoir tank and to refill a toilet main unit via a hose for make-up water and an overflow pipe. The negative pressure break valve body 92 is a valve body disposed to be movable vertically, and is configured to close the air opening 94 when being moved upward. On the other hand, the air opening 94 is an opening formed in a wall surface directed horizontally, and opens vertically upward. In the example illustrated in FIG. 24, an upper side of the air opening 94 is open to the atmosphere.

As illustrated in FIG. 24, when the main valve body 96*b* is opened, the water flows in from the main valve port 96*a*, and the water that has flowed in from the main valve port 96*a* flows along the flow path and is directed upward. The negative pressure break valve body 92 is pushed up upward by the dynamic pressure of the water flowing upward, and closes the air opening 94. In a state where the air opening 94 is closed, the water that has flowed in from the main valve port 96*a* flows out to the outflow port 98. On the other hand, when the flow-in of the water from the main valve port 96*a* is stopped, the dynamic pressure is not applied to the negative pressure break valve body 92, and therefore the negative pressure break valve body 92 is moved downward by gravity, whereby the air opening 94 is opened to the atmosphere. Accordingly, in the case where a negative pressure is generated on the upstream side of the main valve port 96*a*, the atmosphere is introduced from the air opening 94 into the flow path, and the negative pressure is broken. Therefore, the water on the downstream side of the negative pressure break valve 90 is drawn to the upstream side by the negative pressure generated on the upstream side of the main valve port 96*a*, which can prevent the water from flowing backward to the upstream side.

However, in the normal negative pressure break valve 90 having a structure illustrated in FIG. 24, it is impossible to discharge the water that has flowed backward from the downstream side while introducing the atmosphere into the conduit. That is, in the structure illustrated in FIG. 24, to discharge the backward-flow water from the air opening 94, it is necessary for the water level of the water that has flowed backward from the interior of the reservoir tank and the like to the outflow port 98 to rise up to a position higher than the air opening 94. In this state, since the air opening 94 is filled with the water, the atmosphere can no longer be introduced from the air opening 94. Thus, in the normal negative pressure break valve, it is impossible to discharge the backward-flow water while introducing the atmosphere. Therefore, the normal negative pressure break valve cannot operate in the same manner as the discharge/vacuum break valve device 30 in the present embodiment.

According to the above-described flush water tank apparatus 4 of the first embodiment of the present invention, the discharge/vacuum break valve device 30 discharges the water that has flowed backward from the discharge valve hydraulic drive portion 14 (FIG. 12) when the water supply from the upstream side is stopped, thereby making it possible to discharge the water that has flowed into the cylinder 14*a* (FIG. 2) of the discharge valve hydraulic drive portion 14 with a simple mechanism. This enables the piston 14*b* to be returned to the initial position quickly, which makes it possible to return to a state where a next toilet flush operation can be started in a short time. Additionally, according to the flush water tank apparatus 4 of the present embodiment, the discharge/vacuum break valve device 30 opens the upstream side to the atmosphere when the water supply from the upstream side is stopped, thereby making it possible to draw the atmosphere when the pressure on the upstream side of the discharge/vacuum break valve device 30 is negative, to thereby prevent the water from flowing backward to the upstream side.

Additionally, according to the flush water tank apparatus 4 of the present embodiment, the inflow port 76*c* is provided above the outflow port 78*b* (FIG. 12), thereby making it possible to reliably prevent the water that has flowed backward from the discharge valve hydraulic drive portion 14 to the outflow port 78*b* from flowing backward to the inflow port 76*c*. Additionally, the air intake/water discharge opening 74*c* configured to be opened or closed by the flap valve body 80 is formed in a vertical face, thereby making it possible to draw the atmosphere from the upper portion of the air intake/water discharge opening 74*c* while discharging, from the lower portion of the air intake/water discharge opening 74*c*, the water that has flowed backward from the discharge valve hydraulic drive portion 14 to the outflow port 78*b*, whereby the water discharge and the air drawing can be simultaneously performed.

Furthermore according to the flush water tank apparatus 4 of the present embodiment, the area of the air intake/water discharge opening 74*c* is larger than the area of the outflow port 78*b* in the discharge/vacuum break valve device 30, thereby making it possible to reliably draw the atmosphere while discharging the water that has flowed backward from the discharge valve hydraulic drive portion 14 to the outflow port 78*b*.

Additionally, according to the flush water tank apparatus 4 of the present embodiment, the air intake/water discharge opening 74*c* is formed to be longer in the vertical direction than in the horizontal direction (FIG. 11), thereby making it possible to reliably perform the discharge of the backward-flow water and the atmosphere drawing with a small opening area.

Furthermore, according to the flush water tank apparatus 4 of the present embodiment, the air intake/water discharge opening 74*c* is opened and closed by turning the flap valve body 80 in the discharge/vacuum break valve device 30, thereby making it possible to configure an opening/closing mechanism of the air intake/water discharge opening 74*c* in a compact manner, to thereby improve the flexibility in design of the discharge/vacuum break valve device 30.

Additionally, according to the flush water tank apparatus 4 of the present embodiment, the support shaft 80*a* around which the flap valve body 80 is turned is disposed outside the perpendicular projection plane of the air intake/water discharge opening 74*c* (FIG. 12), thereby making it possible to reliably ensure a crush amount of the packing 82 for sealing between the edge portion of the air intake/water discharge opening 74*c* and the flap valve body 80, to thereby reliably close the air intake/water discharge opening 74*c*.

Furthermore, according to the flush water tank apparatus 4 of the present embodiment, the bottom edge 74*e* of the air intake/water discharge opening 74*c* extends horizontally (FIG. 11) and the backward-flow water is discharged into the reservoir tank 10 beyond the bottom edge 74*e*, thereby making it possible to increase an area of the flow path through which the discharge water flows beyond the bottom edge 74*e*, to thereby reduce a rise of the water level in the discharge/vacuum break valve device 30.

Additionally, according to the flush water tank apparatus 4 of the present embodiment, the top edge 74*d* of the air intake/water discharge opening 74*c* extends horizontally (FIG. 12), thereby making it possible to increase an area of the flow path through which the external air is drawn through the air intake/water discharge opening 74*c* even in a state where the water is discharged from the air intake/water discharge opening 74*c*, to thereby reliably draw the atmosphere.

Furthermore, according to the flush water tank apparatus 4 of the present embodiment, the flap valve body 80 is in the stand-by position where the position of the center of gravity is lowest (FIG. 12) in the state where the water is not supplied to the discharge/vacuum break valve device 30, thereby making it possible to return the valve body to the stand-by position by its own weight with a simple structure.

Additionally, according to the flush water tank apparatus 4 of the present embodiment, the flap valve body 80 includes the weight 82*a*, thereby making it possible to increase the gravity applied to the flap valve body 80, to thereby reliably return the flap valve body 80 to the stand-by position with a simple structure.

Furthermore, according to the flush water tank apparatus 4 of the present embodiment, the flap valve body 80 includes the coil spring 84 that biases the air intake/water discharge opening 74*c* in the opening direction (FIG. 13), thereby making it possible to reliably open the air intake/water discharge opening 74*c* when the water supply to the discharge/vacuum break valve device 30 is stopped.

Additionally, according to the flush water tank apparatus 4 of the present embodiment, the biasing force is not applied to the flap valve body 80 (FIG. 12) in the state where the air intake/water discharge opening 74*c* is open by a predetermined amount or more, thereby making it possible to easily move the flap valve body 80 to be closed when the water supply to the discharge/vacuum break valve device 30 is started. On the other hand, the biasing force is applied to the flap valve body 80 (FIG. 13) when the opening degree of the air intake/water discharge opening 74*c* is less than the predetermined amount, thereby making it possible to easily open the valve body when the water supply to the discharge/vacuum break valve device is stopped.

Furthermore, according to the flush water tank apparatus 4 of the present embodiment, the flow rate of the water flowing backward to the discharge/vacuum break valve device 30 is reduced by the orifice 24*d* (FIG. 2) which is a flow rate reduction unit, thereby making it possible to prevent the air intake/water discharge opening 74*c* from being filled with a large flow rate of water from flowing backward from the discharge valve hydraulic drive portion 14, so that the external air can be drawn.

Next, referring to FIGS. 15 to 17, a flush water tank apparatus according to a second embodiment of the present invention and a flush toilet apparatus provided with the same will be described.

The flush water tank apparatus of the present embodiment is different from the flush water tank apparatus in the first embodiment in the structure of the discharge/vacuum break valve device, and the other structures are the same as those in the first embodiment. Accordingly, the following describes only the points that are different between the first embodiment and the second embodiment of the present invention. Similar components, operations and effects are not described.

Figure 15:
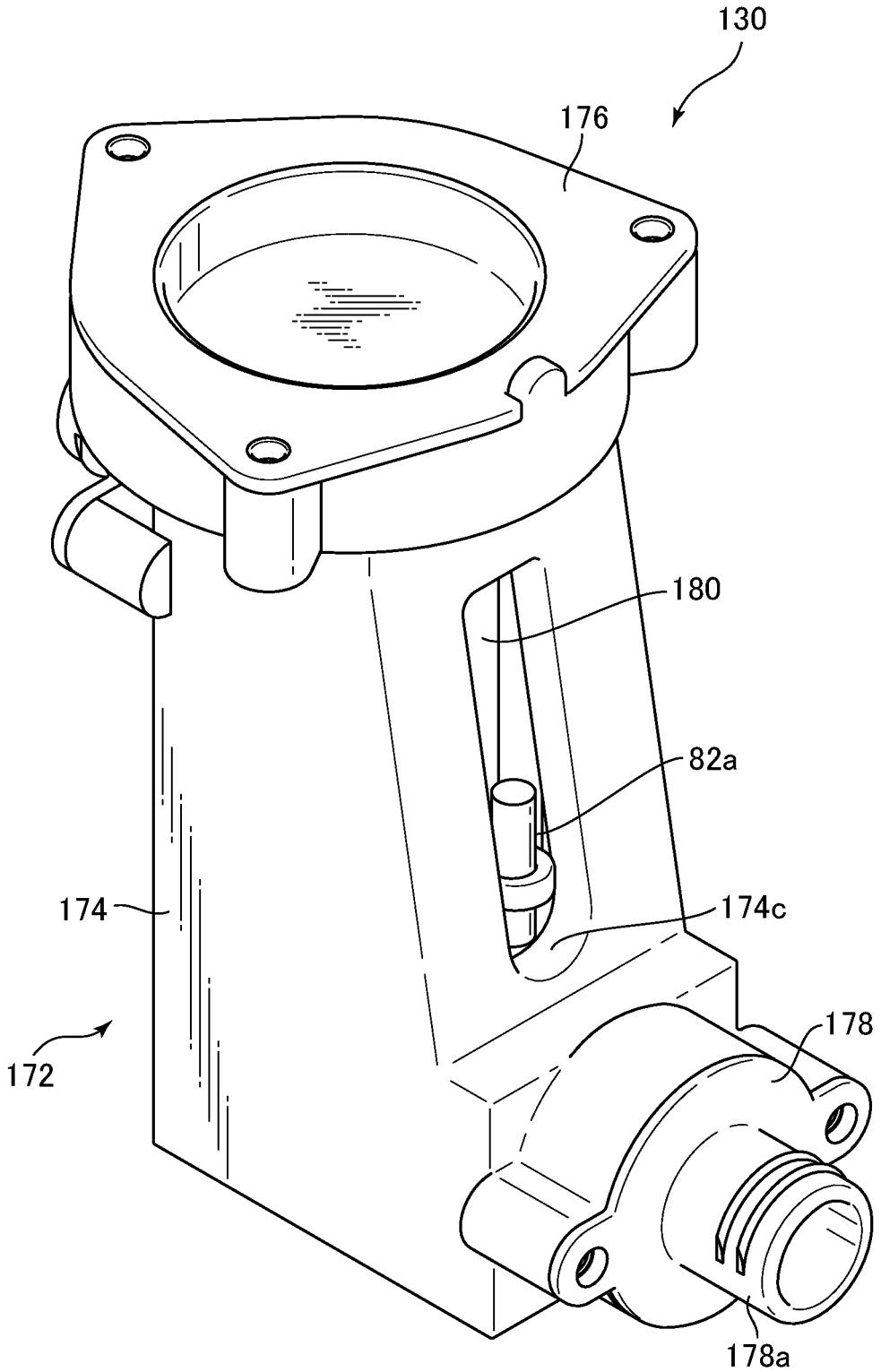
FIG. 15 is a perspective view of a discharge/vacuum break valve device provided in a flush water tank apparatus according to a second embodiment of the present invention.

FIG. 15 is a perspective view of a discharge/vacuum break valve device provided in the flush water tank apparatus according to the second embodiment of the present invention. FIG. 16 is a cross-sectional view of the discharge/vacuum break valve device in a state where water is not supplied from a water supply controller. FIG. 17 is a cross-sectional view of the discharge/vacuum break valve device in a state where the water is supplied from the water supply controller.

Figure 16:
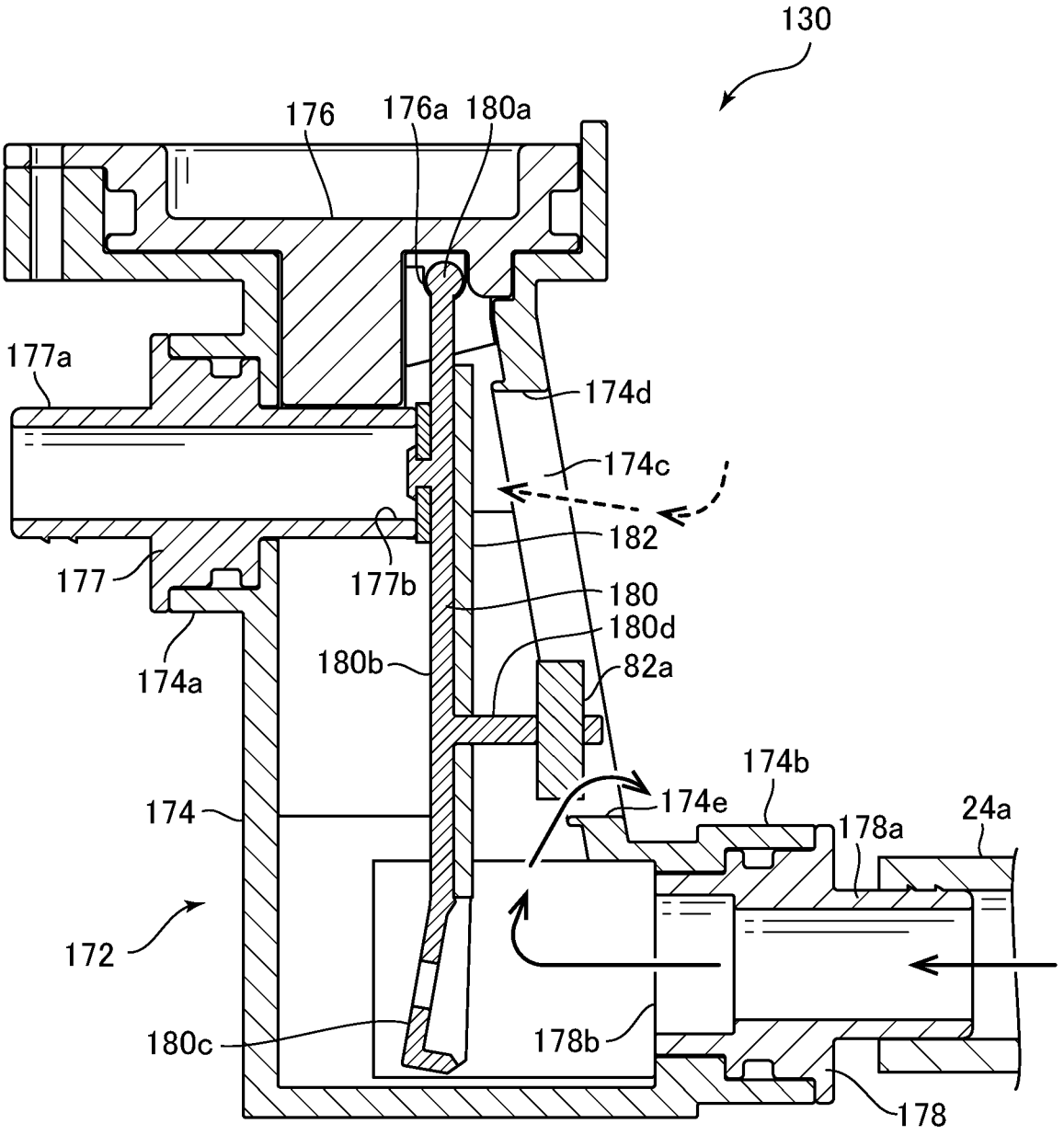
FIG. 16 is a cross-sectional view of the discharge/vacuum break valve device provided in the flush water tank apparatus according to the second embodiment of the present invention, and illustrates a state where the water is not supplied from a water supply controller.
Figure 17:
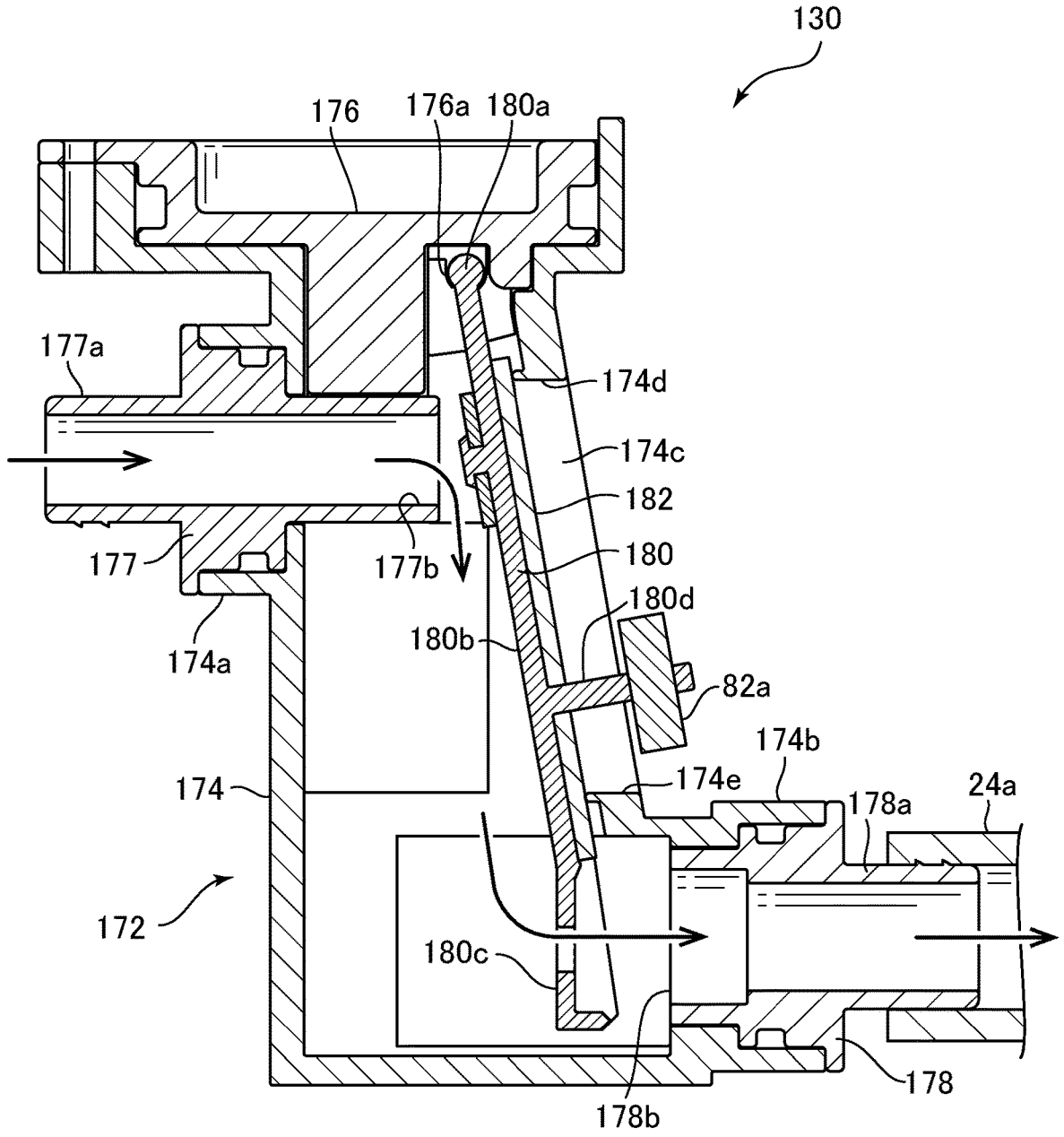
FIG. 17 is a cross-sectional view of the discharge/vacuum break valve device provided in the flush water tank apparatus according to the second embodiment of the present invention, and illustrates a state where the water is supplied from the water supply controller.

As illustrated in FIGS. 15 to 17, a discharge/vacuum break valve device 130 in the present embodiment includes a valve body case 172, a flap valve body 180 which is a valve body, and a packing 182.

The valve body case 172 includes a box-shaped main body portion 174, a lid member 176 attached to an upper surface of the main body portion 174, an inflow pipe connection member 177 (FIG. 16), and an outflow pipe connection member 178 attached to a lower side surface of the main body portion 174.

The main body portion 174 of the valve body case 172 is formed into a substantially trapezoidal box shape expanding downward, in which one of side surfaces is directed vertically, and the other side surface is inclined. The main body portion 174 has an opening portion in the upper surface thereof, and the lid member 176 is attached thereto to close the opening portion. An upper attaching portion 174*a* is provided on an upper portion of the side surface directed vertically of the main body portion 174, and the inflow pipe connection member 177 is attached to the upper attaching portion 174*a*. A lower attaching portion 174*b* is provided on a lower portion of the sloping side surface of the main body portion 174, and the outflow pipe connection member 178 is attached to the lower attaching portion 174*b*. Additionally, in the sloping side surface of the main body portion 174, an air intake/water discharge opening 174*c* is provided in an upper side of the lower attaching portion 174*b*.

The air intake/water discharge opening 174*c* is an opening having a longitudinal rectangular shape. In a state where the flap valve body 180 is open, external air is drawn via the air intake/water discharge opening 174*c*, and the water that has flowed backward from the inflow pipe 24*a* flows out from the air intake/water discharge opening 174*c*, and is discharged into the reservoir tank 10. That is, the air intake/water discharge opening 174*c* is an opening formed in the sloping side surface of the main body portion 174, and is formed to be longer in the vertical direction than in the horizontal direction. Additionally, a top edge 174*d* of the air intake/water discharge opening 174*c* is formed linearly to extend horizontally, and a bottom edge 174*e* extends in an arc shape. The water that has flowed backward to the discharge/vacuum break valve device 130 is discharged into the reservoir tank 10 beyond the bottom edge 174*e*.

In the inflow pipe connection member 177, a water flow pipe attaching portion 177*a* extending horizontally is provided to pass through the main body portion 174. One end of the water flow pipe attaching portion 177*a* projects outward of the main body portion 174 in a direction opposite to the air intake/water discharge opening 174*c*, and is connected to a water flow pipe extending from the water supply controller 18 (FIG. 2). On the other hand, the other end of the water flow pipe attaching portion 177*a* is open to the interior of the main body portion 174, and the water supplied from the water supply controller 18 flows into the discharge/vacuum break valve device 130 through an inflow port 177*b* at the other end of the water flow pipe attaching portion 177*a*. The inflow port 177*b* opens toward the rear surface of the flap valve body 180 disposed in the discharge/vacuum break valve device 130. That is, the water that has flowed out from the water supply controller 18 flows into the valve body case 172 horizontally from the inflow port 177*b* through the water flow pipe attaching portion 177*a* provided in the upper side surface of the discharge/vacuum break valve device 130.

In the outflow pipe connection member 178, a water flow pipe attaching portion 178*a* is provided to project horizontally. The inflow pipe 24*a* is connected to the water flow pipe attaching portion 178*a*. Therefore, the water that has been supplied from the water supply controller 18 and has flowed into the valve body case 172 flows out from the discharge/vacuum break valve device 130 through an outflow port 178*b* at an upstream end of the water flow pipe attaching portion 178*a*, and is supplied to the discharge valve hydraulic drive portion 14 via the inflow pipe 24*a*. That is, the water that has flowed into the discharge/vacuum break valve device 130 is supplied to the discharge valve hydraulic drive portion 14 through the outflow port 178*b*. The air intake/water discharge opening 174*c* is formed so that an area thereof is larger than that of the outflow port 178*b*, and the inflow port 177*b* is provided above the outflow port 178*b*.

The flap valve body 180 is a substantially rectangular plate-shaped member that is turnably attached in the valve body case 172, and is configured to open and close the air intake/water discharge opening 174*c*. A support shaft 180*a*, which is a central axis, extending horizontally is formed in an upper end of the flap valve body 180. The support shaft 180*a* is turnably supported on a bearing portion 176*a* provided in the lid member 176, and the flap valve body 180 is turned between the state illustrated in FIG. 16 and the state illustrated in FIG. 17. The support shaft 180*a* is disposed outside a perpendicular projection plane of the air intake/water discharge opening 174*c*. That is, the support shaft 180*a* is located outside the projection plane of the air intake/water discharge opening 174*c* that is formed by applying light perpendicularly to a surface (sloping face) on which the air intake/water discharge opening 174*c* is formed.

As described above, the water flow pipe attaching portion 177*a* is disposed on the upper rear surface side of the flap valve body 180, and the water supplied from the water supply controller 18 is discharged toward the rear surface of the flap valve body 180 from the inflow port 177*b*. Therefore, when the water flows in via the inflow port 177*b*, the rear surface of the flap valve body 180 is pushed toward the air intake/water discharge opening 174*c*, and the flap valve body 180 is turned from the state illustrated in FIG. 16 to the state illustrated in FIG. 17.

Furthermore, the flap valve body 180 includes a valve plate portion 180*b* extending downward from the support shaft 180*a*, and a discharge water receiving portion 180*c* provided below the valve plate portion 180*b*. The valve plate portion 180*b* is disposed to face the air intake/water discharge opening 174*c* provided in the sloped side surface of the main body portion 174, and is configured to cover the air intake/water discharge opening 174*c* when the flap valve body 180 is turned to the state illustrated in FIG. 17. A thin plate-shaped packing 182 is attached to a surface of the valve plate portion 180*b*, the surface being on the side facing the air intake/water discharge opening 174*c*. When the flap valve body 180 is turned to the state illustrated in FIG. 17, a gap between the valve plate portion 180*b* and the air intake/water discharge opening 174*c* is sealed. Here, since the support shaft 180*a* of the flap valve body 180 is disposed outside the perpendicular projection plane of the air intake/water discharge opening 174*c*, a crush amount of the packing 182 can be reliably ensured in a state where the flap valve body 180 is turned to the state illustrated in FIG. 17.

The discharge water receiving portion 180*c* is formed below the valve plate portion 180*b*, and is disposed to face the outflow port 178*b* of the outflow pipe connection member 178. Therefore, when the water flows backward from the inflow pipe 24*a* to the water flow pipe attaching portion 178*a*, the discharge water receiving portion 180*c* is pushed, and is turned from the state illustrated in FIG. 17 to the state illustrated in FIG. 16. The water that has flowed backward from the water flow pipe attaching portion 178*a* flows out through the air intake/water discharge opening 174*c*, and is discharged into the reservoir tank 10.

Additionally, in the valve plate portion 180*b*, a weight attaching portion 180*d* is provided to project from the air intake/water discharge opening 174*c*, and a weight 182*a* is attached to a distal end portion of the weight attaching portion 180*d*. When the weight 182*a* is attached, the center of gravity of the entire flap valve body 180 is located on a side (the right side in FIGS. 16 and 17) closer to the air intake/water discharge opening 174*c* than the support shaft 180*a*. As a result, the flap valve body 180 is turned to a position illustrated in FIG. 16 in a standby state where a moment of force for turning the flap valve body 180 in the clockwise direction in FIG. 17 around the support shaft 180*a* is applied and no static pressure and dynamic pressure of the water are applied. That is, the flap valve body 180 is in a standby position illustrated in FIG. 16 where the position of the center of gravity of the flap valve body 180 is lowest in the state where the water is not supplied to the discharge/vacuum break valve device 130.

As a modification example, a cover can be attached to an outer peripheral surface of the main body portion 174 to cover the air intake/water discharge opening 174*c*. The cover can prevent the water discharged into the reservoir tank 10 through the air intake/water discharge opening 174*c* from scattering. The water temporarily stays near the flap valve body 180 by causing the discharge water to collide with a surface of the cover facing the air intake/water discharge opening 174*c*, whereby the flap valve body 180 can more easily be turned in the opening direction.

As another modification example, an additional space can be formed below the outflow port 178*b* in the main body portion 174, so that the flap valve body 180 can extend into the space. That is, a distal end portion may be formed extending downward from a lower end of the discharge water receiving portion 180*c*. According to another modification example, in the case where the water flows backward to the water flow pipe attaching portion 178*a* through the inflow pipe 24*a*, the backward-flow water can be introduced to the discharge water receiving portion 180*c* by a portion forming the bottom edge 174*e*. In the case where the water flows in via the inflow port 177*b*, the portion forming the bottom edge 174*e* prevents the water from being discharged from the air intake/water discharge opening 174*c* to increase the internal pressure, and there is no portion projecting into the main body portion 174 at a lower position facing the portion forming the bottom edge 174*e*, whereby the water can flow out from the outflow port 178*b* smoothly. Furthermore, a biasing spring and a cover covering the biasing spring may be provided between the distal end portion and the inner wall of the main body portion 174.

Next, the operations of the flush water tank apparatus according to the second embodiment of the present invention and the flush toilet apparatus will be described.

First, when a command signal for flushing the toilet is received, the water is supplied from the water supply controller 18, and flows into the discharge/vacuum break valve device 130. When the water flows into the discharge/vacuum break valve device 130, the rear surface of the flap valve body 180 is pushed toward the air intake/water discharge opening 174*c* as illustrated in FIG. 16, and the flap valve body 180 is turned to the position illustrated in FIG. 17. In this way, the air intake/water discharge opening 174*c* in the discharge/vacuum break valve device 130 is closed by the flap valve body 180. The water that has flowed in through the inflow port 177*b* of the discharge/vacuum break valve device 130 flows into the valve body case 172 as indicated by an arrow in FIG. 17, and further flows into the inflow pipe 24*a* through the outflow port 178*b* while bypassing the discharge water receiving portion 180*c*.

Hereby, the flush water is supplied to the discharge valve hydraulic drive portion 14. A toilet flush operation by the flush water tank apparatus after the flush water is supplied to the discharge valve hydraulic drive portion 14 is similar to that in the first embodiment, and therefore description thereof is omitted.

Next, when the water supply from the water supply controller 18 is stopped after the toilet flush operation is completed, the dynamic pressure by the water supply is not applied to the rear surface of the valve plate portion 180*b* (FIG. 17) of the flap valve body 180 provided in the discharge/vacuum break valve device 130. As a result, the flap valve body 180 is turned from the state illustrated in FIG. 17 to the state illustrated in FIG. 16 by the gravity applied to the flap valve body 180, whereby the air intake/water discharge opening 174*c* is opened. On the other hand, when the water supply from the water supply controller 18 is stopped, the piston 14*b* (FIG. 4) of the discharge valve hydraulic drive portion 14 that has been pushed up to the second position is pushed down by the biasing force of the spring 14*c*. Hereby, most of the water with which the pressure chamber 16*a* in the cylinder 14*a* is filled flows backward toward the discharge/vacuum break valve device 130 through the inflow pipe 24*a*.

The water that has flowed backward from the inflow pipe 24*a* to the discharge/vacuum break valve device 130 flows into the valve body case 172 through the outflow port 178*b* of the water flow pipe attaching portion 178*a* as indicated by solid arrows in FIG. 16, and flows out beyond the bottom edge 174*e* of the air intake/water discharge opening 174*c*. The water that has flowed out from the air intake/water discharge opening 174*c* in the discharge/vacuum break valve device 130 is discharged into the reservoir tank 10. The outflow port 178*b* is provided below the inflow port 177*b*, which can prevent the water that has flowed backward into the discharge/vacuum break valve device 130 through the outflow port 178*b* from flowing backward to the inflow port 177*b*.

Furthermore, since the air intake/water discharge opening 174*c* is formed so that an area thereof is larger than that of the outflow port 178*b*, the air intake/water discharge opening 174*c* is not filled with the water that has flowed backward through the outflow port 178*b*, and the water that has flowed backward through the outflow port 178*b* is discharged promptly. With this configuration, the water that has flowed backward into the discharge/vacuum break valve device 130 through the outflow port 178*b* can be reliably prevented from flowing backward to the water supply controller 18 on the upstream side. Thus, the water that has flowed backward from the discharge valve hydraulic drive portion 14 can be discharged promptly, and therefore the remaining water in the cylinder 14*a* can be discharged quickly, and the flush water tank apparatus can be returned to an initial state rapidly.

On the other hand, when the air intake/water discharge opening 174*c* in the discharge/vacuum break valve device 130 is opened, external air is drawn into the valve body case 172 through an upper portion of the air intake/water discharge opening 174*c* as indicated by dotted arrows in FIG. 16. That is, the air intake/water discharge opening 174*c* is formed vertically long, which makes it possible to discharge the water that has flowed backward through the outflow port 178*b* from the lower portion of the air intake/water discharge opening 174*c* while easily introducing the external air from the upper portion of the air intake/water discharge opening 174*c*. Thus, even when the water supply from the water supply controller 18 is stopped and the pressure on the water flow pipe attaching portion 177*a* side is negative, the external air is drawn from the discharge/vacuum break valve device 130, thereby preventing the water that has flowed backward from the inflow pipe 24*a* from flowing backward to the water supply controller 18. Here, since the top edge 174*d* of the air intake/water discharge opening 174*c* is formed linearly in the horizontal direction, a relatively large flow path can be ensured to enable the external air to be drawn in the case where the air intake/water discharge opening 174*c* is opened even a little bit.

Furthermore, as illustrated in FIG. 16, since the inflow port 177*b* is located below the top edge 174*d* of the air intake/water discharge opening 174*c*, the water in the valve body case 172 does not flow backward into the water flow pipe attaching portion 177*a*, whereby the backward flow can be reliably prevented. Thus, when the water supply from the upstream side is stopped, the flap valve body 180 in the discharge/vacuum break valve device 130 is operated to discharge the water that has flowed backward from the discharge valve hydraulic drive portion 14 while opening the upstream side to the atmosphere. The discharge/vacuum break valve device 130 has both of a function of discharging the water that has flowed backward from the downstream side and a function of drawing the external air into a conduit, and the air intake/water discharge opening 174*c* functions as an inlet port of the external air and a discharge port of the water in the conduit.

According to the flush water tank apparatus of the second embodiment of the present invention, the air intake/water discharge opening 174*c* is provided in the sloping surface (FIG. 16), thereby making it possible to easily return the flap valve body 180 to the stand-by position by its own weight.

Next, referring to FIGS. 18 to 21, a flush water tank apparatus according to a third embodiment of the present invention and a flush toilet apparatus provided with the same will be described.

The flush water tank apparatus of the present embodiment is different from the flush water tank apparatus in the first embodiment in the structure of the discharge/vacuum break valve device, and the other structures are the same as those in the first embodiment. Accordingly, the following describes only the points that are different between the first embodiment and the third embodiment of the present invention. Similar components, operations and effects are not described.

Figure 18:
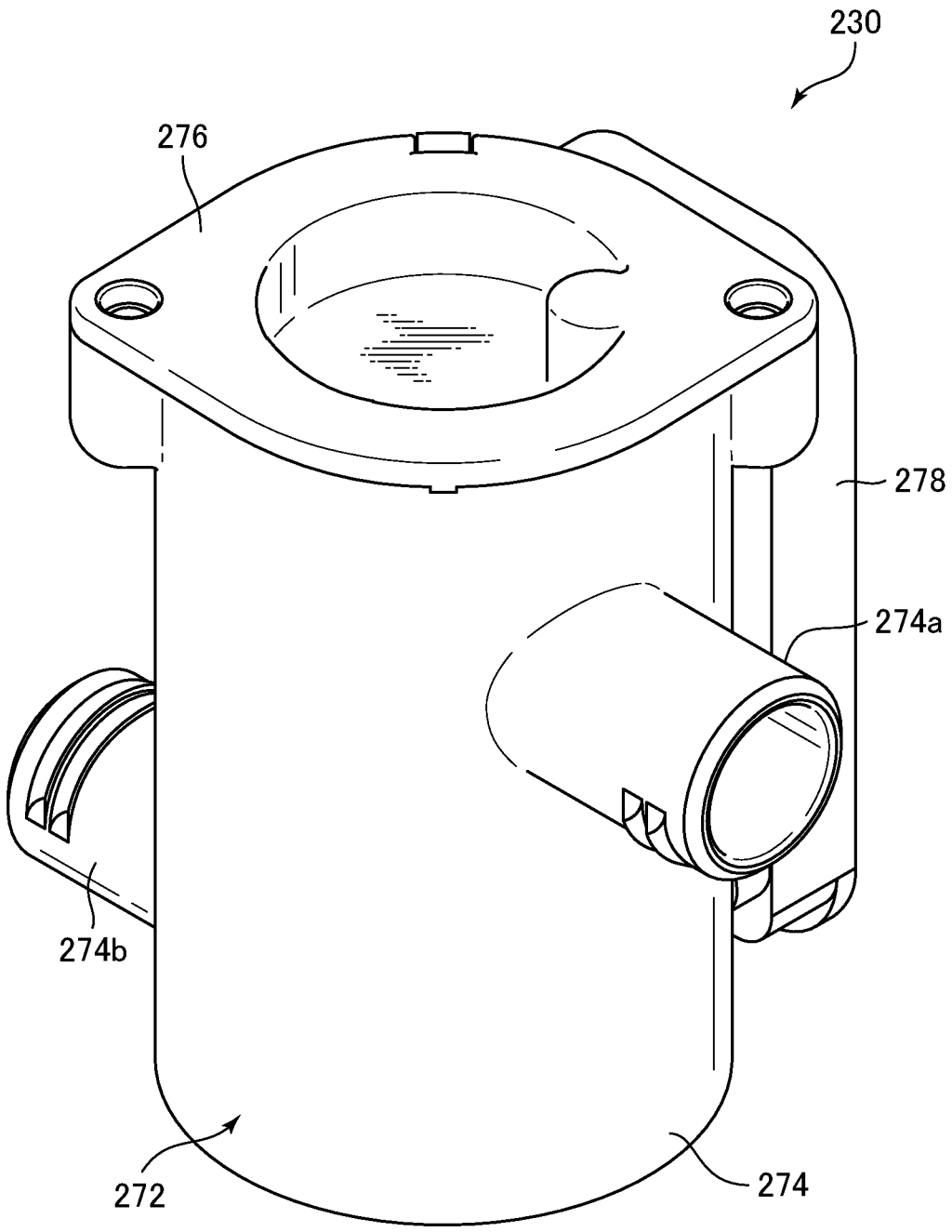
FIG. 18 is a perspective view of a discharge/vacuum break valve device provided in a flush water tank apparatus according to a third embodiment of the present invention.
Figure 19:
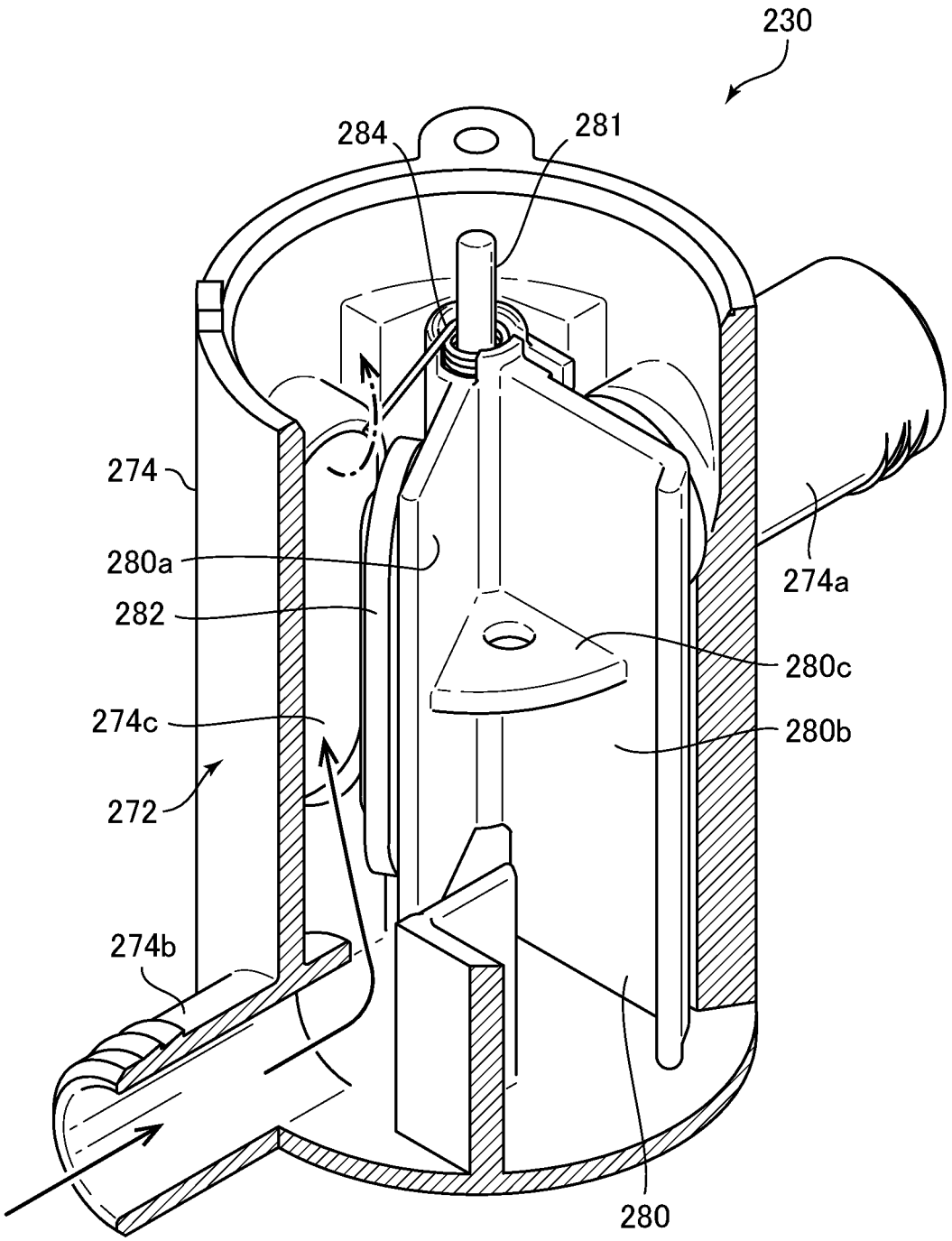
FIG. 19 is a perspective view illustrating the discharge/vacuum break valve device provided in the flush water tank apparatus according to the third embodiment of the present invention, in which a case of the discharge/vacuum break valve device is partially cut away.
Figure 20:
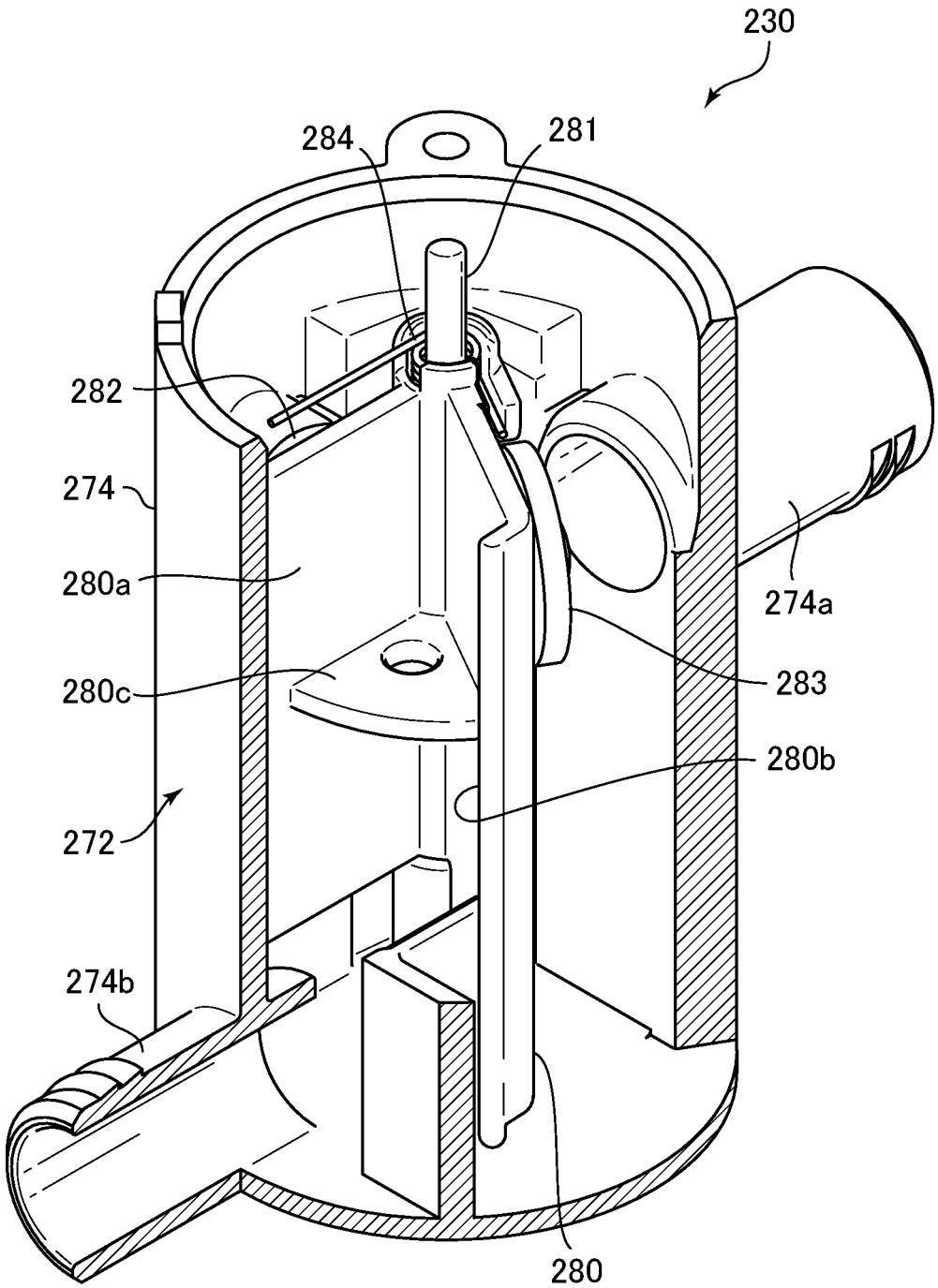
FIG. 20 is a perspective view illustrating the discharge/vacuum break valve device provided in the flush water tank apparatus according to the third embodiment of the present invention, in which the case of the discharge/vacuum break valve device is partially cut away.
Figure 21:
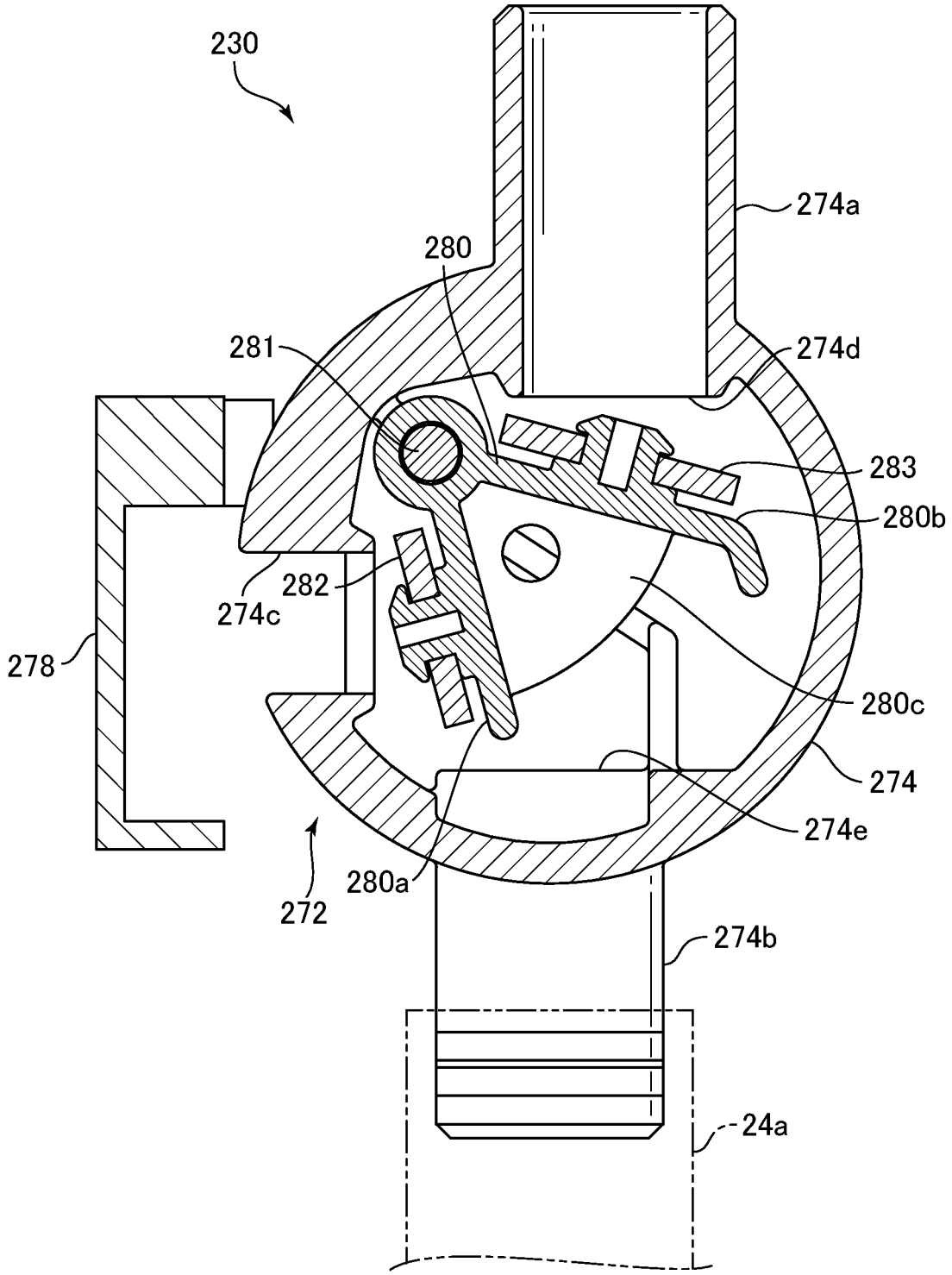
FIG. 21 is a horizontal cross sectional view of the discharge/vacuum break valve device provided in the flush water tank apparatus according to the third embodiment of the present invention.

FIG. 18 is a perspective view of a discharge/vacuum break valve device provided in the flush water tank apparatus according to the third embodiment of the present invention. FIG. 19 is a perspective view illustrating the discharge/vacuum break valve device in which a case is partially cut away, and illustrates a state where the water is not supplied from a water supply controller. FIG. 20 is a perspective view illustrating the discharge/vacuum break valve device in which a case is partially cut away, and illustrates a state where the water is supplied from the water supply controller. FIG. 21 is a horizontal cross sectional view illustrating an internal structure of the discharge/vacuum break valve device.

As illustrated in FIGS. 18 to 21, a discharge/vacuum break valve device 230 in the present embodiment includes a valve body case 272, a flap valve body 280 which is a valve body, and a packing 282.

The valve body case 272 includes a cylindrical main body portion 274, and a lid member 276 attached to an upper surface of the main body portion 274.

The main body portion 274 of the valve body case 272 is formed into a substantially cylindrical shape in which a central axis thereof is directed vertically. The main body portion 274 has an opening portion in the upper surface thereof, and the lid member 276 is attached thereto to close the opening portion. An inflow-side water flow pipe attaching portion 274*a* is provided on an upper portion of the outer peripheral surface of the main body portion 274, and an outflow-side water flow pipe attaching portion 274*b* is provided on a lower portion of the outer peripheral surface. Additionally, an air intake/water discharge opening 274*c* is also provided in the outer peripheral surface of the main body portion 274.

A cover 278 (FIG. 21) is attached to the outer peripheral surface of the main body portion 274. The cover 278 is attached to cover the air intake/water discharge opening 274*c* provided on a side surface of the main body portion 274. The water that has flowed out from the air intake/water discharge opening 274*c* flows out to the outside of the discharge/vacuum break valve device 230 through a gap between the cover 278 and the outer peripheral surface of the main body portion 274.

The inflow-side water flow pipe attaching portion 274*a* is a circular pipe formed to project from the upper side surface of the main body portion 274 horizontally in a direction perpendicular to the central axis of the main body portion 274. The outflow-side water flow pipe attaching portion 274*b* is a circular pipe formed to project from the lower side surface of the main body portion 274 horizontally in the direction perpendicular to the central axis of the main body portion 274. Additionally, a proximal end of the inflow-side water flow pipe attaching portion 274*a* is open inside the main body portion 274 as an inflow port 274*d* (FIG. 21) through which the supplied water flows in, and a proximal end of the outflow-side water flow pipe attaching portion 274*b* is open inside the main body portion 274 as an outflow port 274*e* through which the water in the discharge/vacuum break valve device 230 flows out.

The inflow port 274*d* at the proximal end of the inflow-side water flow pipe attaching portion 274*a* is provided above the outflow port 274*e* at the proximal end of the outflow-side water flow pipe attaching portion 274*b*. The outflow port 274*e* is provided below the lower end of the air intake/water discharge opening 274*c* formed in the side surface of the main body portion 274. A water flow pipe extending from the water supply controller 18 (FIG. 2) is connected to the inflow-side water flow pipe attaching portion 274*a*, and the water supplied from the water supply controller 18 flows into the valve body case 272 through the inflow port 274*d*. The inflow pipe 24*a* is connected to the outflow-side water flow pipe attaching portion 274*b*, and the water that has flowed into the valve body case 272 flows out through the outflow port 274*e*.

The outflow-side water flow pipe attaching portion 274*b* is provided on the opposite side of the inflow-side water flow pipe attaching portion 274*a*, and the inflow-side water flow pipe attaching portion 274*a* and the outflow-side water flow pipe attaching portion 274*b* are directed parallel to each other in a top view (FIG. 21). The air intake/water discharge opening 274*c* provided in the outer peripheral surface of the main body portion 274 is directed in a direction perpendicular to the inflow-side water flow pipe attaching portion 274*a* and the outflow-side water flow pipe attaching portion 274*b*.

The air intake/water discharge opening 274*c* is an opening formed into a vertically elongated oval shape (FIG. 19). In a state where the flap valve body 280 is open, external air is drawn via the air intake/water discharge opening 274*c*, and the water that has flowed backward from the inflow pipe 24*a* is discharged into the reservoir tank 10. That is, the air intake/water discharge opening 274*c* is an opening formed in a surface directed vertically of the main body portion 274, and is formed to be longer in the vertical direction than in the horizontal direction. The water that has flowed backward to the discharge/vacuum break valve device 230 is discharged into the reservoir tank 10 beyond a bottom edge of the air intake/water discharge opening 274*c*.

As illustrated in FIG. 19, the flap valve body 280 is a member including two rectangular plate-shaped portions that are turnably attached in the valve body case 272, and is configured to open and close the air intake/water discharge opening 274*c*. The flap valve body 280 includes a first flat plate portion 280*a*, a second flat plate portion 280*b*, and a connection portion 280*c* for connecting these plate portions. One long side of the first flat plate portion 280*a* and one long side of the second flat plate portion 280*b* are connected to each other with a predetermined angle therebetween. The connection portion 280*c* formed into a substantially sector-shape is used to connect between the first flat plate portion 280*a* and the second flat plate portion 280*b*. As illustrated in FIG. 20, the second flat plate portion 280*b* extends from near a ceiling surface to a bottom surface of the valve body case 272. In contrast, the first flat plate portion 280*a* extends from near the ceiling surface of the valve body case 272 to a position spaced above the bottom surface by a predetermined distance, so that a gap is provided between the lower end of the first flat plate portion 280*a* and the bottom surface of the valve body case 272.

A shaft 281 extending axially is provided in the cylindrical valve body case 272. The shaft 281 turnably supports the connection portion of the first flat plate portion 280*a* and the second flat plate portion 280*b* of the flap valve body 280, so that the flap valve body 280 is turned around the shaft 281. In a state where the flap valve body 280 is turned to a position illustrated in FIG. 19, the second flat plate portion 280*b* faces the inflow-side water flow pipe attaching portion 274*a*. In a state where the flap valve body 280 is turned to a position illustrated in FIG. 20, the first flat plate portion 280*a* faces the air intake/water discharge opening 274*c*. The shaft 281 is disposed outside a perpendicular projection plane of the air intake/water discharge opening 274*c*. That is, the shaft 281 is located outside the projection plane of the air intake/water discharge opening 274*c* that is formed by applying light perpendicularly to the air intake/water discharge opening 274*c*.

As illustrated in FIG. 20, a torsion coil spring 284 is disposed on an upper side of the flap valve body 280, the torsion coil spring 284 is attached to surround the shaft 281. The flap valve body 280 is biased by the torsion coil spring 284 in the opening direction or to be turned from the position illustrated in FIG. 20 to the position illustrated in FIG. 19.

As described above, the second flat plate portion 280*b* of the flap valve body 280 faces the inflow port 274*d* at the proximal end of the inflow-side water flow pipe attaching portion 274*a*, and a disk-shaped small packing 283 (FIG. 21) is attached at a position of the second flat plate portion 280*b*, the position facing the inflow port 274*d*. Since the water supplied from the water supply controller 18 is discharged from the inflow port 274*d* toward the second flat plate portion 280*b*, the second flat plate portion 280*b* is pressed when the water flows in from the inflow port 274*d*, and the flap valve body 280 is turned in the clockwise direction in FIG. 21. Hereby, the flap valve body 280 is turned from the state illustrated in FIG. 19 to the state illustrated in FIG. 20.

As described above, the first flat plate portion 280*a* of the flap valve body 280 faces the air intake/water discharge opening 274*c*, and is configured to cover the air intake/water discharge opening 274*c* when the flap valve body 280 is turned to the state illustrated in FIG. 20. A thin plate-shaped packing 282 (FIG. 19) is attached to a surface of the first flat plate portion 280*a*, the surface facing the air intake/water discharge opening 274*c*. When the flap valve body 280 is turned to the state illustrated in FIG. 20, a gap between the first flat plate portion 280*a* and the air intake/water discharge opening 274*c* is sealed. Here, since the shaft 281 supporting the flap valve body 280 is disposed outside the perpendicular projection plane of the air intake/water discharge opening 274*c*, a crush amount of the packing 282 can be reliably ensured in a state where the flap valve body 280 is turned to the state illustrated in FIG. 20.

On the other hand, in the case where the water flows backward from the inflow pipe 24*a* to the outflow-side water flow pipe attaching portion 274*b*, the backward-flow water contacts the rear surface of the second flat plate portion 280*b* through the gap between the first flat plate portion 280*a* of the flap valve body 280 and the bottom surface of the valve body case 272. Hereby, the flap valve body 280 is turned from the state illustrated in FIG. 20 to the state illustrated in FIG. 19. The water that has flowed backward from the outflow-side water flow pipe attaching portion 274*b* flows out through the air intake/water discharge opening 274*c*, and is discharged into the reservoir tank 10.

Next, the operations of the flush water tank apparatus according to the third embodiment of the present invention and the flush toilet apparatus will be described.

First, when a command signal for flushing the toilet is received, the water is supplied from the water supply controller 18, and flows into the discharge/vacuum break valve device 230. When the water flows into the discharge/vacuum break valve device 230, the second flat plate portion 280*b* of the flap valve body 280 is pushed, and is turned to the position illustrated in FIG. 20 against the biasing force of the torsion coil spring 284. In this way, the air intake/water discharge opening 274*c* in the discharge/vacuum break valve device 230 is closed by the first flat plate portion 280*a* of the flap valve body 280. The water that has flowed in through the inflow port 274*d* of the discharge/vacuum break valve device 230 flows into the inflow pipe 24*a* through the outflow port 274*e* while bypassing the flap valve body 280, in the valve body case 272.

Hereby, the flush water is supplied to the discharge valve hydraulic drive portion 14. A toilet flush operation by the flush water tank apparatus after the flush water is supplied to the discharge valve hydraulic drive portion 14 is similar to that in the first embodiment, and therefore description thereof is omitted.

Next, when the water supply from the water supply controller 18 is stopped after the toilet flush operation is completed, the dynamic pressure by the water supply is not applied to the second flat plate portion 280*b* of the flap valve body 280 provided in the discharge/vacuum break valve device 230. As a result, the flap valve body 280 is turned from the state illustrated in FIG. 20 to the state illustrated in FIG. 19 by the biasing force of the torsion coil spring 284, whereby the air intake/water discharge opening 274*c* is opened. On the other hand, when the water supply from the water supply controller 18 is stopped, the piston 14*b* (FIG. 4) of the discharge valve hydraulic drive portion 14 that has been pushed up to the second position is pushed down by the biasing force of the spring 14*c*. Hereby, most of the water with which the pressure chamber 16*a* in the cylinder 14*a* is filled flows backward toward the discharge/vacuum break valve device 230 through the inflow pipe 24*a*.

The water that has flowed backward from inflow pipe 24*a* to the discharge/vacuum break valve device 230 flows into the valve body case 272 through the outflow port 274*e* of the outflow-side water flow pipe attaching portion 274*b* as indicated by solid arrows in FIG. 19, and flows out beyond the bottom edge of the air intake/water discharge opening 274*c*. The water that has flowed out from the air intake/water discharge opening 274*c* in the discharge/vacuum break valve device 230 is discharged into the reservoir tank 10. The outflow port 274*e* is provided below the inflow port 274*d*, which can prevent the water that has flowed backward into the discharge/vacuum break valve device 230 through the outflow port 274*e* from flowing backward to the inflow port 274*d*.

Furthermore, since the air intake/water discharge opening 274*c* is formed so that an area thereof is larger than that of the outflow port 274*e*, the air intake/water discharge opening 274*c* is not filled with the water that has flowed backward through the outflow port 274*e*, and the water that has flowed backward through the outflow port 274*e* is discharged promptly. With this configuration, the water that has flowed backward into the discharge/vacuum break valve device 230 through the outflow port 274*e* can be reliably prevented from flowing backward to the water supply controller 18 on the upstream side. Thus, the water that has flowed backward from the discharge valve hydraulic drive portion 14 can be discharged promptly, and therefore the remaining water in the cylinder 14*a* can be discharged quickly, and the flush water tank apparatus can be returned to an initial state rapidly.

On the other hand, when the air intake/water discharge opening 274*c* in the discharge/vacuum break valve device 230 is opened, external air is drawn into the valve body case 272 through an upper portion of the air intake/water discharge opening 274*c* as indicated by dotted arrows in FIG. 19. That is, the air intake/water discharge opening 274*c* is formed vertically long, which makes it possible to discharge the water that has flowed backward through the outflow port 274*e* from the lower portion of the air intake/water discharge opening 274*c* while easily introducing the external air from the upper portion of the air intake/water discharge opening 274*c*. Thus, even when the water supply from the water supply controller 18 is stopped and the pressure on the inflow-side water flow pipe attaching portion 274*a* side is negative, the external air is drawn from the discharge/vacuum break valve device 230, thereby preventing the water that has flowed backward from the inflow pipe 24*a* from flowing backward to the water supply controller 18.

Thus, when the water supply from the upstream side is stopped, the flap valve body 280 in the discharge/vacuum break valve device 230 is operated to discharge the water that has flowed backward from the discharge valve hydraulic drive portion 14 while opening the upstream side to the atmosphere. The discharge/vacuum break valve device 230 has both of a function of discharging the water that has flowed backward from the downstream side and a function of drawing the external air into a conduit, and the air intake/water discharge opening 274*c* functions as an inlet port of the external air and a discharge port of the water in the conduit.

According to the flush water tank apparatus of the third embodiment of the present invention, the flap valve body 280 is supported by the shaft 281 directed vertically, thereby making it possible to turn the flap valve body 280 without being substantially affected by the gravity.

Next, referring to FIGS. 22 and 23, a flush water tank apparatus according to a fourth embodiment of the present invention and a flush toilet apparatus provided with the same will be described.

The flush water tank apparatus of the present embodiment includes a power generator, and is different from the flush water tank apparatus in the first embodiment in that an electromagnetic valve of a power supply controller is operated with electric power generated by the power generator. Accordingly, the following describes only the components, operations and effects that are different between the first embodiment and the fourth embodiment of the present invention. Components similar to those in the first embodiment are denoted by the same reference numerals as those in the first embodiment, and description thereof is omitted.

Figure 22:
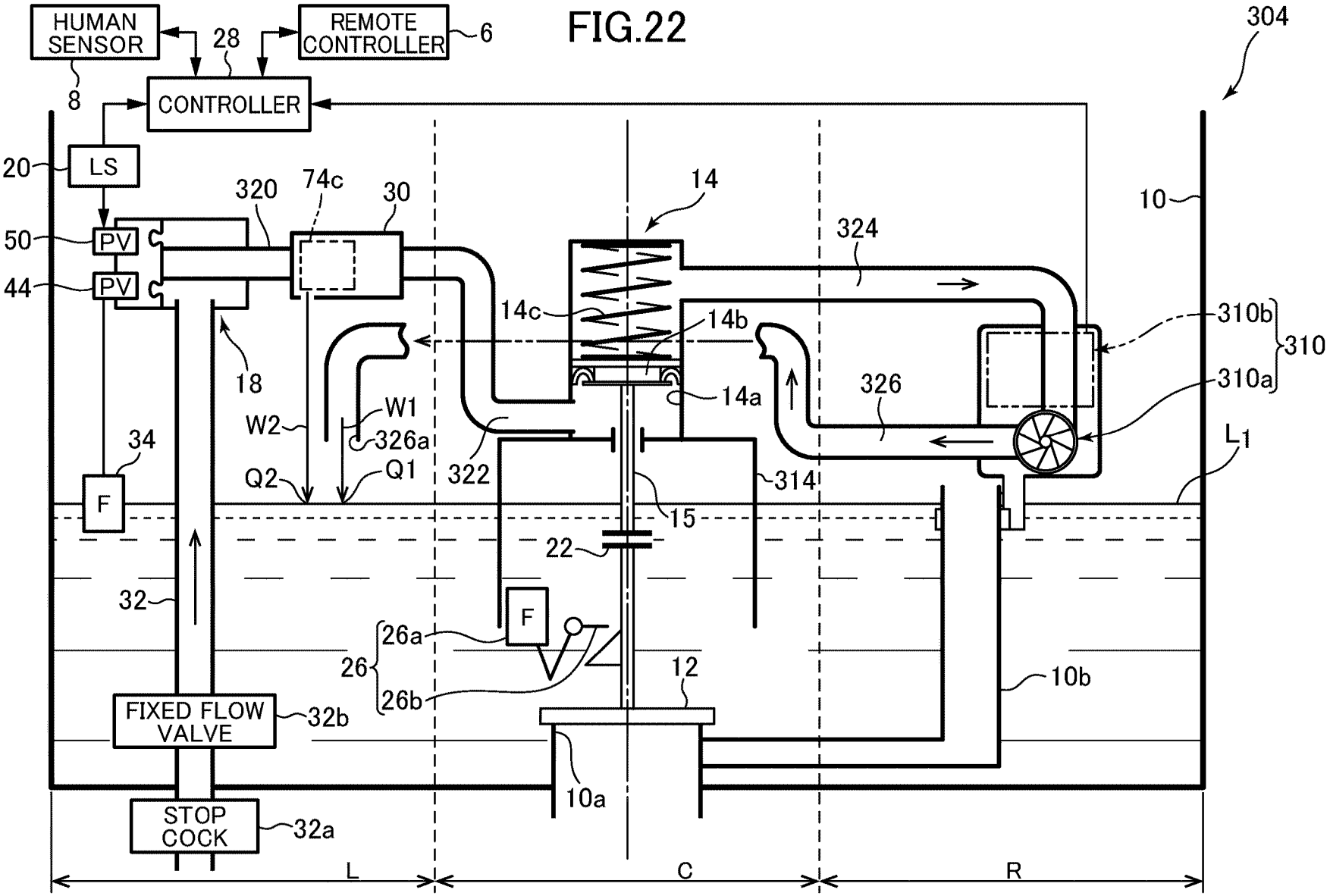
FIG. 22 is a front sectional view illustrating a schematic configuration of a flush water tank apparatus according to a fourth embodiment of the present invention.

FIG. 22 is a front sectional view illustrating a schematic configuration of the flush water tank apparatus according to the fourth embodiment of the present invention. FIG. 23 is a plan sectional view illustrating the schematic configuration of the flush water tank apparatus according to the fourth embodiment of the present invention.

Figure 23:
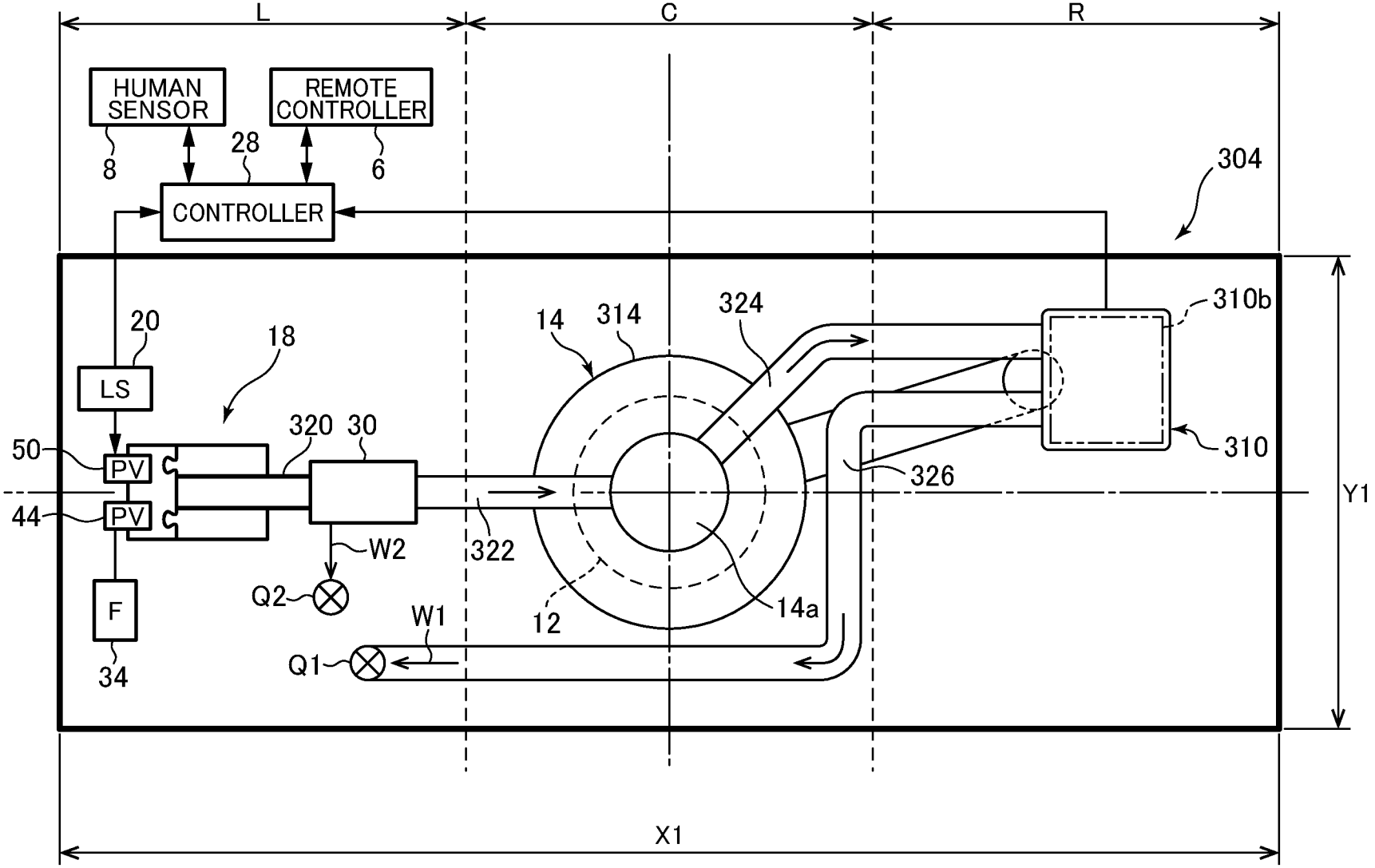
FIG. 23 is a plan sectional view illustrating the schematic configuration of the flush water tank apparatus according to the fourth embodiment of the present invention.

As illustrated in FIGS. 22 and 23, a flush water tank apparatus 304 according to the fourth embodiment of the present invention includes a power generator 310 in the reservoir tank 10. The power generator 310 includes a water turbine 310*a* and a power generating portion 310*b*. The water turbine 310*a* is configured to be rotated by the flow of the water supplied to the power generator 310. The power generating portion 310*b* is configured to generate electric power by the rotation of the water turbine 310*a*.

The electric power generated by the power generator 310 is transmitted to the controller 28, and is accumulated in a battery (not illustrated) built in the controller 28. Hereby, the water is supplied to the power generator 310 to generate the electric power every time when the flush toilet main unit 2 is washed by the flush water tank apparatus 304, and the electric power is accumulated in the battery (not illustrated). In the flush water tank apparatus 304 of the present embodiment, the controller 28 and an electromagnetic valve 20 of the water supply controller 18 are operated by the electric power generated by the power generator 310 and accumulated in the battery (not illustrated). Therefore, the flush water tank apparatus 304 can be installed also in a toilet room in which an external power supply cannot be acquired. The control of the electromagnetic valve 20 of the water supply controller 18 by the controller 28, and the operation of the water supply controller 18 are similar to those in the first embodiment, and therefore description thereof is omitted.

As illustrated in FIG. 22, the power generator 310 is attached at an upper end of the overflow pipe 10*b* to be located above the stopped water level $L_1$ in the reservoir tank 10. That is, since the power generator 310 is disposed above an upper end opening at the upper end of the overflow pipe 10*b*, the power generator 310 is not submerged in the water even when the water level in the reservoir tank 10 has risen. Furthermore, in the present embodiment, the power generator 310 is disposed in a right-side region R among a left-side region L, a center region C, and the right-side region R that are obtained by equally dividing the reservoir tank 10 into three in a left-right direction X1 (FIG. 23) on the plan view. Additionally, as illustrated in FIG. 23, in the present embodiment, the power generator 310 is disposed in a rear-side region of two regions obtained by equally dividing the reservoir tank 10 into two in a front-rear direction Y1 on the plan view.

Furthermore, in the present embodiment, the water supply controller 18 and the discharge/vacuum break valve device 30 are disposed in the left-side region L, and the discharge valve hydraulic drive portion 14 is disposed in the center region C. As illustrated in FIG. 23, in the present embodiment, the discharge valve hydraulic drive portion 14 is disposed in the substantially center of the reservoir tank 10 in the front-rear direction on the plan view.

In the present embodiment, the discharge valve hydraulic drive portion 14 includes an outer shell portion 314. The outer shell portion 314 is a frame-shaped member that supports the cylinder 14*a* and the like of the discharge valve hydraulic drive portion 14 with respect to the reservoir tank 10. The cylinder 14*a* is provided above the outer shell portion 314. Furthermore, as illustrated in FIG. 23, the outer shell portion 314 is disposed to surround the discharge valve 12 on the plan view.

Here, as illustrated in FIG. 22, the water supply controller 18 and the discharge/vacuum break valve device 30 are connected to each other by a water flow pipe 320, and the discharge/vacuum break valve device 30 and the cylinder 14*a* are connected to each other by a water flow pipe 322. Furthermore, the cylinder 14*a* and the power generator 310 are connected to each other by a water flow pipe 324, and a water flow pipe 326 is connected to the downstream side of the power generator 310. The water flow pipe 326 extending from the power generator 310 partially extends higher, so that the water remains around the water turbine 310*a* in the power generator 310 even after the water supply to the power generator 310 is stopped.

With such a configuration, the water supplied from the water supply controller 18 flows into the discharge/vacuum break valve device 30 through the water flow pipe 320, and the water that has flowed out from the discharge/vacuum break valve device 30 flows into the cylinder 14*a* through the water flow pipe 322. Furthermore, the water that has flowed out from the cylinder 14*a* flows into the power generator 310 through the water flow pipe 324, and the water that has flowed out from the power generator 310 flows into the reservoir tank 10 through the water flow pipe 326. That is, the water that has flowed from the power generator 310 into the water flow pipe 326 flows out from an outlet 326*a* at the end of the water flow pipe 326, and lands on a landing position Q1 on the water surface in the reservoir tank 10.

As illustrated in FIG. 22, the water flow pipe 326 extends substantially horizontally from the power generator 310 disposed in the right-side region R of the reservoir tank 10 to the outlet 326*a* located in the left-side region L, and the landing position Q1 of the water W1 that has flowed out from the outlet 326*a* is also located in the left-side region L. Accordingly, the power generator 310 disposed in the right-side region R is disposed on an opposite side across the outer shell portion 314 of the discharge valve hydraulic drive portion 14 from the landing position Q1 located in the left-side region L. In other words, in the case where the reservoir tank 10 is equally divided into three regions, which are the left-side region L, the center region C, and the right-side region R, in the left-right direction X1 on the plan view, the power generator 310 is disposed in a region different from the region to which the landing position Q1 belongs. As a modification example, the present invention can be configured so that the power generator 310 is disposed in the left-side region L, and the landing position Q1 is disposed in the right-side region R.

In the present embodiment, since the discharge/vacuum break valve device 30 is also disposed in the left-side region L, a landing position Q2 of the water W2 discharged from the air intake/water discharge opening 74*c* in the discharge/vacuum break valve device 30 is also located in the left-side region L. Therefore, the power generator 310 disposed on an opposite side across the outer shell portion 314 of the discharge valve hydraulic drive portion 14 from the landing position Q2 located in the left-side region L. In other words, in the case where the reservoir tank 10 is equally divided into three regions, which are the left-side region L, the center region C, and the right-side region R, in the left-right direction X1 on the plan view, the power generator 310 is disposed in a region different from the region to which the landing position Q2 belongs. As a modification example, the present invention can be configured so that the power generator 310 is disposed in the left-side region L, and the landing position Q2 is disposed in the right-side region R.

Furthermore, as illustrated in FIG. 23, the landing position Q2 of the water W2 discharged from the air intake/water discharge opening 74*c* in the discharge/vacuum break valve device 30 is located in a front-side region of two regions obtained by equally dividing the reservoir tank 10 into two in the front-rear direction Y1 on the plan view. Accordingly, the power generator 310 disposed in a region on the rear side of the reservoir tank 10 is disposed on an opposite side across the outer shell portion 314 of the discharge valve hydraulic drive portion 14 from the landing position Q2 located in the front-side region. In other words, in the case where the reservoir tank 10 is equally divided into two in the front-rear direction, the power generator 310 is disposed in a region different from the region to which the landing position Q2 belongs. As a modification example, the present invention can be configured so that the power generator 310 is disposed in the front-side region, and the landing position Q2 is disposed in the rear-side region.

According to the flush water tank apparatus 304 of the fourth embodiment of the present invention, the power generator 310 is located above the stopped water level $L_1$ in the reservoir tank 10 (FIG. 22), and is disposed on an opposite side across the outer shell portion 314 from the landing position Q2 where the water discharged from the discharge/vacuum break valve device 30 lands on the water surface in the reservoir tank 10, in the left-right direction on the plan view. As a result, the outer shell portion 314 blocks scattering of the water when the water that has flowed out from the discharge/vacuum break valve device 30 lands on the water surface in the reservoir tank 10, thereby making it possible to prevent exposure of the power generator 310 to the water.

Additionally, according to the flush water tank apparatus 302 of the present embodiment, among the left-side region L, the center region C, and the right-side region R on the plan view, the power generator 310 is disposed in a region different from the region to which the landing position Q2 belongs (FIG. 22), thereby making it possible to secure a relatively large distance between the landing position Q2 and the power generator 310. This can effectively prevent the power generator 310 from being splashed with the water scattered when the water that has flowed out from the discharge/vacuum break valve device 30 lands on the water surface in the reservoir tank 10.

Furthermore, according to the flush water tank apparatus 304 of the present embodiment, the landing position Q2 of the water that has flowed out from the discharge/vacuum break valve device 30 is located in the left-side region L in the reservoir tank 10, whereas the power generator 310 is disposed in the right-side region R (FIG. 22). This makes it possible to secure the relatively large distance between the landing position Q2 and the power generator 310 in the reservoir tank 10, and effectively prevent the power generator 310 from being splashed with the water scattered when the water that has flowed out from the discharge/vacuum break valve device 30 lands on the water surface in the reservoir tank 10.

Additionally, according to the flush water tank apparatus 304 of the present embodiment, the power generator 310 is disposed on an opposite side across the outer shell portion 314 in the front-rear direction from the landing position Q2 of the water that has flowed out from the discharge/vacuum break valve device 30 (FIG. 23), whereby the outer shell portion 314 can block scattering of the water when the water that has flowed out from the discharge/vacuum break valve device 30 lands on the landing position Q2, which makes it possible to effectively prevent exposure of the power generator 310 to the water.

Furthermore, according to the flush water tank apparatus 304 of the present embodiment, the cylinder 14*a* of the discharge valve hydraulic drive portion 14 is provided above the outer shell portion 314 (FIG. 22), whereby the cylinder 14*a* can block scattering of the water when the water that has flowed out from the discharge/vacuum break valve device 30 lands on the landing position Q2, which makes it possible to more effectively prevent exposure of the power generator 310 to the water.

Although the flush water tank apparatus according to the embodiments of the present invention and the flush toilet apparatus provided with the same have been described, it should be understood that various changes and modifications may be made in the above-described embodiments. In particular, in the above-described embodiments, the discharge/vacuum break valve device includes a flap type valve body, but a direct-acting valve body or any type of valve body can be applied thereto.

REFERENCE SIGNS LIST

1 Flush toilet apparatus
2 Flush toilet main unit (flush toilet)
2*a* Bowl
4 Flush water tank apparatus
6 Remote controller
8 Human sensor
10 Reservoir tank
10*a* Discharge port
10*b* Overflow pipe
12 Discharge valve
12*a* Valve shaft
12*b* Valve body portion
12*c* Engaging projection
12*d* Support portion
14 Discharge valve hydraulic drive portion
14*a* Cylinder
14*b* Piston
14*c* Spring
14*d* Gap
14*e* Packing (elastic member)
14*f* Sleeve
14*g* Outflow guiding portion
15 Rod (drive member)
15*a* Thin thickness portion
15*b* Pull-up portion
15*c* Upper surface
15*d* Abutted portion
16*a* Pressure chamber
16*b* Back pressure chamber
17 Communicating flow path
17*a* Upper end opening (back pressure chamber opening)
17*b* Side opening (rod opening)
17*c* Edge portion
18 Water supply controller
20 Electromagnetic valve
22 Clutch mechanism
24*a* Inflow pipe
24*b* Outflow pipe
24*c* Outflow pipe branching portion
24*d* Orifice (flow rate reduction unit)
25*a* Inflow port
25*b* Outflow port
26 Discharge valve float mechanism (float mechanism)
26*a* Float portion (float)
26*b* Engaging portion
26*c* Float shaft
28 Controller
30 Discharge/vacuum break valve device
32 Water supply pipe
32*a* Stop cock
32*b* Fixed flow valve
34 Water supply valve float
36 Main body portion
36*a* Pressure chamber
38 Main valve body
40 Valve seat
42 Arm portion
44 Float-side pilot valve
50 Electromagnetic valve-side pilot valve
60 Movable member
62 Base plate
64 Arm
66 Rotary shaft
68 Abutting portion
70 Restricting portion
72 Valve body case
74 Main body portion
74*a* Opening portion
74*b* Attaching portion

74*c* Air intake/water discharge opening
74*d* Top edge
74*e* Bottom edge
76 Inflow pipe connection member
76*a* Water flow pipe attaching portion
76*b* Bearing portion
76*c* Inflow port
78 Outflow pipe connection member
78*a* Water flow pipe attaching portion
78*b* Outflow port
80 Flap valve body (valve body)
80*a* Support shaft (central axis)
80*b* Supply water receiving portion
80*c* Valve plate portion
80*d* Discharge water receiving portion
80*e* Weight attaching portion
82 Packing
82*a* Weight
84 Coil spring (biasing spring)
90 Negative pressure break valve
92 Negative pressure break valve body
94 Air opening
96*a* Main valve port
96*b* Main valve body
98 Outflow port
130 Discharge/vacuum break valve device
172 Valve body case
174 Main body portion
174*a* Upper attaching portion
174*b* Lower attaching portion
174*c* Air intake/water discharge opening
174*d* Top edge
174*e* Bottom edge
176 Lid member
176*a* Bearing portion
177 Inflow pipe connection member
177*a* Water flow pipe attaching portion
177*b* Inflow port
178 Outflow pipe connection member
178*a* Water flow pipe attaching portion
178*b* Outflow port
180 Flap valve body
180*a* Support shaft
180*b* Valve plate portion
180*c* Discharge water receiving portion
180*d* Weight attaching portion
182 Packing
182*a* Weight
230 Discharge/vacuum break valve device
272 Valve body case
274 Main body portion
274*a* Inflow-side water supply pipe attaching portion
274*b* Outflow-side water supply pipe attaching portion
274*c* Air intake/water discharge opening
274*d* Inflow port
274*e* Outflow port
276 Lid member
278 Cover
280 Flap valve body
280*a* First flat plate portion
280*b* Second flat plate portion
280*c* Connection portion
281 Shaft
282 Packing
283 Small packing
284 Torsion coil spring
304 Flush water tank apparatus
310 Power generator
310*a* Water turbine
310*b* Power generating portion
314 Outer shell portion
320 Water flow pipe
322 Water flow pipe
324 Water flow pipe
326 Water flow pipe
326*a* Outlet

What is claimed is:

1. A flush water tank apparatus configured to supply flush water to a flush toilet, comprising:

a reservoir tank configured to store the flush water to be supplied to the flush toilet and having a discharge port formed to discharge the stored flush water to the flush toilet;

a discharge valve configured to open and close the discharge port to supply the flush water to the flush toilet and to stop a supply of the flush water to the flush toilet;

a discharge valve hydraulic drive portion configured to drive the discharge valve using a water supply pressure of the supplied water; and a discharge/vacuum break valve device provided on an upstream side of the discharge valve hydraulic drive portion and configured to supply the water supplied from the upstream side to the discharge valve hydraulic drive portion on a downstream side, wherein the discharge valve hydraulic drive portion includes:

a cylinder into which the water supplied through the discharge/vacuum break valve device flows; and a piston that is slidably disposed in the cylinder, and is configured to be moved by a pressure of the water flowing into the cylinder, lifting the discharge valve with a force based on the pressure of the water supplied through the discharge/vacuum break valve device, and wherein the discharge/vacuum break valve device includes:

a valve body that operates, when the supply of the water from the upstream side is stopped, to discharge the water flowing backward from the discharge valve hydraulic drive portion simultaneously with opening the upstream side of the discharge/vacuum break valve device to an atmosphere.

2. The flush water tank apparatus according to claim 1, wherein the discharge/vacuum break valve device includes an inflow port through which the supplied water flows, an outflow port through which the water flowing into the discharge/vacuum break valve device is supplied to the discharge valve hydraulic drive portion, and an air intake/water discharge opening configured to be opened and closed by the valve body, the inflow port is provided above the outflow port, and the air intake/water discharge opening is formed in a vertical face or a sloping surface.

3. The flush water tank apparatus according to claim 2, wherein an area of the air intake/water discharge opening in the discharge/vacuum break valve device is larger than the area of the outflow port in the discharge/vacuum break valve device.

4. The flush water tank apparatus according to claim 2, wherein the air intake/water discharge opening is formed to be longer in a vertical direction than in a horizontal direction.

5. The flush water tank apparatus according to claim 2, wherein the valve body of the discharge/vacuum break valve device is provided turnably around a predetermined central axis, and the air intake/water discharge opening is opened and closed by turning the valve body.

6. The flush water tank apparatus according to claim 5, wherein the predetermined central axis is disposed outside a perpendicular projection plane of the air intake/water discharge opening.

7. The flush water tank apparatus according to claim 2, wherein a bottom edge of the air intake/water discharge opening is formed to extend horizontally, and the water flowing backward from the discharge valve hydraulic drive portion to the discharge/vacuum break valve device is discharged into the reservoir tank beyond the bottom edge.

8. The flush water tank apparatus according to claim 7, wherein a top edge of the air intake/water discharge opening is formed to extend horizontally.

9. The flush water tank apparatus according to claim 2, wherein the discharge/vacuum break valve device includes a biasing spring, and the biasing spring biases the valve body in a direction in which the air intake/water discharge opening is opened.

10. The flush water tank apparatus according to claim 9, wherein the biasing spring is configured to increase an increase in biasing force with respect to an increase in deformation amount as the deformation amount is increased.

11. The flush water tank apparatus according to claim 9, wherein the biasing spring does not apply the biasing force to the valve body in a state where the air intake/water discharge opening is open by a predetermined amount or more.

12. The flush water tank apparatus according to claim 1, wherein the valve body is in a stand-by position where a position of the center of gravity of the valve body is lowest in a state where the water is not supplied to the discharge/vacuum break valve device.

13. The flush water tank apparatus according to claim 12, wherein the valve body includes a weight.

14. The flush water tank apparatus according to claim 1, further comprising:

a flow rate reduction unit configured to reduce a flow rate of the water flowing backward from the discharge valve hydraulic drive portion to the discharge/vacuum break valve device.

15. A flush toilet apparatus, comprising:

the flush water tank apparatus according to claim 1; and the flush toilet that is to be washed with flush water supplied from the flush water tank apparatus.

* * * * *